US008110328B2

(12) United States Patent
Yamada et al.

(10) Patent No.: US 8,110,328 B2
(45) Date of Patent: Feb. 7, 2012

(54) ELECTROPHOTOGRAPHIC PHOTORECEPTOR, PROCESS CARTRIDGE AND IMAGE FORMING APPARATUS

(75) Inventors: Wataru Yamada, Kanagawa (JP); Katsumi Nukada, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 800 days.

(21) Appl. No.: 12/049,684

(22) Filed: Mar. 17, 2008

(65) Prior Publication Data

US 2008/0261135 A1 Oct. 23, 2008

(30) Foreign Application Priority Data

Apr. 9, 2007 (JP) ..... 2007-102101

(51) Int. Cl.
*G03G 5/00* (2006.01)

(52) U.S. Cl. ..... 430/66; 430/56; 430/58.05; 430/58.2; 399/159

(58) Field of Classification Search ..... 430/58.05, 430/58.2, 56, 58.77, 66, 58.1, 58.75; 399/159
See application file for complete search history.

(56) References Cited

U.S. PATENT DOCUMENTS

| | | | | |
|---|---|---|---|---|
| 5,298,617 | A | 3/1994 | Nukada et al. | |
| 5,302,479 | A | 4/1994 | Daimon et al. | |
| 5,459,004 | A | 10/1995 | Daimon et al. | |
| 7,955,770 | B2 * | 6/2011 | Miyakawa et al. | 430/66 |
| 2002/0034701 | A1 * | 3/2002 | Morikawa et al. | 430/66 |
| 2002/0103316 | A1 | 8/2002 | Tanaka et al. | |
| 2005/0026058 | A1 * | 2/2005 | Kami et al. | 430/66 |
| 2005/0181291 | A1 * | 8/2005 | Kami et al. | 430/66 |
| 2006/0014097 | A1 * | 1/2006 | Perry et al. | 430/133 |
| 2006/0216619 | A1 | 9/2006 | Iwasaki et al. | |
| 2006/0292464 | A1 * | 12/2006 | Yamada et al. | 430/56 |
| 2007/0003850 | A1 * | 1/2007 | Yamada et al. | 430/58.05 |
| 2010/0167192 | A1 * | 7/2010 | Yamada et al. | 430/66 |

FOREIGN PATENT DOCUMENTS

| | | |
|---|---|---|
| EP | 0 710 893 A1 | 5/1996 |
| JP | A-47-030330 | 11/1972 |
| JP | A-53-146631 | 12/1978 |
| JP | A-62-251756 | 11/1987 |
| JP | A-04-189873 | 7/1992 |
| JP | A-05-043813 | 2/1993 |
| JP | A-05-098181 | 4/1993 |
| JP | A-05-140472 | 6/1993 |
| JP | A-05-140473 | 6/1993 |
| JP | A-05-263007 | 10/1993 |
| JP | A-05-279591 | 10/1993 |
| JP | A-08-176293 | 7/1996 |
| JP | A-08-208820 | 8/1996 |

(Continued)

OTHER PUBLICATIONS

Sep. 27, 2011 Japanese Office Action issued in Japanese Patent Application No. 2007-102101 (with translation).

*Primary Examiner* — Christopher Rodee
*Assistant Examiner* — Stewart Fraser
(74) *Attorney, Agent, or Firm* — Oliff & Berridge, PLC

(57) ABSTRACT

An electrophotographic photoreceptor comprising a conductive support and a photosensitive layer provided on or above the conductive support, the photosensitive layer having an outermost layer comprising a cured product of a composition comprising a curable resin, a surfactant containing a fluorine atom, and a charge transporting organic compound having a specific structure.

16 Claims, 9 Drawing Sheets

FOREIGN PATENT DOCUMENTS

| | | |
|---|---|---|
| JP | A-9-6034 | 1/1997 |
| JP | A-9-15891 | 1/1997 |
| JP | A-11-209787 | 8/1999 |
| JP | A-2002-006527 | 1/2002 |
| JP | A-2002-082466 | 3/2002 |
| JP | A-2002-082469 | 3/2002 |
| JP | A-2003-29438 | 1/2003 |
| JP | A-2003-186215 | 7/2003 |
| JP | A-2003-186234 | 7/2003 |
| JP | A-2004-101813 | 4/2004 |
| JP | A-2004-219925 | 8/2004 |
| JP | A-2005-292413 | 10/2005 |
| JP | A-2006-48031 | 2/2006 |
| JP | A-2006-84711 | 3/2006 |
| JP | A-2006-154631 | 6/2006 |
| JP | A-2006-184527 | 7/2006 |
| JP | A-2007-133344 | 5/2007 |
| WO | WO 2006/004171 A1 | 1/2006 |

* cited by examiner

ELECTROPHOTOGRAPHIC PHOTORECEPTOR, PROCESS CARTRIDGE AND IMAGE FORMING APPARATUS

CROSS-REFERENCE TO RELATED APPLICATION

This application is based on and claims priority under 35 USC 119 from Japanese Patent Application No. 2007-102101 filed Apr. 9, 2007.

BACKGROUND

1. Field of the Invention

The invention is related to an electrophotographic photoreceptor, a process cartridge, and an image forming apparatus.

2. Description of the Related Art

Xerographic image forming apparatuses are equipped with an electrophotographic photoreceptor (hereinafter, sometimes simply referred to as "a photoreceptor"), a charging unit, an exposure unit, a developing unit, and a transferring unit, and form images by an electrophotographic process using these units.

Xerographic image forming apparatuses have increased in speed and have extended operating lifes due to technological developments in each member and in the system as a whole. Along with such changes, there are increasing requirements for each subsystem to be able to cope with high speeds and provide high reliability.

In order to achieve a longer operating life of an electrophotographic photoreceptor, it is very important to prevent scratches or abrasion, and curable resins are being developed in order to improve the mechanical strength of the photosensitive layer.

In image forming apparatuses with requirements for each subsystem to be able to cope with high speeds and provide high reliability, there are particularly strenuous requirements for the photoreceptor that is used for image writing and for the cleaning member that cleans the photoreceptor to be able to cope with high speeds and provide high reliability.

There have also been some investigations into the properties, such as mechanical strength, of functional layers using an alcohol soluble curable resin. However, there has been insufficient investigation from the viewpoint of improving film formation properties.

SUMMARY

According to an aspect of the invention, there is provided an electrophotographic photoreceptor comprising a conductive support and a photosensitive layer provided on or above the conductive support, the photosensitive layer having an outermost layer comprising a cured product of a composition comprising a curable resin, a surfactant containing a fluorine atom, and at least one charge transporting organic compound represented by any one of the following formulae (I) to (V):

$$F—[(X^2)_{n2}—(R^2)_{n3}—(Z^2)_{n4}G]_{n5} \quad (I)$$

wherein in Formula (I): F represents an n5-valent organic group derived from a compound having a hole transporting capability; $X^2$ represents an oxygen atom or a sulfur atom; $R^2$ represents an alkylene group; $Z^2$ represents an oxygen atom, a sulfur atom, NH or COO; G represents an epoxy group; n2, n3 and n4 each independently represent 0 or 1; and n5 is an integer of 1 to 4:

$$F\text{-}[\text{-}D\text{-}Si(R^3)_{(3-a)}Q_a]_b \quad (II)$$

wherein in Formula (II): F represents a b-valent organic group derived from a compound having a hole transporting capability; D represents a bivalent group; $R^3$ represents a hydrogen atom, a substituted or unsubstituted alkyl group, or a substituted or unsubstituted aryl group; Q represents a hydrolyzable group; a is an integer of 1 to 3; and b is an integer of 1 to 4:

(III)

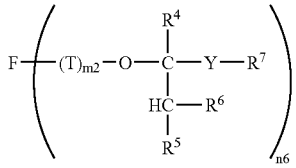

wherein in Formula (III): F represents an n6-valent organic group derived from a compound having a hole transporting capability; T represents a bivalent group; Y represents an oxygen atom or a sulfur atom; $R^4$, $R^5$ and $R^6$ each independently represent a hydrogen atom or a monovalent organic group; $R^7$ represents a monovalent organic group; m2 is 0 or 1; n6 is an integer of 1 to 4; and $R^6$ and $R^7$ may bind to each other to form a heterocyclic ring containing Y as the heteroatom:

(IV)

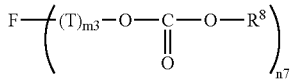

wherein in Formula (IV): F represents an n7-valent organic group derived from a compound having a hole transporting capability; T represents a bivalent group; $R^8$ represents a monovalent organic group; m3 is 0 or 1; and n7 is an integer of 1 to 4:

(V)

wherein in Formula (V): F represents an n8-valent organic group derived from a compound having a hole transporting capability; L represents an alkylene group; $R^9$ represents a monovalent organic group; and n8 is an integer of 1 to 4.

BRIEF DESCRIPTION OF THE DRAWINGS

Exemplary embodiments of the present invention will be described in detail based on the following figures, wherein.

DETAILED DESCRIPTION (Electrophotographic Photoreceptor)

Figure 1:
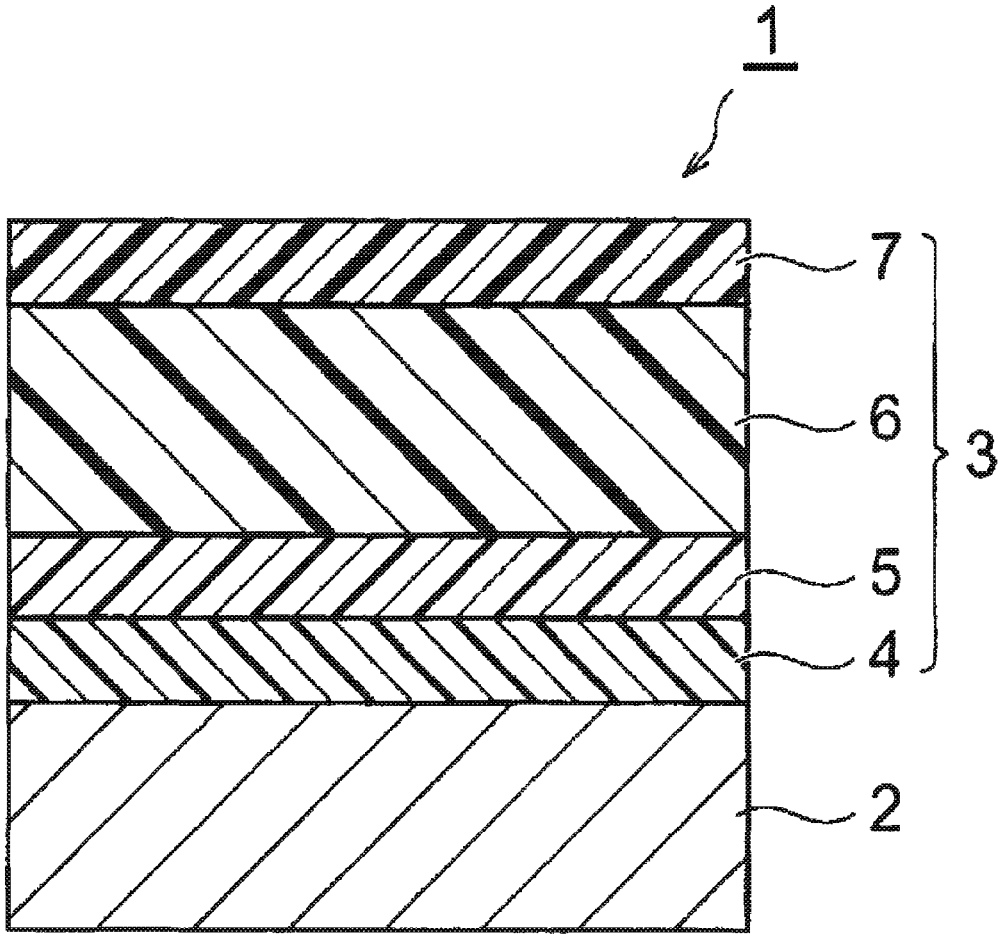
FIG. 1 is a schematic sectional view of an exemplary embodiment of the electrophotographic photoreceptor of the invention.

The electrophotographic photoreceptor in the present exemplary embodiment is equipped with a conductive support and a photosensitive layer formed on the conductive substrate, the layer having the outmost layer composed of a cured product of a composition containing a curable resin, a fluorine atom containing surfactant and at least one organic charge-transporting compound represented by Formula (I) to (V) to be described later.

The electrophotographic photoreceptor in the present exemplary embodiment, in such a configuration as above, has an outermost layer on the photosensitive layer. The outermost layer is formed due to smaller variation in component in a thickness direction and fewer defects. The electrophotographic photoreceptor in the present exemplary embodiment is thus superior in strength and environment stability and gives favorable high-quality images for an extended period of time. In addition, the electrophotographic photoreceptor in the present exemplary embodiment in the above configuration exhibits favorable cleaning characteristics over an extended period of time.

Generally, it is thought that when a thin film is formed using a coating solution containing a curable resin (in particular, an alcohol-soluble curable resin), the surface tension (or surface energy) of the curable resin changes significantly during formation of a film from the coating solution, and consequently causing film defects such as cissing. In this regard, it is thought that the addition of a fluorine atom containing surfactant is effective in reducing the change in surface tension (or surface energy) of the curable resin, and consequently sufficiently preventing generation of film defects.

In addition, it is thought that since the fluorine atom containing surfactant is miscible favorably with a coating solution containing a curable resin (in particular, an alcohol-soluble curable resin), the film characteristics do not change significantly during a period between the initial and latter phases of use, i.e., the variation in composition of the outmost layer is restricted, even when the photosensitive layer is used repeatedly as the outmost layer is gradually abraded. Use of the fluorine atom containing surfactant is also thought to be effective in improving the efficiency of removing the residual toner after a transferring process or discharge products such as NOx and an ozone gas generated, for example, by an electrostatic stress in an electrophotographic process.

On the other hand, use of an organic charge-transporting compound represented by any one of Formulae (I) to (V) as described later is thought to be effective in improving strength and also environment stability of the outmost layer.

Although the reasons are not yet clear, it is thought that by using a fluorine atom containing surfactant together, an organic charge-transporting compound represented by any one of Formulae (I) to (V) described later is dispersed uniformly in molecular level in a liquid or film, without forming a micellar structure, and thereby assuring favorable charge transfer even under the change in environment.

For the reasons as described above, it is thought that in the electrophotographic photoreceptor in the present exemplary embodiment, an outermost layer is formed on the photosensitive layer with smaller variation in its composition in a thickness direction, and with fewer defects, and thereby a photosensitive layer superior in strength and environment stability and capable of forming images of favorable quality for an extended period of time is obtained.

Hereinafter, favorable exemplary embodiments of the invention will be described in detail, with reference to drawings.

FIG. 1 is a schematic sectional view illustrating the electrophotographic photoreceptor in the present exemplary embodiment. The electrophotographic photoreceptor 1 shown in FIG. 1 is a type of so-called function-separated photoreceptor (or laminate-type photoreceptor) having a structure consisting of an undercoat layer 4, a charge generating layer 5, a charge-transporting layer 6 and a protective layer 7, which are sequentially formed on a conductive support 2. In the electrophotographic photoreceptor 1, the undercoat layer 4, the charge generating layer 5, the charge-transporting layer 6 and the protective layer 7 are provided to form, in combination, a photosensitive layer 3. In the electrophotographic photoreceptor 1 shown in FIG. 1, the protective layer 7 is the outmost layer placed outmost from the conductive support 2, and the outmost layer is composed of a cured product of a composition containing a curable resin, a fluorine atom containing surfactant, and at least one of the organic charge-transporting compounds represented by Formulae (I) to (V) described later.

Examples of the materials for conductive support 2 include a metal plate, metal drum, metal belt and the like of a metal such as aluminum, copper, zinc, stainless steel, chromium, nickel, molybdenum, vanadium, indium, gold, platinum, or an alloy thereof. Other exemplary materials for conductive support 2 include paper, a plastic film, a belt and the like that are coated, vapor-deposited or laminated with a conductive polymer, a conductive compound such as indium oxide, or a metal such as aluminum, palladium, gold or an alloy thereof. The term "conductive" here is used for a material having a volume resistivity of less than $10^{13}$ Ωcm.

The surface of the conductive support 2 is preferably roughened, for example, to a ten-point average roughness (Rz) of 0.04 μm or more and 0.5 μm or less, in order to prevent interference fringes that occur during laser beam irradiation. The surface of a conductive support 2 having a surface ten-point average roughness (Rz) of less than 0.04 μm, nearly a state of mirror surface, often has an insufficient effect of preventing interference. On the other hand, when a ten-point average roughness (Rx) of conductive support 2 exceeds 0.5 μm, the image quality is often insufficient even when a film is formed. When a non-coherent light is used as a light source, surface roughening for preventing interference fringes is not particularly necessary, and occurrence of defects due to surface irregularity at the surface of conductive support 2 can be prevented, thereby leading to a longer product life.

The method for surface roughening is preferably wet honing where an abrasive suspended in water is sprayed onto a support; centerless grinding where a support is pressed against a revolving grindstone to sequentially perform grinding; anodic oxidation, and the like.

In addition to the above surface roughening methods, there is also a preferable method of forming a layer of a resin in which conductive or semiconductive powder is dispersed, on the surface of a support, and thus roughening the surface with the particles dispersed in the resin layer, without performing surface roughening of the surface of the conductive support 2.

In the anodic oxidation above, an oxide layer is formed on the surface of an aluminum plate by anodizing the aluminum plate as an anode in an electrolyte solution. As the electrolyte solution, a sulfuric acid solution, an oxalic acid solution and the like can be used. However, the anodized film, that is porous as it is, is chemically active and vulnerable to contamination, and the variation in resistance thereof due to the environment is significant. For the above reasons, the anodized film is preferably subjected to sealing processing to close the fine pores in the film by volume expansion due to hydration reaction, in pressurized water vapor or boiling water (a metal salt of nickel and the like may be added therein), and thereby converting to a stabler hydrated oxide.

The thickness of the anodized film is desirably 0.3 μm or more and 15 μm or less. An anodized film having a film thickness of less than 0.3 μm may be less effective as a barrier to injection. On the other hand, a film having a thickness of more than 15 μm may cause the increase in residual potential as a result of repeated use.

Alternatively, the conductive support 2 may be treated with an acidic aqueous solution or with boehmite. The treatment with an acidic processing solution containing phosphoric acid, chromic acid, and hydrofluoric acid is performed in the following manner: First, an acidic processing solution is prepared. The contents of the phosphoric acid, chromic acid and hydrofluoric acid in the acidic processing solution are preferably in the range of 10 wt % or more and 11 wt % or less, 3 wt % or more and 5 wt % or less, and 0.5 wt % or more and 2 wt % or less, respectively, and the total concentration of these acids is preferably in the range of 13.5 wt % or more and 18 wt % or less. The processing temperature is desirably 42° C. or higher and 48° C. or lower, but by keeping the processing temperature higher, a thicker film is formed more rapidly. The thickness of the film is desirably 0.3 μm or more and 15 μm or less. A film having a thickness of less than 0.3 μm may be less effective as a barrier to injection. On the other hand, a thickness of 15 μm may cause the increase in residual potential of the film as a result of repeated use.

The boehmite treatment is performed by immersing the film in purified water at 90° C. or higher and 100° C. or lower, for 5 to 60 minutes, or by bringing the film into contact with heated steam at 90° C. or higher and 120° C. or lower, for 5 to 60 minutes. The thickness of the film is desirably 0.1 μm or more and 5 μm or less. The film may further be subjected to an anodization by using an electrolyte solution having a low film dissolving property (such as adipic acid, boric acid, borate salt, phosphate salt, phthalate salt, maleate salt, benzoate salt, tartarate salt, and citrate salt).

An undercoat layer 4 is formed on the conductive support 2. The undercoat layer 4 contains, for example, an organic metal compound and/or a binder resin.

Examples of the organic metal compounds include organic zirconium compounds such as zirconium chelate compounds, zirconium alkoxide compounds, and zirconium coupling agents; organic titanium compounds such as titanium chelate compounds, titanium alkoxide compounds, and titanate coupling agents; organic aluminum compounds such as aluminum chelate compounds and aluminum coupling agents; as well as antimony alkoxide compounds, germanium alkoxide compounds, indium alkoxide compounds, indium chelate compounds, manganese alkoxide compounds, manganese chelate compounds, tin alkoxide compounds, tin chelate compounds, aluminum silicone alkoxide compounds, aluminum titanium alkoxide compounds, aluminum zirconium alkoxide compounds, and the like.

In particular, an organic zirconium compound, an organic titanyl compound, and an organic aluminum compound are favorably used as the organic metal compound, since these compounds give the undercoat layer a low residual potential and superior electrophotographic properties.

Examples of the binder resins include known resins such as polyvinylalcohol, polyvinylmethylether, poly-N-vinylimidazole, polyethyleneoxide, ethylcellulose, methylcellulose, ethylene-acrylic acid copolymers, polyamide, polyimide, casein, gelatin, polyethylene, polyester, phenol resins, vinyl chloride-vinyl acetate copolymers, epoxy resins, polyvinylpyrrolidone, polyvinylpyridine, polyurethane, polyglutamic acid, and polyacrylic acid. When two or more of these resins are used in combination, the mixing rate thereof is determined as appropriate.

The undercoat layer 4 may also contain a silane coupling agent such as vinyltrichlorosilane, vinyltrimethoxysilane, vinyltriethoxysilane, vinyltris-2-methoxyethoxysilane, vinyltriacetoxysilane, γ-glycidoxypropyltrimethoxysilane, γ-methacryloxypropyltrimethoxysilane, γ-aminopropyltriethoxysilane, γ-chloropropyltrimethoxysilane, γ-2-aminoethylaminopropyltrimethoxysilane, γ-mercaptopropyltrimethoxysilane, γ-ureidopropyltriethoxysilane, or β-3,4-epoxycyclohexyltrimethoxysilane.

In addition, an electron transporting pigment may be mixed or dispersed in the undercoat layer 4 to reduce residual potential and improve environmental stability. Examples of the electron transporting pigments include organic pigments such as the perylene pigments described in JP-A No. 47-30330, bisbenzimidazole perylene pigments, polycyclic quinone pigments, indigo pigments, and quinacridone pigments, bisazo pigments having an electron withdrawing substituent such as a cyano group, nitro group, nitroso group and halogen atom, and phthalocyanine pigments; and inorganic pigments such as zinc oxide and titanium oxide.

Among the above, perylene pigments, bisbenzimidazole perylene pigments, polycyclic quinone pigments, zinc oxide and titanium oxide are favorably used, because of a high degree of electron-transferring efficiency thereof as compared to the other pigments.

The surface of these pigments may be treated with the aforementioned coupling agent, a binder resin, and the like, in order to control the dispersibility and charge-transporting property of the pigment.

The electron transporting pigment is used preferably in an amount of 95 wt % or less, more preferably 90 wt % or less, with respect to the total solid matter in the undercoat layer 4, because an excessive amount of the pigment may lower the strength of the undercoat layer 4 and consequently cause film defects.

It is also preferable to add a fine powder of an organic or inorganic compound to the undercoat layer 4 for improvements in electrical properties, light scattering efficiency and the like. Examples of the particularly effective particles include white pigment particles such as titanium oxide, zinc oxide, zinc white, zinc sulfide, white lead, and lithopone; inorganic extender pigment particles such as alumina, calcium carbonate, and barium sulfate; and resin particles of polytetrafluoroethylene, benzoguanamine, styrene, and the like.

The volume-average particle diameter of the added fine powder is desirably 0.01 μm to 2 μm. The fine powder is added as needed, and the addition amount thereof is preferably 10 wt % to 90 wt %, more preferably 30 wt % to 80 wt % or less, with respect to the total solid matter of the undercoat layer 4.

The undercoat layer 4 is formed by using an undercoat layer forming solution containing the components described above. The organic solvent for use in the undercoat layer forming solution is not particularly limited, as long as it dissolves the organic metal compound and the binder resin, and does not form a gel or aggregate when the electron transporting pigment is mixed and/or dispersed therein.

Examples of the organic solvents include common solvents such as methanol, ethanol, n-propanol, n-butanol, benzyl alcohol, methyl cellosolve, ethyl cellosolve, acetone, methylethylketone, cyclohexanone, methyl acetate, n-butyl acetate, dioxane, tetrahydrofuran, methylene chloride, chloroform, chlorobenzene, and toluene. These solvents are used alone or as a mixture of two or more.

These components are mixed and/or dispersed by a common method, by means of a ball mill, roll mill, sand mill, attriter, vibration ball mill, colloid mill, paint shaker ultrasonic wave, and the like. The mixing and/or dispersion are performed in an organic solvent.

The undercoat layer 4 is formed by a common application method such as blade coating, wire bar coating, spray coating, dip coating, bead coating, air knife coating, and curtain coating.

The undercoat layer 4 is dried normally at a temperature at which the solvent is vaporized and a film can be formed. In particular, the undercoat layer 4 is preferably formed on the conductive support 2 that has previously been subjected to an acidic solution treatment or boehmite treatment, because the masking property for defects on the base material tends to be insufficient.

The thickness of the undercoat layer 4 is desirably 0.01 μm to 30 μm, more preferably 0.05 μm to 25 μm.

The charge generating layer 5 contains a charge generating substance, and a binder resin as needed.

The charge generating substances for use may be known pigments and examples thereof include organic pigments, e.g., azo pigments such as bisazo and trisazo pigments, condensed ring aromatic pigments such as dibromoanthanthrone, perylene pigments, pyrrolopyrrole pigments, and phthalocyanine pigments; and inorganic pigments such as trigonal selenium and zinc oxide. When a light source that emits irradiation light at a wavelength of 380 nm to 500 nm is used, the charge generating substance is preferably a metal or nonmetal phthalocyanine pigment, trigonal selenium, dibromoanthanthrone, and the like. Among these, particularly preferred are the hydroxygallium phthalocyanines disclosed in Japanese Patent Application Laid-Open (JP-A) Nos. 5-263007 and 5-279591; the chlorogallium phthalocyanines disclosed in JP-A No. 5-98181; the dichlorotin phthalocyanines disclosed in JP-A Nos. 5-140472 and 5-140473; and the titanylphthalocyanines disclosed in JP-A Nos. 4-189873 and 5-43813.

Further, among the aforementioned hydroxygallium phthalocyanines, particularly preferred are those having an absorption maximum in the range of 810 nm to 839 nm in a spectroscopic absorption spectrum, a primary particle diameter of 0.10 μm or less, and a specific surface area, as determined by a BET method, of 45 $m^2/g$ or more.

The binder resin may be selected from various types of insulating resins. Alternatively, the binder resin may be selected from organic photoconductive polymers such as poly-N-vinylcarbazole, polyvinylanthracene, polyvinyl pyrene, and polysilane. Examples of the favorable binder resins include, but are not limited to, insulating resins such as polyvinylbutyral resins, polyarylate resins (e.g., polycondensation polymers of bisphenol A and phthalic acid), polycarbonate resins, polyester resins, phenoxy resins, vinyl chloride-vinyl acetate copolymers, polyamide resins, acrylic resins, polyacrylamide resins, polyvinylpyridine resins, cellulosic resins, urethane resins, epoxy resins, casein, polyvinylalcohol resins, and polyvinylpyrrolidone resins. These binder resins may be used alone or in combination of two or more.

The charge generating layer 5 is formed by vapor depositing a charge generating substance, or by applying a charge generating layer forming solution containing a charge generating substance and a binder resin. When the charge generating layer 5 is formed with a charge generating layer forming solution, the blending rate of the charge generating substance to the binder resin (by weight) is preferably in the range of from 10:1 to 1:0.

Known methods such as ball mill dispersion, attriter dispersion, or sand mill dispersion may be used to disperse the respective components in the charge generating layer forming solution. At this time, conditions under which the crystalline form of the pigment does not change due to dispersion are required. During the dispersion, the particles are preferably formed into a particle diameter of preferably 0.5 μm or less, more preferably 0.3 μm or less, and still more preferably 0.15 μm or less.

Examples of the solvents used for the dispersion include common organic solvents such as methanol, ethanol, n-propanol, n-butanol, benzyl alcohol, methylcellosolve, ethylcellosolve, acetone, methylethylketone, cyclohexanone, methyl acetate, n-butyl acetate, dioxane, tetrahydrofuran, methylene chloride, chloroform, chlorobenzene, and toluene. These solvents may be used alone or as a mixture of two or more.

The charge generating layer 5 is formed with the charge generating layer forming solution by a common application method such as blade coating, wire bar coating, spray coating, dip coating, bead coating, air knife coating, or curtain coating.

The thickness of the charge generating layer 5 is preferably 0.1 μm or more and 5 μm or less, more preferably 0.2 μm or more and 2.0 μm or less.

The charge transporting layer 6 contains a charge transporting material and a binder resin, or contains a charge transporting polymer material.

Examples of the charge transporting materials include, but are not limited to, electron-transporting compounds including quinone compounds such as p-benzoquinone, chloranil, bromanil, and anthraquinone; tetracyanoquinodimethane compounds, fluorenone compounds such as 2,4,7-trinitrofluorenone, xanthone compounds, benzophenone compounds, cyanovinyl compounds, and ethylene compounds; and hole transporting compounds including triarylamine compounds, benzidine compounds, arylalkane compounds, aryl-substituted ethylene compounds, stilbene compounds, anthracene compounds, hydrazone compounds, and the like. These charge transporting materials may be used alone or in combination of two or more.

The charge transporting material is preferably a compound represented by the following Formula (a-1), (a-2) or (a-3), from the viewpoint of charge mobility.

(a-1)

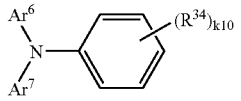

In Formula (a-1) above, $R^{34}$ represents a hydrogen atom or a methyl group. $k^{10}$ is 1 or 2. $Ar^6$ and $Ar^7$ each independently represent a substituted or unsubstituted aryl group, $—C_6H_4—C(R^{38})=C(R^{39})(R^{40})$, or $—C_6H_4—CH=CH—CH=C(Ar)_2$, and examples of the substituents on the aryl group include halogen atoms, alkyl groups having 1 to 5 carbon atoms, alkoxy groups having 1 to 5 carbon atoms, and substituted amino groups substituted by an alkyl groups having 1 to 3 carbon atoms. $R^{38}$, $R^{39}$, and $R^{40}$ each independently represent a hydrogen atom, a substituted or unsubstituted alkyl group, or a substituted or unsubstituted aryl group. Ar represents a substituted or unsubstituted aryl group.

(a-2)

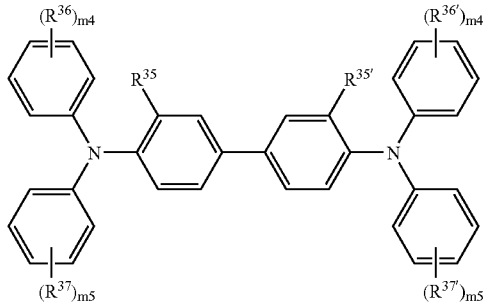

In Formula (a-2) shown above, $R^{35}$ and $R^{35'}$ each independently represent a hydrogen atom, a halogen atom, an alkyl group having 1 to 5 carbon atoms, or an alkoxy group having 1 to 5 carbon atoms. $R^{36}$, $R^{36'}$, $R^{37}$ and $R^{37'}$ each independently represent a halogen atom, an alkyl group having 1 to 5 carbon atoms, an alkoxy group having 1 to 5 carbon atoms, an amino group substituted by an alkyl group of 1 or 2 carbon atoms, a substituted or unsubstituted aryl group, —C($R^{38}$)═C($R^{39}$)($R^{40}$), or —CH═CH—CH═C(Ar)$_2$. $R^{38}$, $R^{39}$ and $R^{40}$ each independently represent a hydrogen atom, a substituted or unsubstituted alkyl group, or a substituted or unsubstituted aryl group. Ar represents a substituted or unsubstituted aryl group. m4 and m5 each independently are an integer of 0 to 2.

polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins and the like. These binder resins may be used alone or in combination of two or more. The blending ratio of the charge transporting material to the binder resin (by weight) is desirably 10:1 to 1:5.

Any one of known resins with charge transporting property such as poly-N-vinylcarbazole and polysilane may be used as the charge transporting polymer material. In particular, the polyester-based charge transporting polymer materials disclosed in JP-A Nos. 8-176293 and 8-208820 are particularly favorable because of a high level of charge transporting property, as compared with other compounds.

The charge transporting polymer material may be used alone as a component for the charge transporting layer 6, or may be mixed with the above-described binder resin to form a film.

The charge transporting layer 6 is formed by using a charge transporting layer forming solution containing the aforementioned components.

Examples of the solvent for use in the charge transporting layer forming solution include common organic solvents including aromatic hydrocarbons such as benzene, toluene, xylene, and chlorobenzene; ketones such as acetone and 2-butanone, halogenated aliphatic hydrocarbons such as methylene chloride, chloroform, and ethylene chloride; and cyclic or linear ethers such as tetrahydrofuran and ethylether. These solvents may be used alone or as a mixture or two or more.

(a-3)

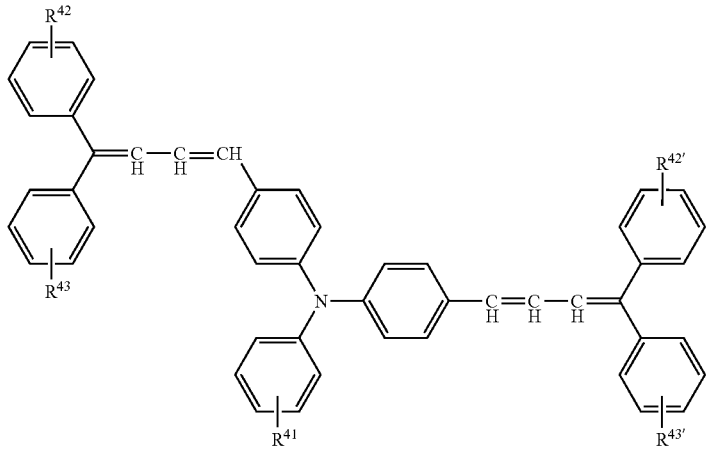

In Formula (a-3) shown above, $R^{41}$ represents a hydrogen atom, an alkyl group having 1 to 5 carbon atoms, an alkoxy group having 1 to 5 carbon atoms, a substituted or unsubstituted aryl group, or —CH═CH—CH═C(Ar)$_2$. Ar represents a substituted or unsubstituted aryl group. $R^{42}$, $R^{42'}$, $R^{43}$, and $R^{43'}$ each independently represent a hydrogen atom, a halogen atom, an alkyl group having 1 to 5 carbon atoms, an alkoxy group having 1 to 5 carbon atoms, an amino group substituted by an alkyl group having 1 or 2 carbon atoms, or a substituted or unsubstituted aryl group.

Examples of the binder resins for use in the charge transporting layer 6 include polycarbonate resins, polyester resins, methacrylic resins, acrylic resins, polyvinyl chloride resins, The coating method of the charge transporting layer forming solution is applied by a common application method such as blade coating, wire bar coating, spray coating, dip coating, bead coating, air knife coating, or curtain coating.

The thickness of the charge transporting layer 6 is desirably 5 μm or more and 50 μm or less, more preferably 10 μm or more and 30 μm or less.

Additives such as an antioxidant, photostabilizer and heat stabilizer may be added to the charge transporting layer 6, for the purpose of preventing degradation of the photoreceptor due to ozone or oxidative gases generated in the image formation apparatus, or due to heat or light. These additives may be added to other layers, as well as the charge transporting layer 6.

Examples of the antioxidants include hindered phenols, hindered amines, p-phenylenediamine, arylalkanes, hydroquinone, spirochromane, spiroindanone, and derivatives of these compounds, organic sulfur compounds, organic phosphorus compounds, and the like. Examples of the photostabilizers include derivatives of benzophenone, benzotriazole, dithiocarbamate, tetramethylpiperidine and the like.

One or more electron accepting substances may be added to the charge transporting layer 6, for example, for the purposes of improving sensitivity and reducing residual potential and fatigue after repeated use. The electron accepting substance may be added to other layers, as well as the charge transporting layer 6.

Examples of the electron accepting substances include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and the like. Among them, fluorenone compounds, quinone compounds, and benzene derivatives substituted by an electron withdrawing group such as Cl, CN, and $NO_2$ are particularly preferable.

The protective layer 7 contains the cured product of a composition containing a curable resin, a fluorine atom containing surfactant, and at least one organic charge transporting compound represented by any one of Formulae (I) to (V) shown below. Specifically, the protective layer 7 contains, for example, (1) a cured product of a curable resin, a fluorine atom containing surfactant, and at least one organic charge transporting compound represented by any one of the Formulae (I) to (V) shown below; or (2) a cured product of a curable resin and at least one organic charge transporting compound represented by any one of the Formulae (I) to (V) shown below, and a fluorine atom containing surfactant.

The type of the curable resin is not particularly limited, but particularly preferably, an alcohol-soluble curable resin. Such an alcohol-soluble curable resin often causes film defects, for example by "cissing" of the coating solution thereof in preparation of the protective layer 7. However, according to the present exemplary embodiment, it is possible to prepare the protective layer 7 with fewer defects even when an alcohol-soluble curable resin is applied.

The alcohol-soluble curable resin is a curable resin that is soluble at 1 wt % or more in an alcohol having five or less carbon atoms. Typical examples of the alcohol-soluble curable resins include thermosetting resins such as phenol resins, thermosetting acrylic resins, thermosetting silicone resins, epoxy resins, melamine resins, and urethane resins, and particularly favorable are phenol resins, melamine resins, siloxane resins, urethane resins and the like. Among these curable resins, phenol resins are preferable from the viewpoints of mechanical strength, electrical properties and deposit-removing efficiency after curing.

As for the preparation of a phenol resin, a compound having a phenol structure e.g., a substituted phenol having a hydroxyl group such as phenol, cresol, xylenol, p-alkylohenol and p-phenylphenol, a substituted phenol having two hydroxyl groups such as catechol, resorcinol, or hydroquinone, a bisphenol such as bisphenol A and Z, and a biphenol, is allowed to react with formaldehyde, paraformaldehyde and the like, in the presence of an acid or alkali catalyst, to give a monomer of monomethylol phenol, dimethylol phenol, trimethylol phenol, a mixture thereof, an oligomer thereof, or a mixture of the monomer and the oligomer. A relatively large molecule having molecular repeating units of about 2 to 20 is an oligomer, and that having a smaller number of molecular repeating units is a monomer.

Examples of the acid catalysts used in production of a phenol resin include sulfuric acid, p-toluenesulfonic acid, phenolsulfonic acid, phosphoric acid, and the like. Examples of the alkali catalysts for use include alkaline-earth metal hydroxides (such as NaOH, KOH, $Ca(OH)_2$, $Mg(OH)_2$, and $Ba(OH)_2$), alkali metal or alkaline-earth metal oxides (such as CaO and MgO), amine catalysts (such as ammonia, hexamethylenetetramine, trimethylamine, triethylamine, and triethanolamine), acetate salts (such as zinc acetate and sodium acetate), and the like.

When an alkali catalyst (basic catalyst) is used, carriers may be trapped significantly by the residual catalyst, and thereby deteriorating the electrophotographic properties. In such a case, the catalyst is preferably inactivated or removed by distilling under reduced pressure neutralizing with an acid, or allowing to contact with an adsorbent such as silica gel or an ion-exchange resin. Alternatively, a curing catalyst may be used during curing. The catalyst used in the above case is not particularly limited, as long as it does not adversely affect electrical properties and the like.

The type of the fluorine atom containing surfactant is not particularly limited, as long as it has a molecular structure in which a fluorine atom is contained, and favorable examples thereof include surfactants having an alkyleneoxide structure, surfactants having an acrylic structure, and surfactants having a perfluoroalkyl group. In particular, the surfactants having an alkyleneoxide structure and the surfactants having an acrylic structure have higher levels of affinity and compatibility with the curable resin and the organic charge transporting compound, and suppress the variation in composition in a thickness direction of the protective layer 7 more effectively. On the other hand, use of a surfactant having a perfluoroalkyl group lead to improvement in the film-forming property of the protective layer forming solution, and suppression of the defects of the protective layer 7.

Examples of the surfactants having an alkyleneoxide structure include those having an alkyleneoxide structure or a polyalkylene structure in a side chain, those having the distol end of the alkyleneoxide or polyalkyleneoxide structure substituted by a fluorine containing substituent, and the like. Typical examples of the surfactants having an alkyleneoxide structure include MEGAFAC F-443, F-444, F-445, and F-446 (manufactured by Dainippon Ink and Chemicals, Inc.), FTERGENT 250, 251, and 222F (manufactured by Neos Company Ltd.), POLY FOX PF636, PF6320, PF6520, and PF656 (manufactured by Kitamura Chemicals Co., Ltd.), and the like.

The surfactants having an acrylic structure include polymers and copolymers of monomer(s) such as an acrylic or methacrylic compound. Typical examples of the surfactants having an acrylic structure include POLYFLOW KL600 (manufactured by Kyoeisha Chemical Co., Ltd.), FTOP EF-351, EF-352, EF-801, EF-802, and EF-601 (manufactured by JEMCO Inc.), and the like.

The surfactant having a perfluoroalkyl group is a surfactant having a molecular structure in which a perfluoroalkyl group is contained. Typical favorable examples of the surfactants having a perfluoroalkyl group include perfluoroalkylsulfonic acids (such as perfluorobutanesulfonic acid and perfluorooctanesulfonic acid), perfluoroalkylcarboxylic acids (such as perfluorobutanecarboxylic acid and perfluorooctanecarboxylic acid), and perfluoroalkyl group-containing phosphoric esters. The perfluoroalkylsulfonic acids and perfluoroalkylcarboxylic acids may be a salt or an amide modified product thereof.

Commercial products of the perfluoroalkylsulfonic acids include MEGAFAC F-114 (manufactured by Dainippon Ink and Chemicals, Inc.), FTOP EF-101, EF102, EF-103, EF-104, EF-105, EF-112, EF-121, EF-122A, EF-122B, EF-122C, and EF-123 A (manufactured by JEMCO Inc.), FTERGENT 100, 100C, 110, 140A, 150, 150CH, A-K, and 501 (manufactured by Neos Company Ltd.), and the like.

Commercial products of the perfluoroalkylcarboxylic acids include MEGAFACE F-410 (manufactured by Dainippon Ink and Chemicals, Inc.), FTOP EF-201 and EF-204 (manufactured by JEMCO Inc.), and the like.

Commercial products of the perfluoroalkyl group containing phosphoric esters include MEGAFAC F-493 and F-494 (manufactured by Dainippon Ink and Chemicals, Inc.), FTOP EF-123A, EF-123B, EF-125M, and EF-132, (manufactured by JEMCO Inc.), and the like.

The fluorine atom containing surfactants are not limited to the compounds described above, and other products such as a fluorine atom containing compound having a betaine structure (such as FTERGENT 400SW, manufactured by Neos Company Ltd.) and a surfactant having an amphoteric ion group (such as FTERGENT SW, manufactured by Neos Company Ltd.).

The content of the fluorine atom containing surfactant is preferably from 0.01 wt % or about 0.01 wt % to 1 wt % or about 1 wt %, more preferably from 0.02 wt % or about 0.02 wt % to 0.5 wt % or about 0.5, with respect to the total solid matter in the protective layer 7. When the content of a fluorine atom containing surfactant is less than 0.01 wt % or about 0.01 wt %, prevention effect against film defects may not be sufficient. On the other hand, when the content of a fluorine atom containing surfactant is more than 1 wt % or about 1 wt %, strength of the obtained cured product may not be sufficient due to separation of the fluorine atom containing surfactant from the curable resin.

The organic charge transporting compounds represented by Formulae (I) to (V) are shown in the following.

$$F—[(X^2)_{n2}—(R^2)_{n3}—(Z^2)_{n4}G]_{n5} \quad (I)$$

In Formula (I), F represents an n5-valent organic group derived from a compound having a hole transporting capability; $X^2$ represents an oxygen or sulfur atom; $R^2$ represents an alkylene group (the carbon number is preferably from 1 to 15, and more preferably from 1 to 10); $Z^2$ represents an oxygen atom, a sulfur atom, NH or COO; G represents an epoxy group; n2, n3 and n4 each independently represent 0 or 1; and n5 is an integer of 1 to 4.

$$F[\text{-}D\text{-}Si(R^3)_{(3-a)}Q_a]_b \quad (II)$$

In Formula (II), F represents a b-valent organic group derived from a compound having a hole transporting capability; D represents a bivalent group; $R^3$ represents a hydrogen atom, a substituted or unsubstituted alkyl group (the carbon number is preferably from 1 to 15, and more preferably from 1 to 10), or a substituted or unsubstituted aryl group (the carbon number is preferably from 6 to 20, more preferably from 6 to 15). Q represents a hydrolyzable group; a is an integer of 1 to 3; and b is an integer of 1 to 4.

(III)

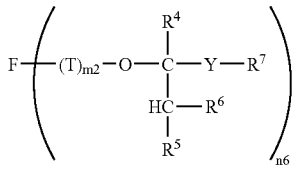

In Formula (III), F represents an n6-valent organic group derived from a compound having a hole transporting capability; T represents a bivalent group; Y represents an oxygen atom or a sulfur atom; $R^4$, $R^5$ and $R^6$ each independently represent a hydrogen atom or a monovalent organic group; $R^7$ represents a monovalent organic group; m2 is 0 or 1; n6 is an integer of 1 to 4, and $R^6$ and $R^7$ may bind to each other to form a heterocyclic ring containing Y as the heteroatom.

In Formula (III) above, $R^4$, $R^5$ and $R^6$ each preferably represent a monovalent organic group having 1 to 18 carbon atoms; more preferably a monovalent hydrocarbon group having 1 to 18 carbon atoms that may be substituted by a halogen atom, or a group represented by $—(CH_2)_f—OR^{24}$; still more preferably an alkyl group having 1 to 4 carbon atoms or a group represented by $—(CH_2)_f—O—R^{24}$; and particularly preferably a methyl group, wherein $R^{24}$ represents a hydrocarbon group having 1 to 6 carbon atoms, which may form a ring but is preferably an aliphatic hydrocarbon group such as a methyl group, ethyl group, propyl group, and butyl group; and f is an integer of 1 to 12, preferably 1 to 4. T is preferably an alkylene group having 1 to 18 carbon atoms that may be branched, and more preferably a methylene group. In Formula (III) above, if there are two or more of $R^4$, $R^5$, $R^6$ or T, two or more of $R^4$, $R^5$, $R^6$ or T may be the same or different from each other.

(IV)

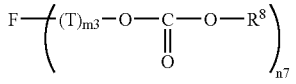

In Formula (IV), F represents an n7-valent organic group derived from a compound having a hole transporting capability; T represents a bivalent group; $R^8$ represents a monovalent organic group; m3 is 0 or 1; and n7 is an integer of 1 or more and 4 or less.

In Formula (IV) above, $R^8$ preferably represents a monovalent organic group having 1 to 18 carbon atoms, more preferably a monovalent hydrocarbon group substituted by a halogen atom having 1 to 18 carbon atoms or a group represented by $—(CH_2)_f—O—R^{24}$, still more preferably an alkyl group having 1 to 4 carbon atoms or a group represented by $—(CH_2)_f—O—R^{24}$, and particularly preferably a methyl group, wherein $R^{24}$ represents a hydrocarbon group having 1 to 6 carbon atoms that may form a ring, preferably an aliphatic hydrocarbon group such as a methyl group, ethyl group, propyl group, or butyl group; and f is an integer of 1 to 12 or less, preferably 1 to 4. T is preferably an alkylene group having 1 to 18 carbon atoms that may be branched, more preferably a methylene group. In Formula (IV) above, there are two or more of $R^8$ or T, two or more of $R^8$ or T may be the same or different from each other.

$$F\text{—}[L\text{—}O\text{—}R^9]_{n8} \quad (V)$$

In Formula (V), F represents an n8-valent organic group derived from a compound having a hole transporting capability; L represents an alkylene group; $R^9$ represents a monovalent organic group; and n8 is an integer of 1 to 4.

In Formula (V) above, $R^9$ preferably represents a monovalent organic group having 1 to 18 carbon atoms, more preferably a monovalent hydrocarbon group having 1 to 18 carbon atoms that may be substituted by a halogen atom, or a group represented by $—(CH_2)_f—R^{24}$, still more preferably an alkyl group having 1 to 4 carbon atoms or a group represented by $—(CH_2)_f—O—R^{24}$, and particularly preferably a methyl group, wherein $R^{24}$ represents a hydrocarbon group having 1 to 6 carbon atoms, which may form a ring but is preferably an aliphatic hydrocarbon group such as a methyl group, ethyl group, propyl group, or butyl group; and f is an integer of 1 to 12, preferably 1 to 4. L is preferably an alkylene group having 1 to 18 carbon atoms that may be branched, more preferably a methylene group. In Formula (V) above, if there are two or more of $R^9$ or L, two or more of $R^9$ or L may be the same or different from each other.

In Formula (II), the bivalent group D is specifically a bivalent group having a function to connect the unit F, which imparts a photoelectric property, to the substituted silicon group, which contributes to construction of a three-dimensional inorganic glassy network structure. Further, the group D is an organic group structure that imparts the rigid but fragile inorganic glassy network structure with favorable flexibility, and improves the mechanical toughness as a film.

The bivalent group D specifically represents a bivalent hydrocarbon group represented by $—C_\alpha H_{2\alpha}—$, $—C_\beta H_{2\beta-2}—$, or $—C_\gamma H_{2\gamma-4}—$ (where α is an integer of 1 to 15; β is an integer of 2 to 15; and γ is an integer of 3 to 15), —COO—, —S—, —O—, $—CH_2—C_6H_4$, —N═CH—, $—(C_6H_4)—(C_6H_4)—$, a functional group in which these functional groups are combined, a functional group as above having a component atom thereof substituted by another substituent, and the like.

The hydrolyzable group Q is preferably an alkoxy group, more preferably an alkoxy group having 1 to 15 carbon atoms.

The organic group F derived from a compound having a hole transporting capability is preferably an arylamine compound represented by the following Formula (VI).

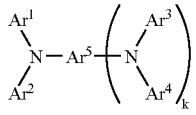

(VI)

In Formula (VI), $Ar^1$, $Ar^2$, $Ar^3$ and $Ar^4$ each independently represent a substituted or unsubstituted aryl group, $Ar^5$ represents a substituted or unsubstituted aryl or arylene group, wherein:

one to four out of the groups $Ar^1$ to $Ar^5$ each independently have a bonding site for bonding to the unit represented by the following Formula (IX) in the compound represented by the Formula (I); the unit represented by the following Formula (X) in the compound represented by the Formula (II); the unit represented by the following Formula (XI) in the compound represented by the Formula (III); the unit represented by the following Formula (XII) in the compound represented by Formula (IV); or the unit represented by the following Formula (XIII) in the compound represented by Formula (V).

$$—(X^2)_{n2}—(R^2)_{n3}—(Z^2)_{n4}G \quad (IX)$$

$$\text{-D-Si}(R^3)_{(3-a)}Q_a \quad (X)$$

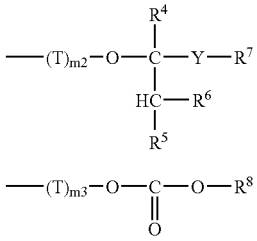

(XI)

(XII)

$$\text{-L-O—}R^9 \quad (XIII)$$

Specifically, the substituted or unsubstituted aryl groups represented by $Ar^1$ to $Ar^4$ in Formula (VI) above each preferably an aryl group selected from those represented by the following Formulae (1) to (7).

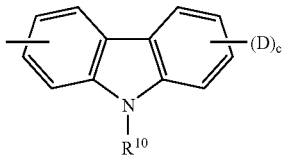

(1)

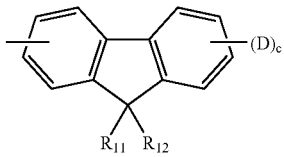

(2)

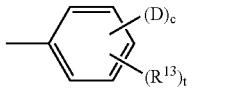

(3)

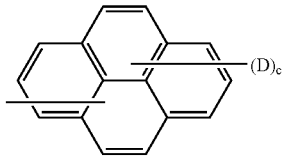

(4)

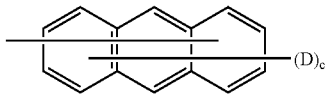

(5)

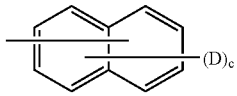

(6)

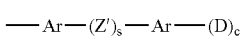

(7)

In Formulae (1) to (7) above, $R^{10}$ represents a hydrogen atom, an alkyl group having 1 to 4 carbon atoms, an alkoxy group having 1 to 4 carbon atoms, a phenyl group substituted by any of these groups, an unsubstituted phenyl group, or an aralkyl group having 7 to 10 carbon atoms; $R^{11}$ to $R^{13}$ each independently represent a hydrogen atom, an alkyl group having 1 to 4 carbon atoms, an alkoxy group having 1 to 4 carbon atoms, a phenyl group substituted by any of the aforementioned group, an unsubstituted phenyl group, an aralkyl group having 7 to 10 carbon atoms, or a halogen atom; Ar represents a substituted or unsubstituted arylene group; D represents a structure represented by any one of the structures represented by Formulae (IX) to (XIII); each of C and S independently is 0 or 1; and t is an integer of 1 to 3.

The Ar in the aryl group represented by Formula (7) above is preferably an arylene group represented by the following Formula (8) or (9).

(8)

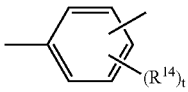

(9)

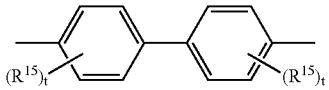

In Formulae (8) and (9) above, $R^{14}$ and $R^{15}$ each independently represent a hydrogen atom, an alkyl group having 1 to 4 carbon atoms, an alkoxy group having 1 to 4 carbon atoms, a phenyl group substituted by any of these groups, an unsubstituted phenyl group, an aralkyl group having 7 to 10 carbon atoms, or a halogen atom; and t is an integer of 1 to 3.

The Z' in the aryl group represented by Formula (7) above is preferably a bivalent group represented by the following Formula (10) to (17).

(10)

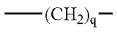

(11)

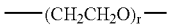

(12)

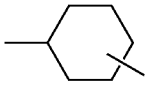

(13)

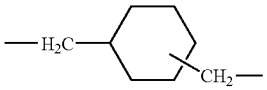

(14)

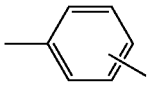

(15)

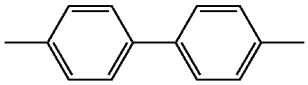

(16)

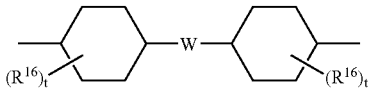

(17)

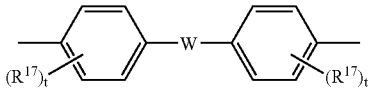

In Formulae (10) to (17), $R^{16}$ and $R^{17}$ each independently represent a hydrogen atom, an alkyl group having 1 to 4 carbon atoms, an alkoxy group having 1 to 4 carbon atoms, a phenyl group substituted by any of these groups, an unsubstituted phenyl group, an aralkyl group having 7 to 10 carbon atoms, or a halogen atom; W represents a bivalent group; q and r each independently represent an integer of 1 to 10; and t each independently represent an integer of 1 to 3.

In Formulae (16) to (17) above, W represents a bivalent group represented by the following Formulae (18) to (26). In Formula (25), u is an integer of 0 to 3.

$$—CH_2— \quad (18)$$

$$—C(CH_3)_2— \quad (19)$$

$$—O— \quad (20)$$

$$—S— \quad (21)$$

$$—C(CF_3)_2— \quad (22)$$

$$—Si(CH_3)_2— \quad (23)$$

(24)

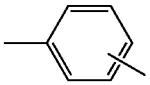

(25)

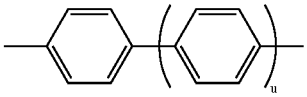

(26)

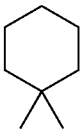

Specific examples of $Ar^5$ in Formula (VI) above include, when k=0, aryl groups represented by the specific structures of Formulae (1) to (7) for the above $Ar^1$ to $Ar^4$ where c=1, and when k=1, arylene groups obtained by subtracting a predetermined hydrogen atom from the aryl group represented by the specific structures of Formulae (1) to (7) for the above $Ar^1$ to $Ar^4$.

Specific examples of the compounds represented by Formula (I) above include the following compounds (I-1) to (I-47). In the following tables, Me and a binding site described with no substituent represent a methyl group, and Et represents an ethyl group.

I-1

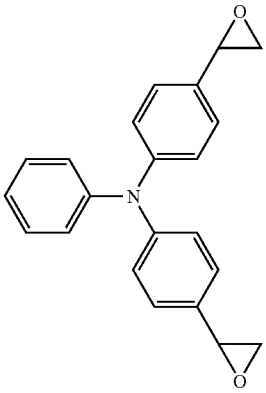

I-2
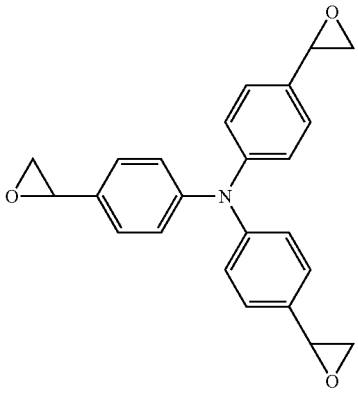
I-3
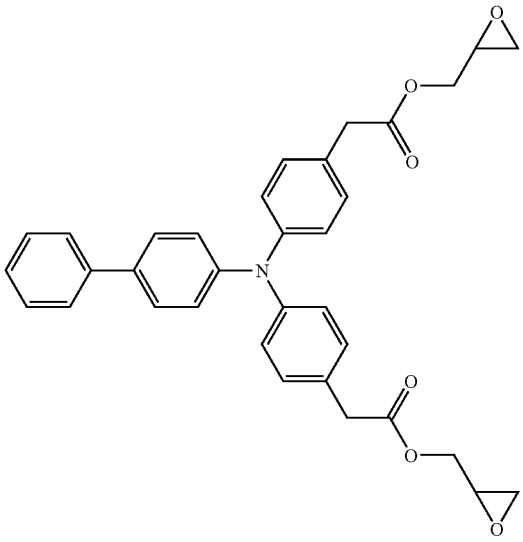
I-4
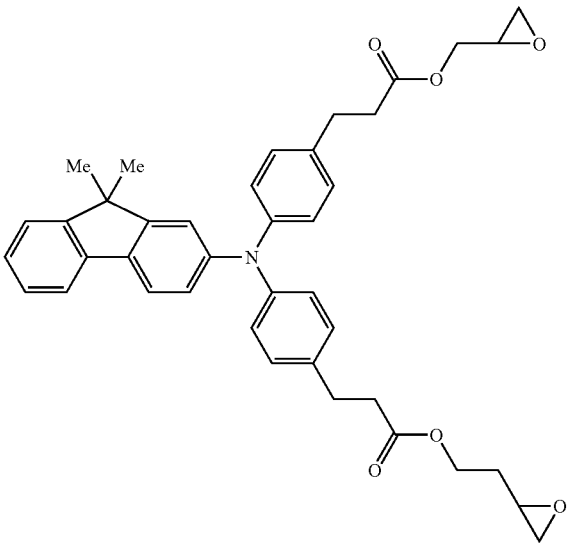
I-5
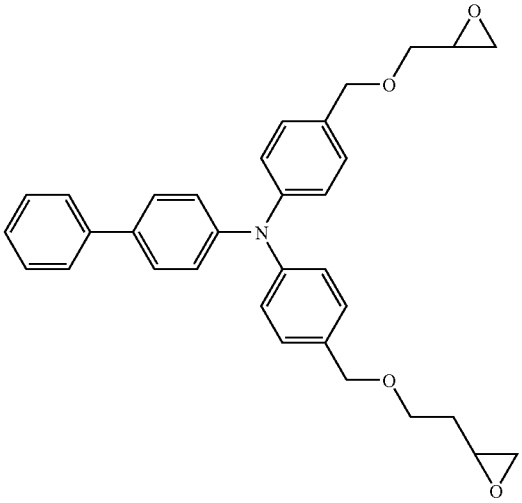
I-6
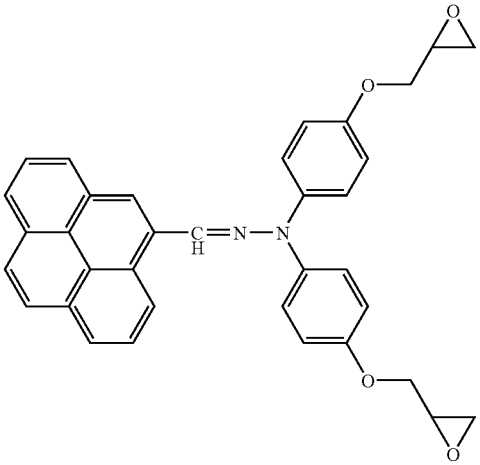
I-7
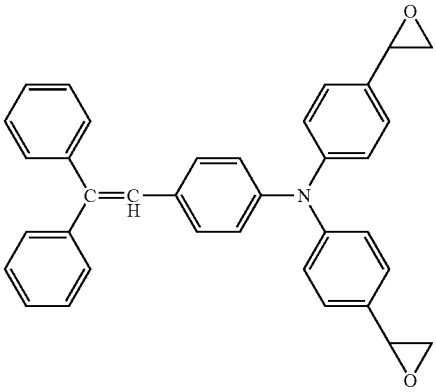

-continued
I-8
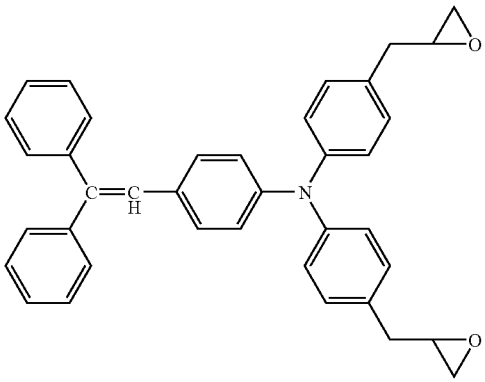
I-9
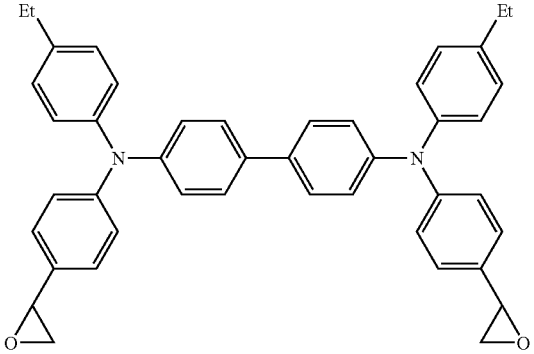
I-10
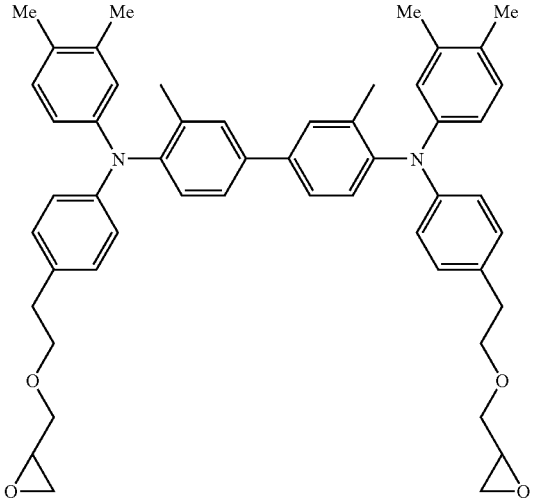
-continued
I-11
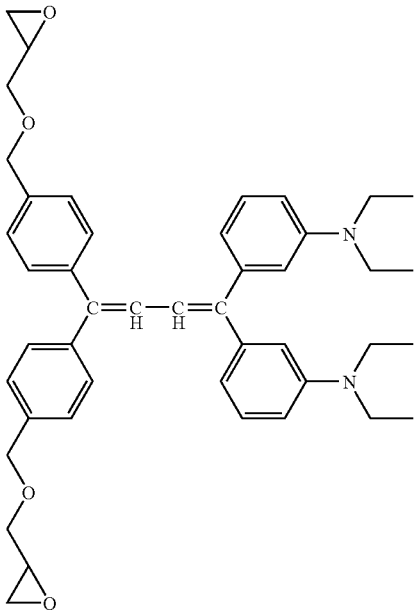
I-12
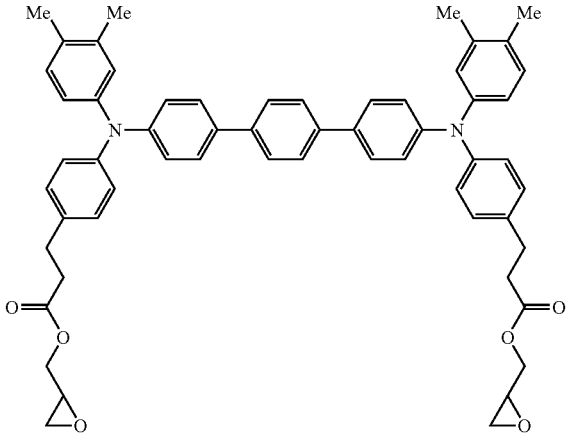
I-13
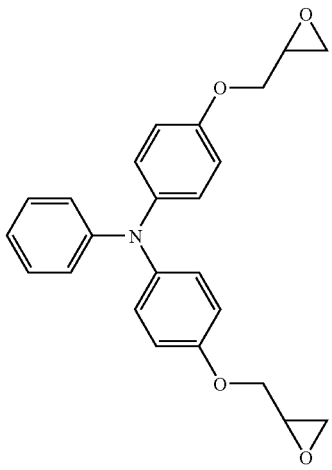

-continued
I-14
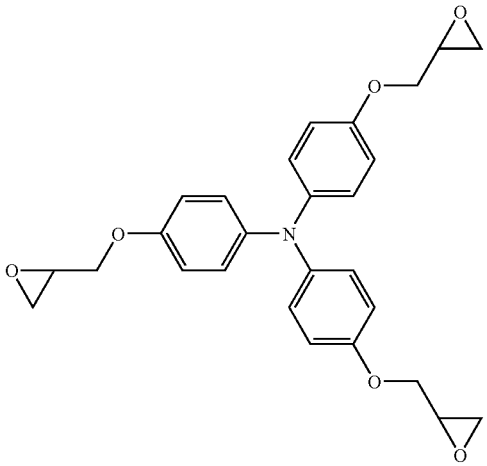
I-15
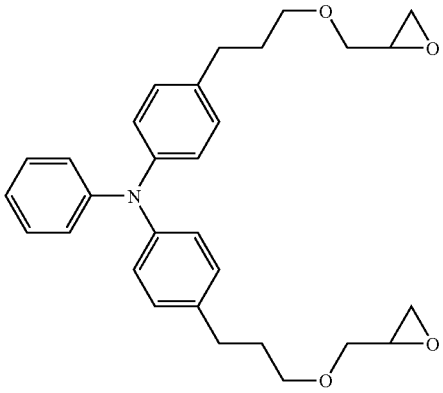
I-16
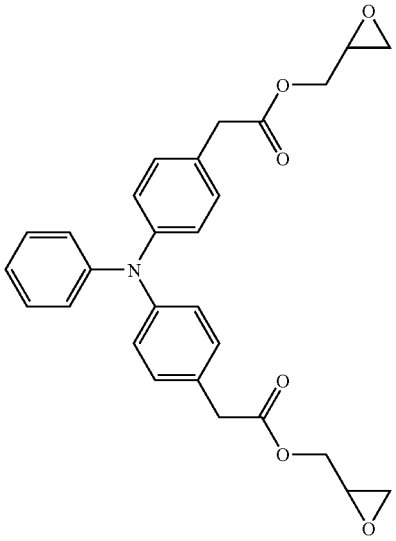
-continued
I-17
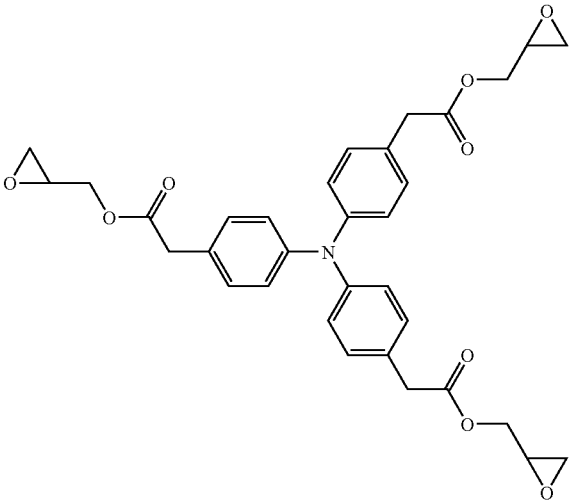
I-18
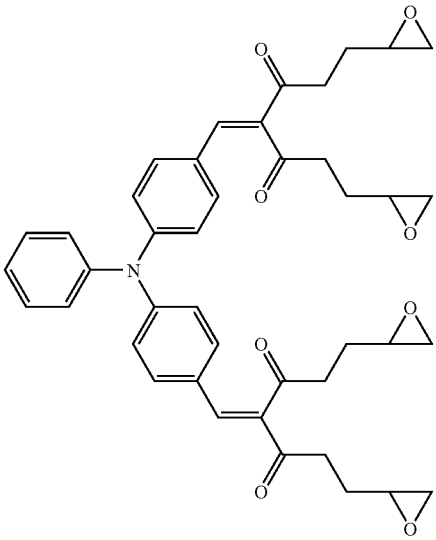
I-19
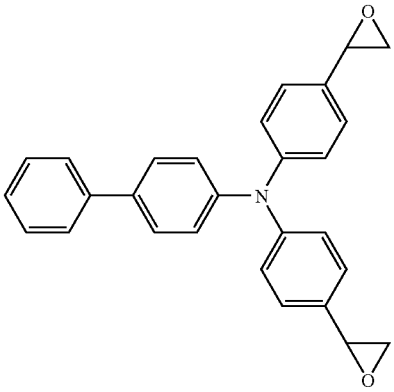

-continued
I-20
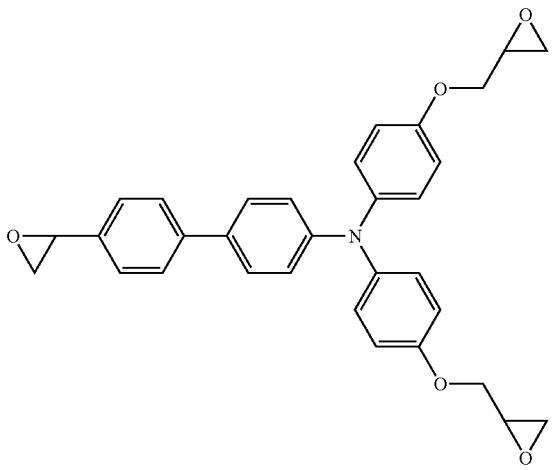
I-21
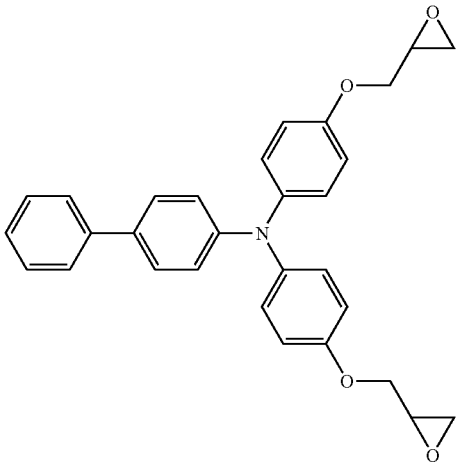
I-22
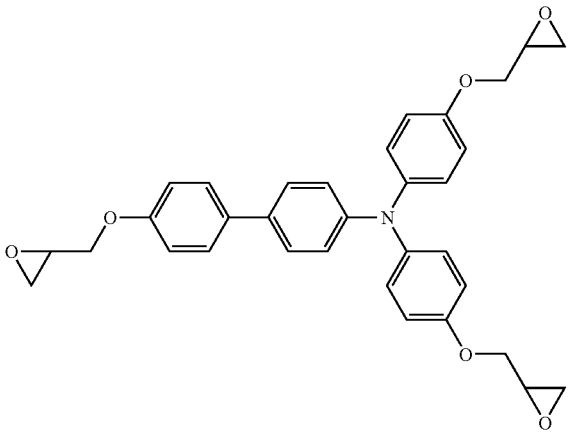
-continued
I-23
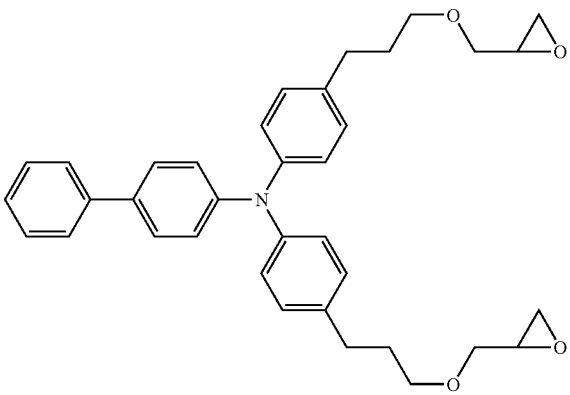
I-24
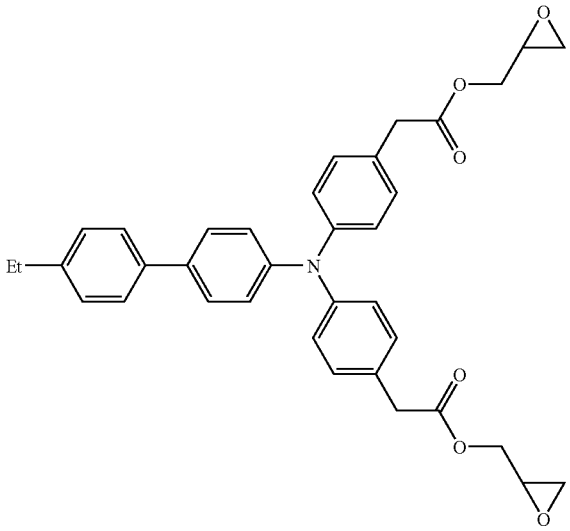
I-25
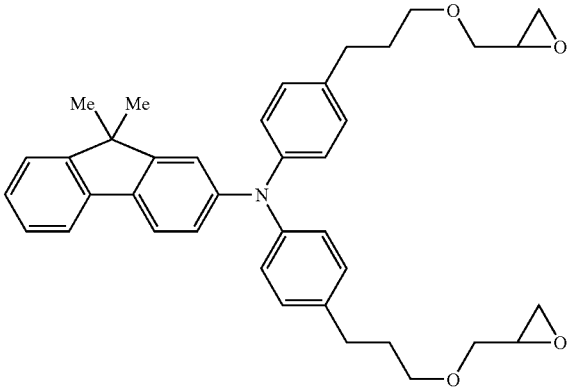

-continued
I-26
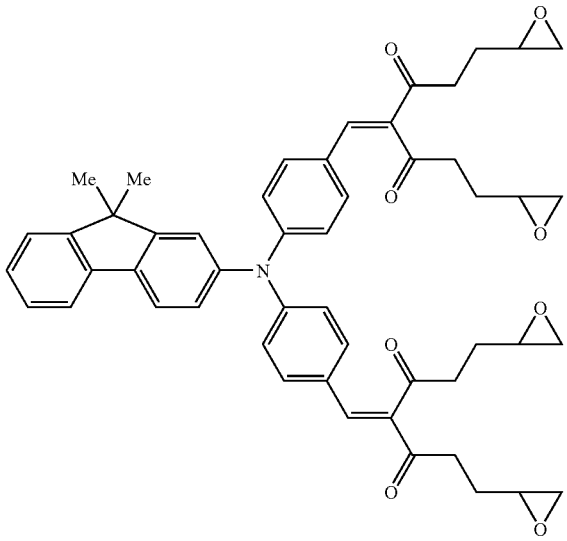
I-27
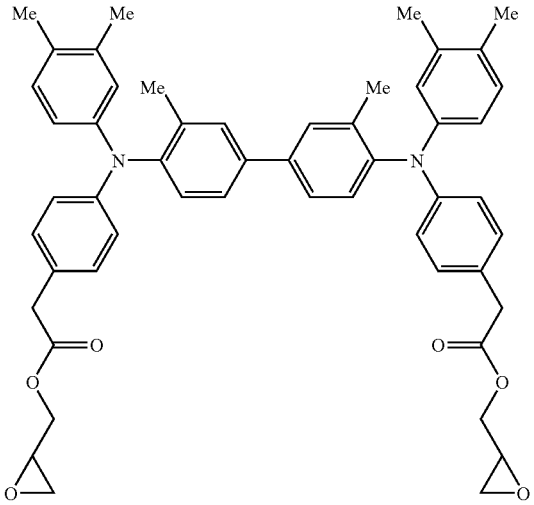
I-28
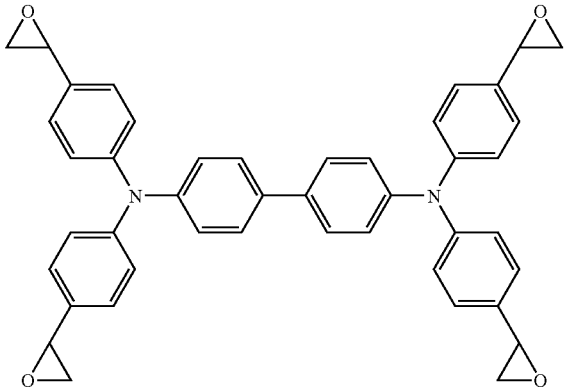
-continued
I-29
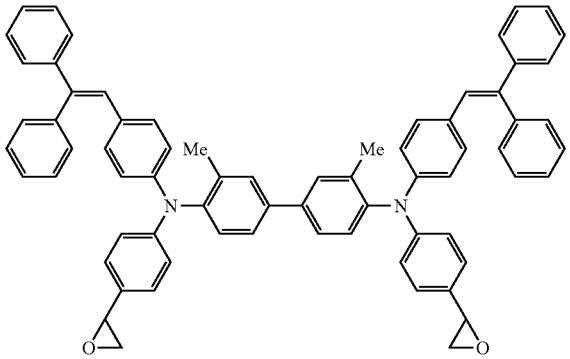
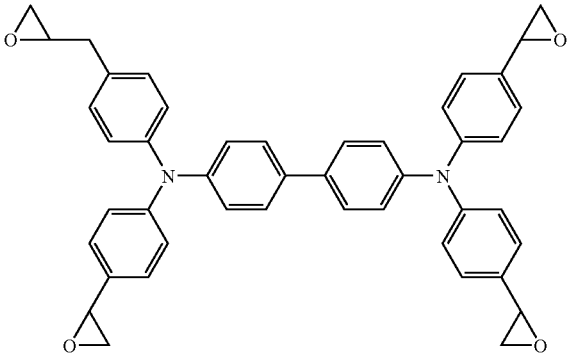
I-31
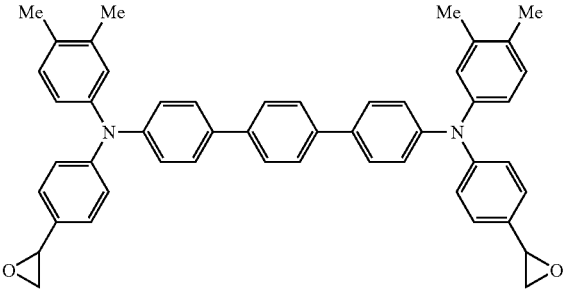
I-32
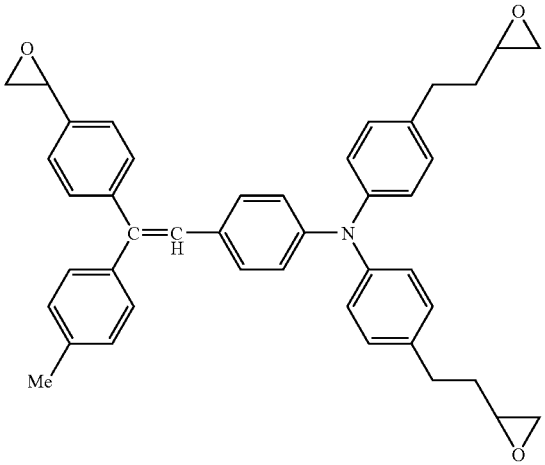

I-33
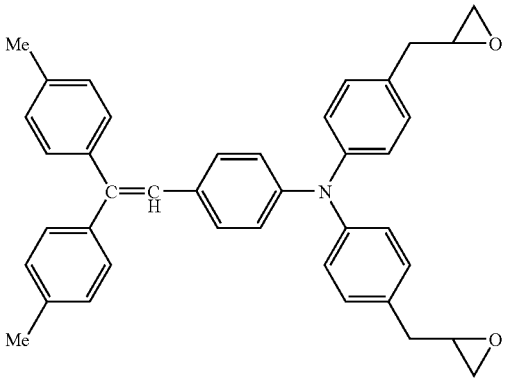
I-34
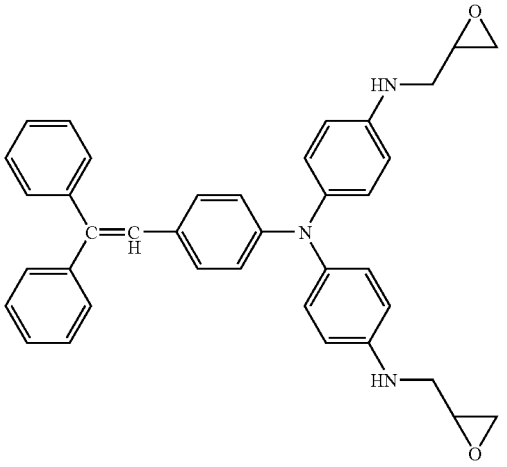
I-35
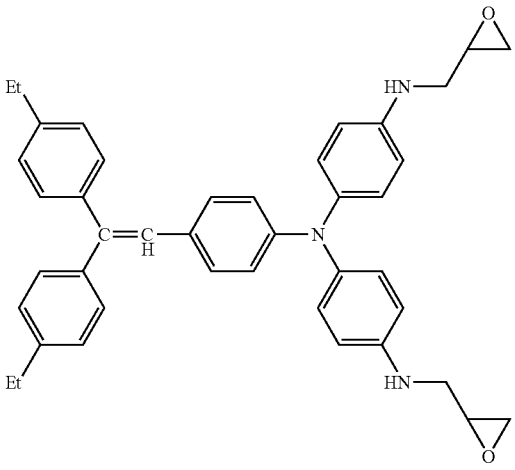
I-36
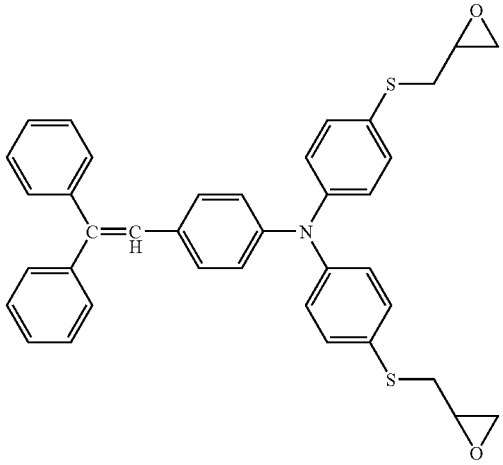
I-37
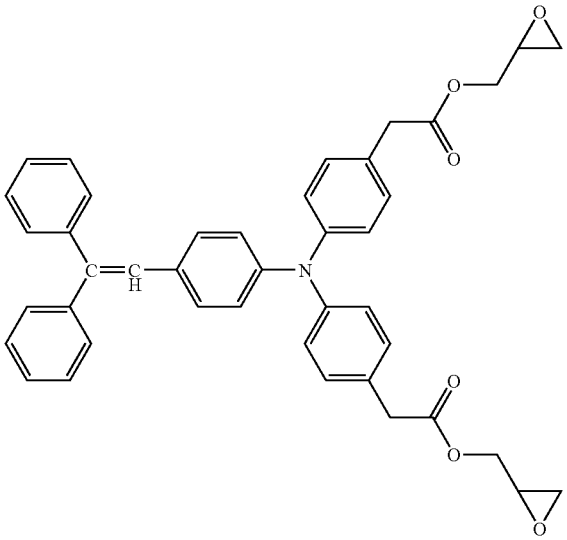
I-38
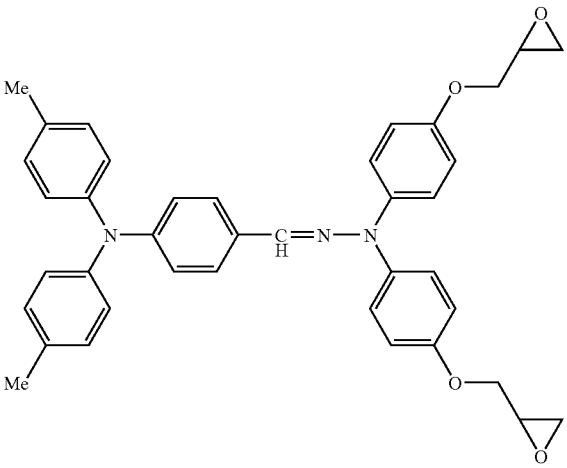

-continued
I-39
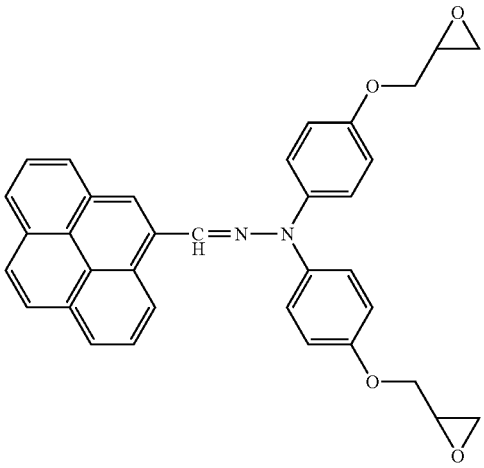
I-40
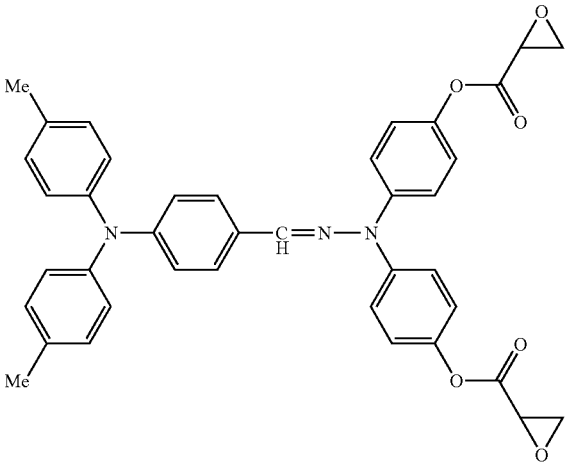
I-41
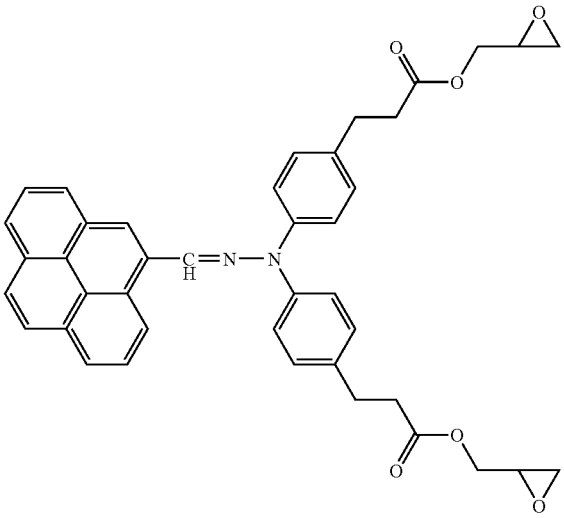
-continued
I-42
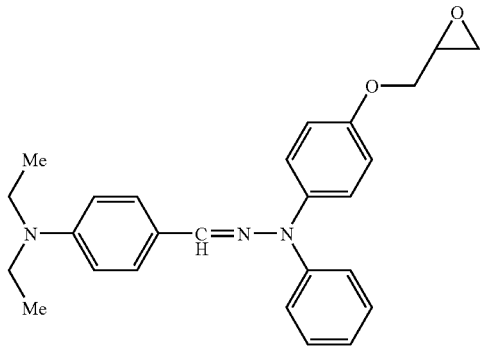
I-43
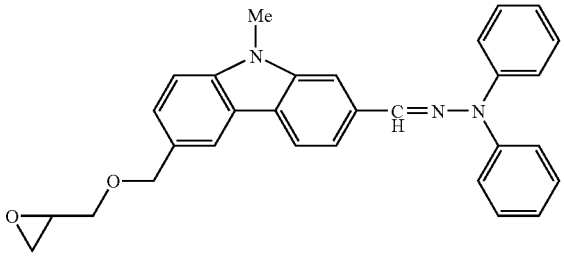
I-44
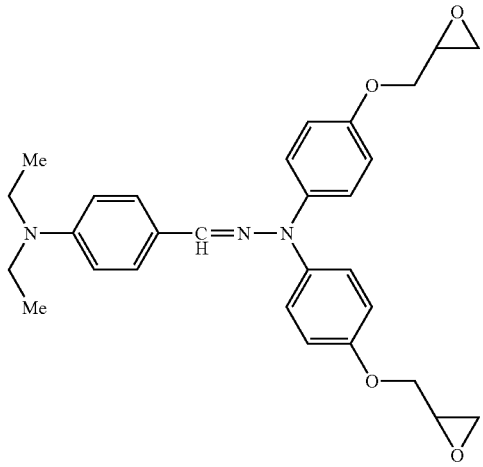

-continued

I-45

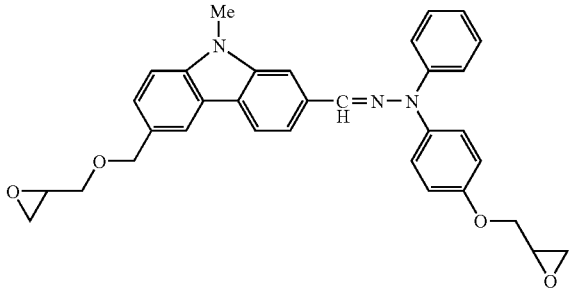

I-46

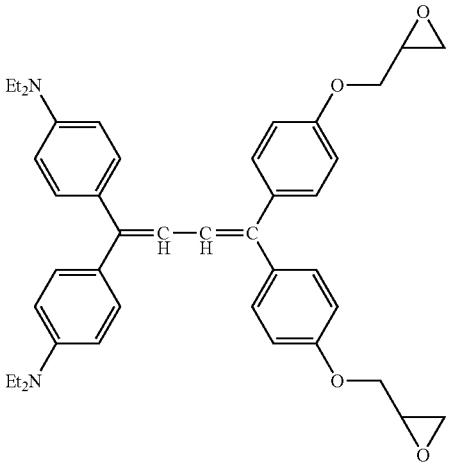

-continued

I-47

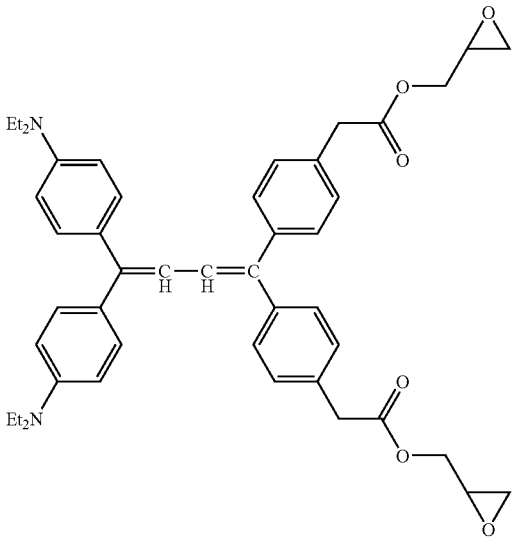

Specific examples of the compounds represented by Formula (II) above include the compounds represented by the following formulae (II-1) to (II-61). The compounds represented by the following Formulae (II-1) to (II-61) have a structure in which $Ar^1$ to $Ar^5$ and k shown in Formula (VI) and the alkoxysilyl group(s) are specified as indicated in the following tables.

| NO. | $Ar^1$ | $Ar^2$ | $Ar^3$ |
|---|---|---|---|
| II-1 | 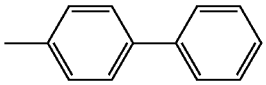 | 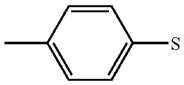 | — |
| II-2 | 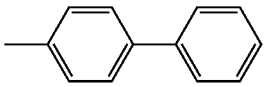 | 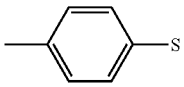 | — |
| II-3 | 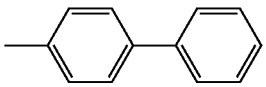 | 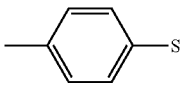 | — |
| II-4 | 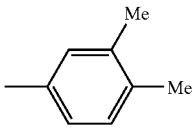 | 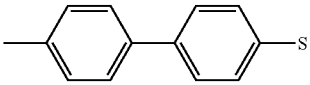 | — |
| II-5 | 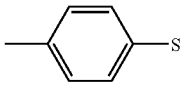 | 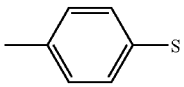 | — |
| II-6 | 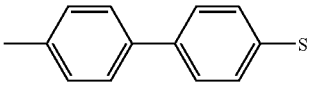 | 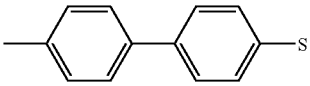 | — |

-continued
| | | | |
|---|---|---|---|
| II-7 | 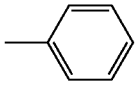 | 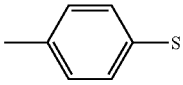 | 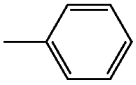 |
| II-8 | 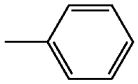 | 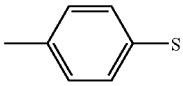 | 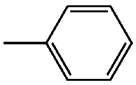 |
| II-9 | 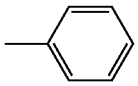 | 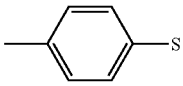 | 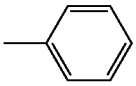 |
| II-10 | 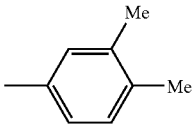 | 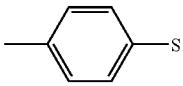 | 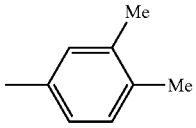 |
| II-11 | 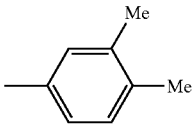 | 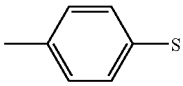 | 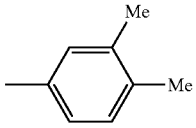 |
| II-12 | 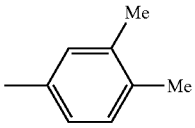 | 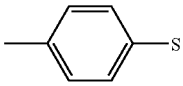 | 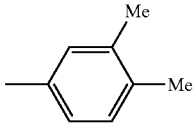 |
| II-13 | 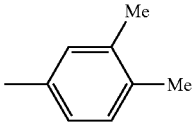 | 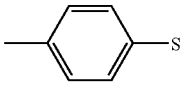 | 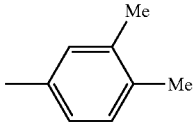 |
| II-14 | 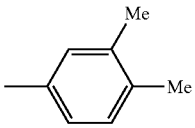 | 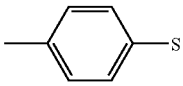 | 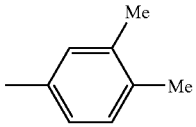 |
| II-15 | 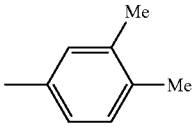 | 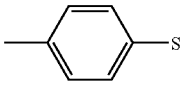 | 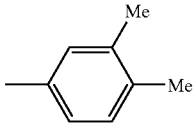 |
| II-16 | 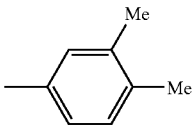 | 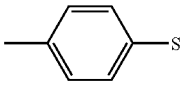 | 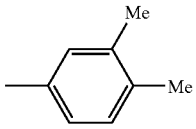 |
| II-17 | 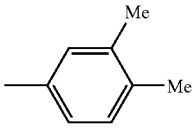 | 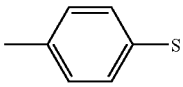 | 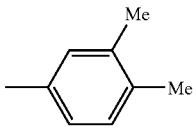 |
| II-18 | 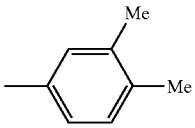 | 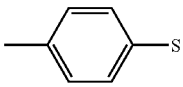 | 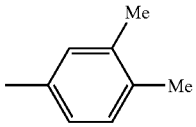 |

-continued
| | | | |
|---|---|---|---|
| II-19 | 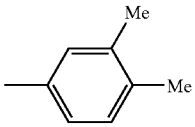 | 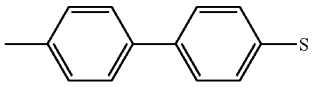 | 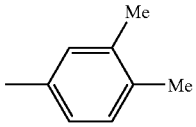 |
| II-20 | 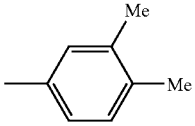 | 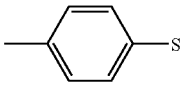 | 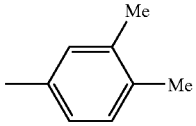 |
| II-21 | 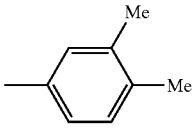 | 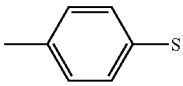 | 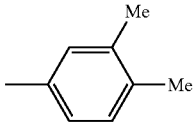 |
| II-22 | 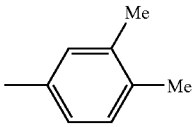 | 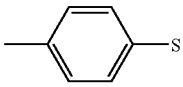 | 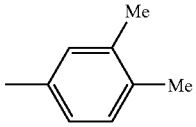 |
| II-23 | 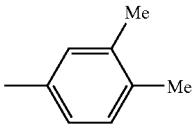 | 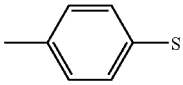 | 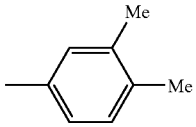 |
| II-24 | 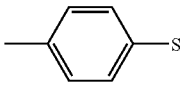 | 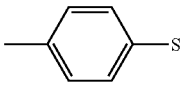 | 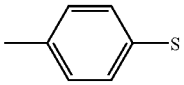 |
| II-25 | 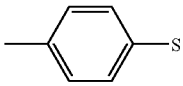 | 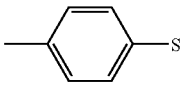 | 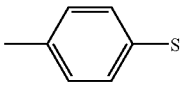 |
| II-26 | 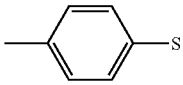 | 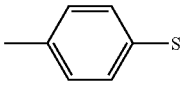 | 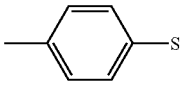 |
| II-27 | 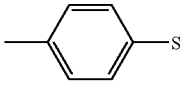 | 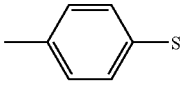 | 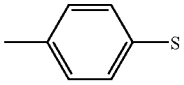 |
| II-28 | 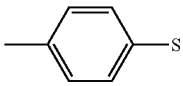 | 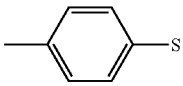 | 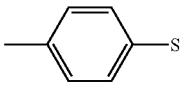 |
| II-29 | 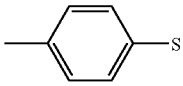 | 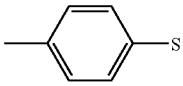 | 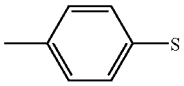 |
| II-30 | 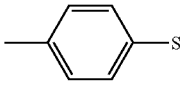 | 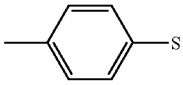 | 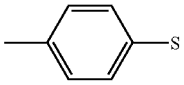 |
| II-31 | 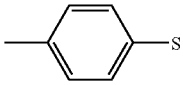 | 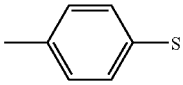 | 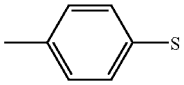 |
| II-32 | 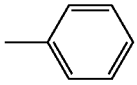 | 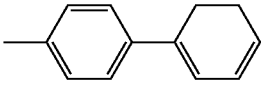 | — |

-continued
| | | | |
|---|---|---|---|
| II-33 | 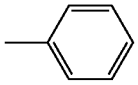 | 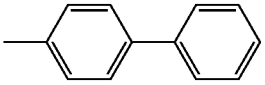 | — |
| II-34 | 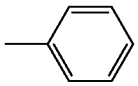 | 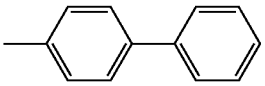 | — |
| II-35 | 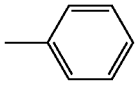 | 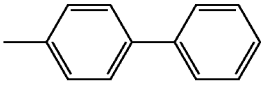 | — |
| II-36 | 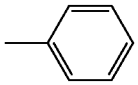 | 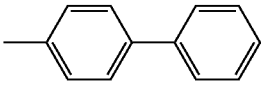 | — |
| II-37 | 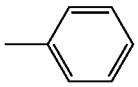 | 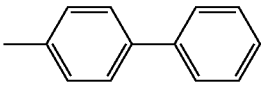 | — |
| II-38 | 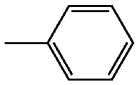 | 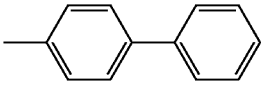 | — |
| II-39 | 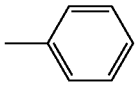 | 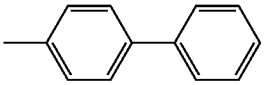 | — |
| II-40 | 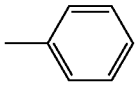 | 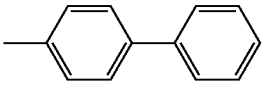 | — |
| II-41 | 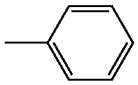 | 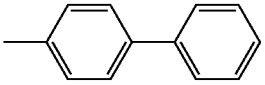 | — |
| II-42 | 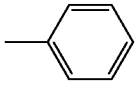 | 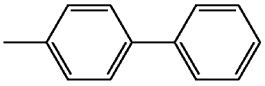 | — |
| II-43 | 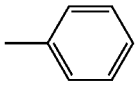 | 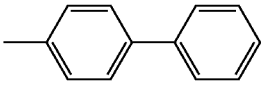 | — |
| II-44 | 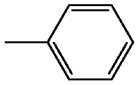 | 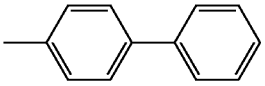 | — |
| II-45 | 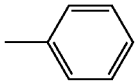 | 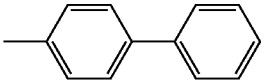 | — |
| II-46 | 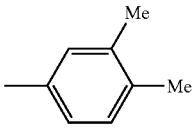 | 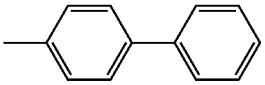 | — |
| II-47 | 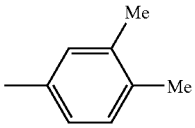 | 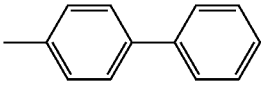 | — |

-continued
| | | | |
|---|---|---|---|
| II-48 | 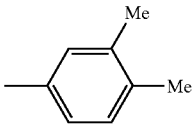 | 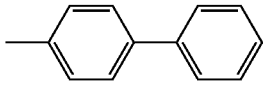 | — |
| II-49 | 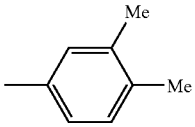 | 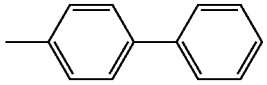 | — |
| II-50 | 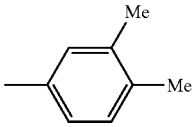 | 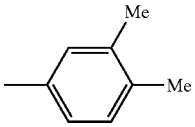 | — |
| II-51 | 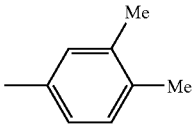 | 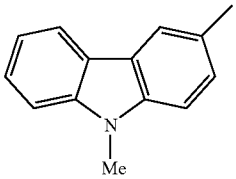 | — |
| II-52 | 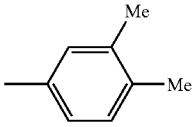 | 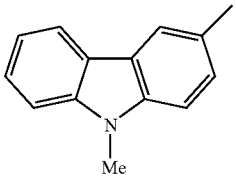 | — |
| II-53 | 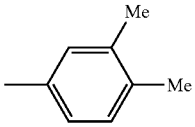 | 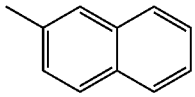 | — |
| II-54 | 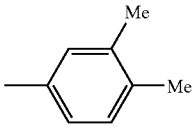 | 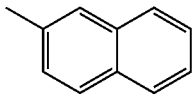 | — |
| II-55 | 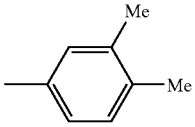 | 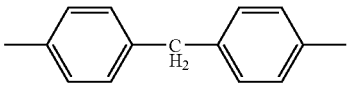 | — |
| II-56 | 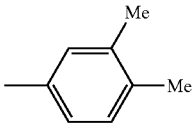 | 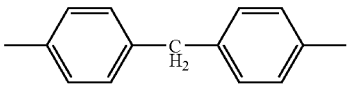 | — |
| II-57 | 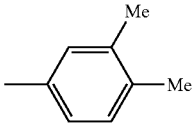 | 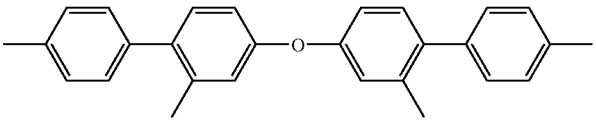 | — |

-continued
| | | | |
|---|---|---|---|
| II-58 | 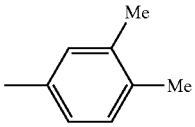 | 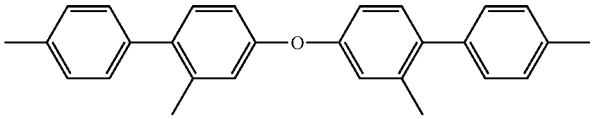 | — |
| II-59 | 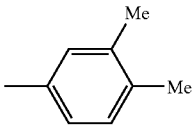 | 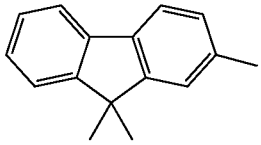 | — |
| II-60 | 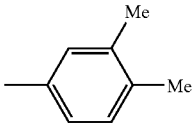 | 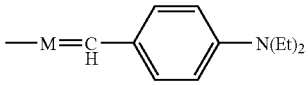 | — |
| II-61 | 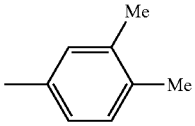 | 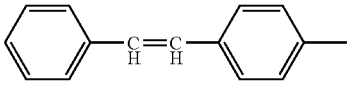 | — |
| NO. | $Ar^4$ | $Ar^5$ | k | S |
|---|---|---|---|---|
| II-1 | — | 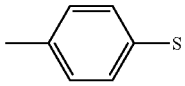 | 0 | —$(CH_2)_2$—COO—$(CH_2)_3$—Si(OiPr)$_3$ |
| II-2 | — | 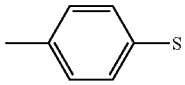 | 0 | —$(CH_2)_2$—COO—$(CH_2)_3$—Si(OiPr)$_2$Me |
| II-3 | — | 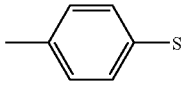 | 0 | —$(CH_2)_2$—COO—$(CH_2)_3$—Si(OiPr)Me$_2$ |
| II-4 | — | 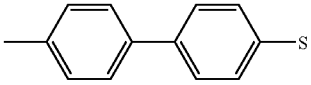 | 0 | —COO—$(CH_2)_3$—Si(OiPr)$_3$ |
| II-5 | — | 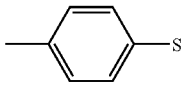 | 0 | —$(CH_2)_2$—COO—$(CH_2)_3$—Si(OiPr)$_3$ |
| II-6 | — | 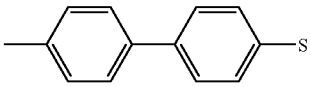 | 0 | —COO—$(CH_2)_3$—Si(OiPr)$_3$ |
| II-7 | 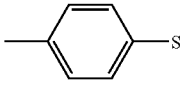 | 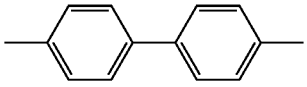 | 1 | —$(CH_2)_4$—Si(OEt)$_3$ |
| II-8 | 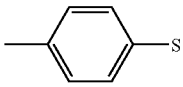 | 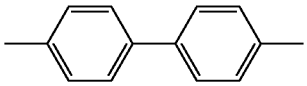 | 1 | —$(CH_2)_4$—Si(OPt)$_3$ |
| II-9 | 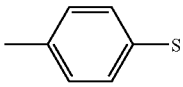 | 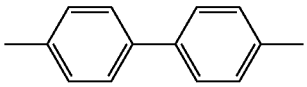 | 1 | —CH═CH—$(CH_2)_2$—Si(OiPr)$_3$ |

-continued
| | | | | |
|---|---|---|---|---|
| II-10 | 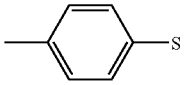 | 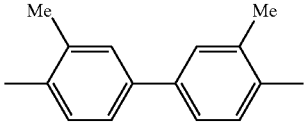 | 1 | —$(CH_2)_4$—Si(OiMe)$_3$ |
| II-11 | 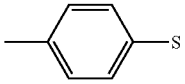 | 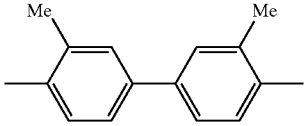 | 1 | —$(CH_2)_4$—Si(OiPr)$_3$ |
| II-12 | 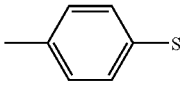 | 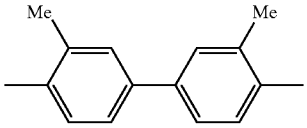 | 1 | —CH═CH—$(CH_2)_2$—Si(OiPr)$_3$ |
| II-13 | 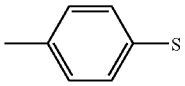 | 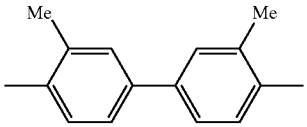 | 1 | —CH═N—$(CH_2)_3$—Si(OiPr)$_3$ |
| II-14 | 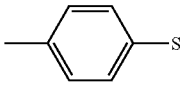 | 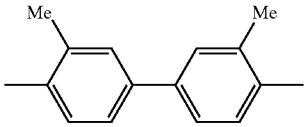 | 1 | —O—$(CH_2)_3$—Si(OiPr)$_3$ |
| II-15 | 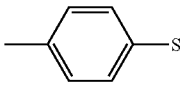 | 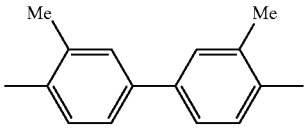 | 1 | —COO—$(CH_2)_3$—Si(OiPr)$_3$ |
| II-16 | 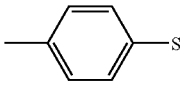 | 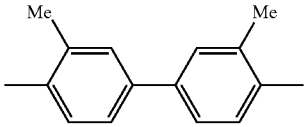 | 1 | —$(CH_2)_2$—COO—$(CH_2)_3$—Si(OiPr)$_3$ |
| II-17 | 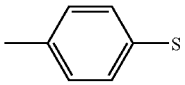 | 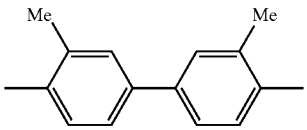 | 1 | —$(CH_2)_2$—COO—$(CH_2)_3$—Si(OiPr)$_2$Me |
| II-18 | 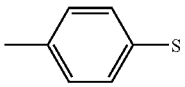 | 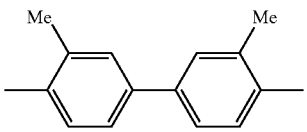 | 1 | —$(CH_2)_2$—COO—$(CH_2)_3$—Si(OiPr)Me$_2$ |
| II-19 | 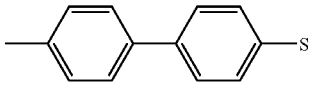 | 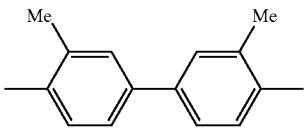 | 1 | —COO—$(CH_2)_3$—Si(OiPr)$_3$ |
| II-20 | 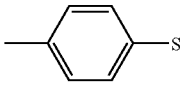 | 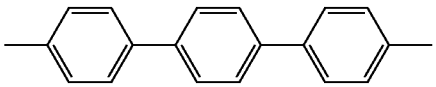 | 1 | —$(CH_2)_4$—Si(OiPr)$_3$ |
| II-21 | 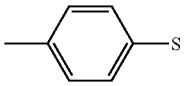 | 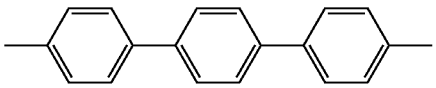 | 1 | —CH═CH—$(CH_2)_2$—Si(OiPr)$_3$ |

-continued
| | | | | |
|---|---|---|---|---|
| II-22 | 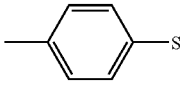 | 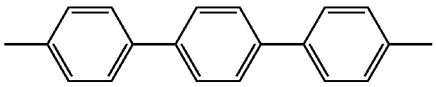 | 1 | —$(CH_2)_2$—COO—$(CH_2)_3$—Si(OiPr)$_3$ |
| II-23 | 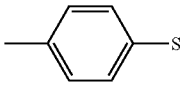 | 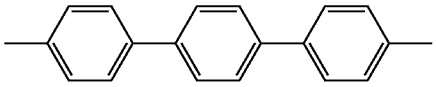 | 1 | —$(CH_2)_2$—COO—$(CH_2)_3$—Si(OiPr)$_2$Me |
| II-24 | 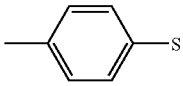 | 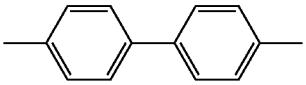 | 1 | —COO—$(CH_2)_3$—Si(OiPr)$_3$ |
| II-25 | 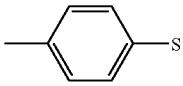 | 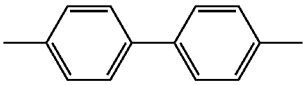 | 1 | —$(CH_2)_2$—COO—$(CH_2)_3$—Si(OiPr)$_3$ |
| II-26 | 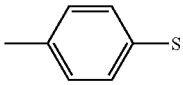 | 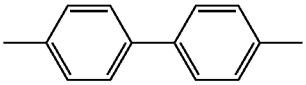 | 1 | —$(CH_2)_2$—COO—$(CH_2)_3$—Si(OiPr)$_2$Me |
| II-27 | 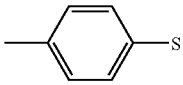 | 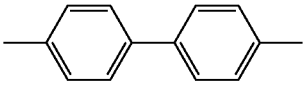 | 1 | —$(CH_2)_2$—COO—$(CH_2)_3$—Si(OiPr)Me$_2$ |
| II-28 | 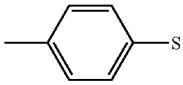 | 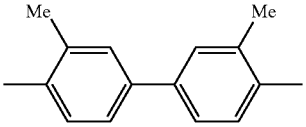 | 1 | —COO—$(CH_2)_3$—Si(OiPr)$_3$ |
| II-29 | 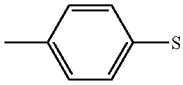 | 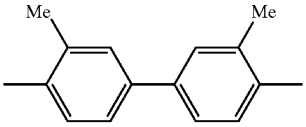 | 1 | —$(CH_2)_2$—COO—$(CH_2)_3$—Si(OiPr)$_3$ |
| II-30 | 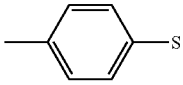 | 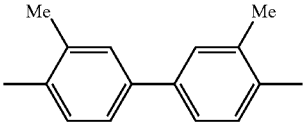 | 1 | —$(CH_2)_2$—COO—$(CH_2)_3$—Si(OiPr)$_2$Me |
| II-31 | 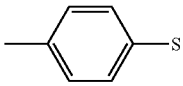 | 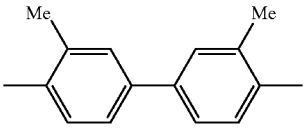 | 1 | —$(CH_2)_2$—COO—$(CH_2)_3$—Si(OiPr)Me$_2$ |
| II-32 | — | 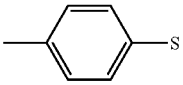 | 0 | —$(CH_2)_4$—Si(OiPr)$_3$ |
| II-33 | — | 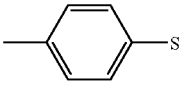 | 0 | —$(CH_2)_4$—Si(OEt)$_3$ |
| II-34 | — | 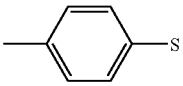 | 0 | —$(CH_2)_4$—Si(OMe)$_3$ |
| II-35 | — | 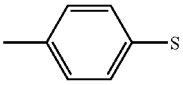 | 0 | —$(CH_2)_4$—SiMe(OMe)$_2$ |

-continued

| | | | | |
|---|---|---|---|---|
| II-36 | — | 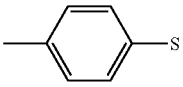 | 0 | —$(CH_2)_4$—$SiMe(OiPr)_2$ |
| II-37 | — | 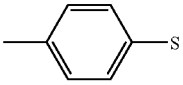 | 0 | —CH═CH—$(CH_2)_2$—$Si(OiPr)_3$ |
| II-38 | — | 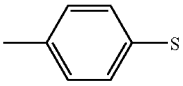 | 0 | —CH═CH—$(CH_2)_2$—$Si(OMe)_3$ |
| II-39 | — | 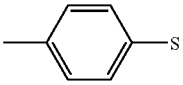 | 0 | —CH═N—$(CH_2)_3$—$Si(OiMe)_3$ |
| II-40 | — | 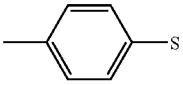 | 0 | —CH═N—$(CH_2)_3$—$Si(OiPr)_3$ |
| II-41 | — | 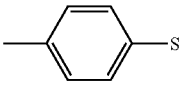 | 0 | —O—$(CH_2)_3$—$Si(OiPr)_3$ |
| II-42 | — | 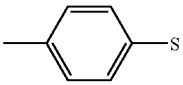 | 0 | —COO—$(CH_2)_3$—$Si(OiPr)_3$ |
| II-43 | — | 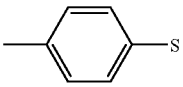 | 0 | —$(CH_2)_2$—COO—$(CH_2)_3$—$Si(OiPr)_3$ |
| II-44 | — | 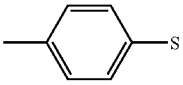 | 0 | —$(CH_2)_2$—COO—$(CH_2)_3$—$Si(OiPr)_2Me$ |
| II-45 | — | 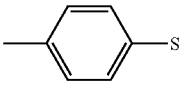 | 0 | —$(CH_2)_2$—COO—$(CH_2)_3$—$Si(OiPr)Me_2$ |
| II-46 | — | 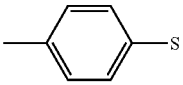 | 0 | —$(CH_2)_4$—$Si(OMe)_3$ |
| II-47 | — | 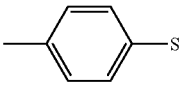 | 0 | —$(CH_2)_2$—COO—$(CH_2)_3$—$Si(OiPr)_3$ |
| II-48 | — | 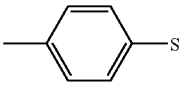 | 0 | —$(CH_2)_2$—COO—$(CH_2)_3$—$SiMe(OiPr)_2$ |
| II-49 | — | 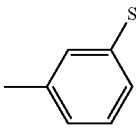 | 0 | —O—$(CH_2)_4$—$Si(OiPr)_3$ |
| II-50 | — | 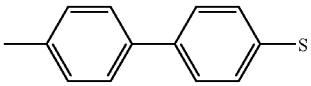 | 0 | —COO—$(CH_2)_3$—$Si(OiPr)_3$ |
| II-51 | — | 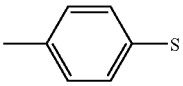 | 0 | —$(CH_2)_4$—$Si(OiPr)_3$ |

-continued

| | | | | |
|---|---|---|---|---|
| II-52 | — | 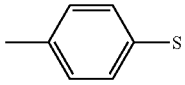 | 0 | —$(CH_2)_2$—COO—$(CH_2)_3$—Si(OiPr)$_3$ |
| II-53 | — | 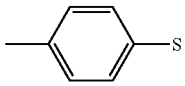 | 0 | —$(CH_2)_4$—Si(OiPr)$_3$ |
| II-54 | — | 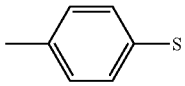 | 0 | —$(CH_2)_2$—COO—$(CH_2)_3$—Si(OiPr)$_3$ |
| II-55 | — | 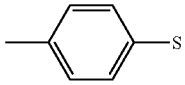 | 0 | —$(CH_2)_4$—Si(OiPr)$_3$ |
| II-56 | — | 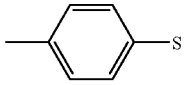 | 0 | —$(CH_2)_2$—COO—$(CH_2)_3$—Si(OiPr)$_3$ |
| II-57 | — | 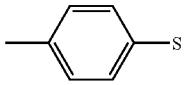 | 0 | —$(CH_2)_4$—Si(OiPr)$_3$ |
| II-58 | — | 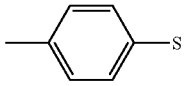 | 0 | —$(CH_2)_2$—COO—$(CH_2)_3$—Si(OiPr)$_3$ |
| II-59 | — | 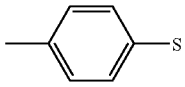 | 0 | —$(CH_2)_2$—COO—$(CH_2)_3$—Si(OiPr)$_3$ |
| II-60 | — | 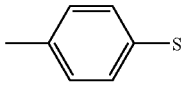 | 0 | —$(CH_2)_2$—COO—$(CH_2)_3$—Si(OiPr)$_3$ |
| II-61 | — | 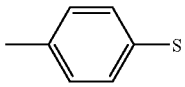 | 0 | —$(CH_2)_2$—COO—$(CH_2)_3$—Si(OiPr)$_3$ |

Specific examples of the compounds represented by Formula (III) above include the compounds represented by the following formulae (III-1) to (III-40). In the following, Me and a binding site described with no substituent represent a methyl group, and Et represents an ethyl group.

III-1

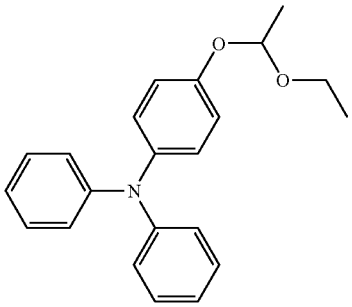

III-2

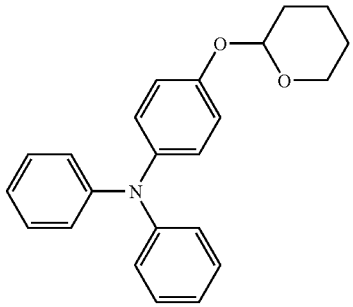

-continued
III-3
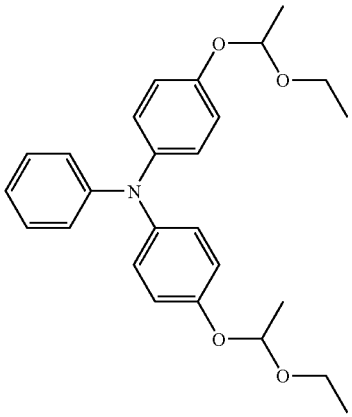
III-4
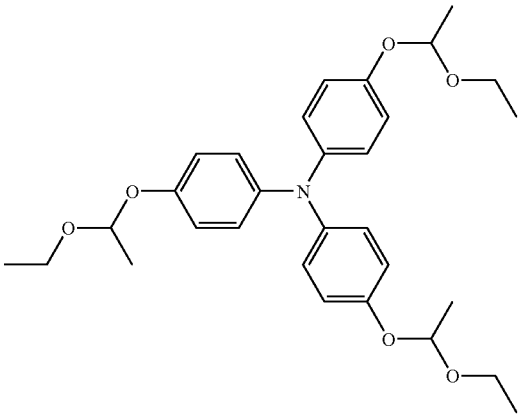
III-5
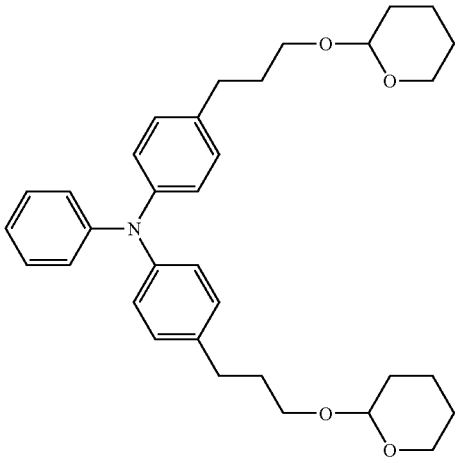
III-6
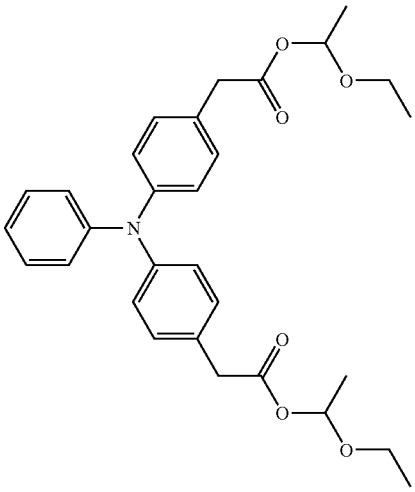
III-7
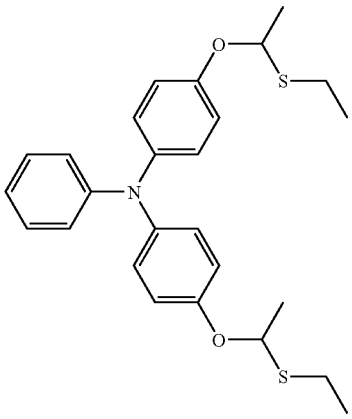
III-8
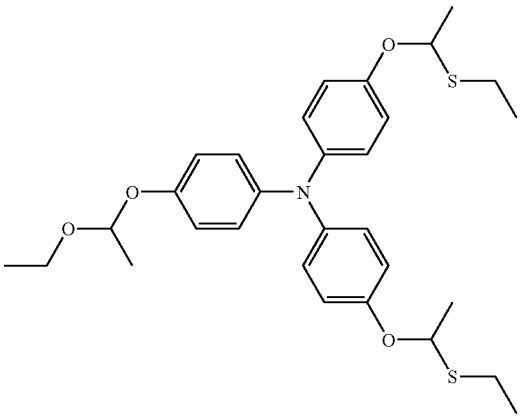

-continued
III-9
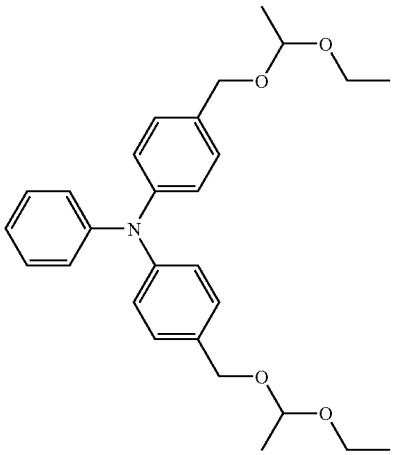
III-10
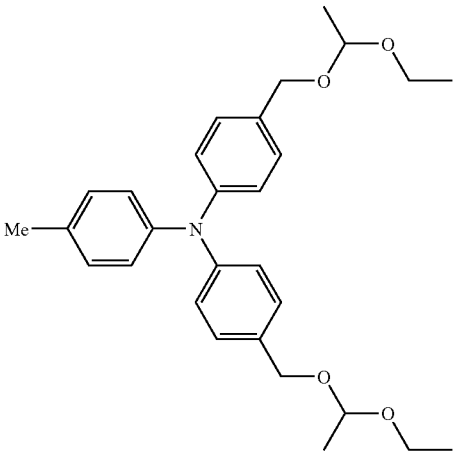
III-11
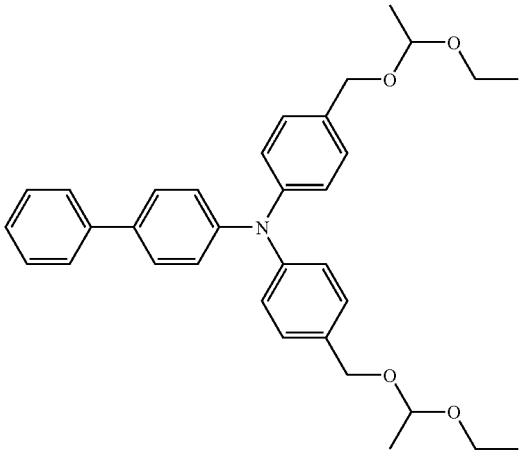
III-12
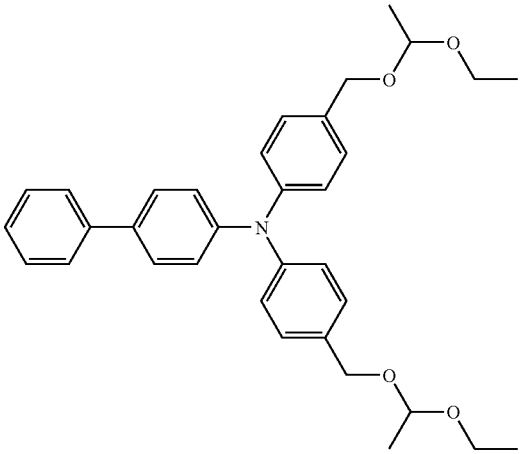
III-13
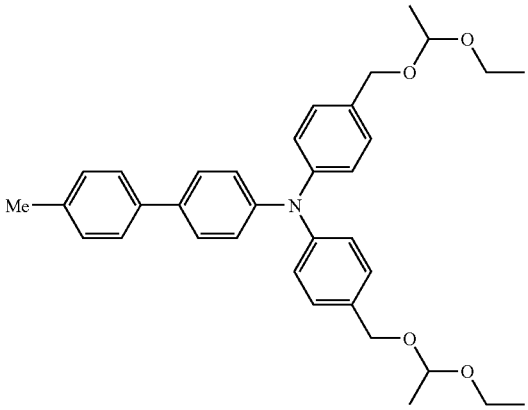
III-14
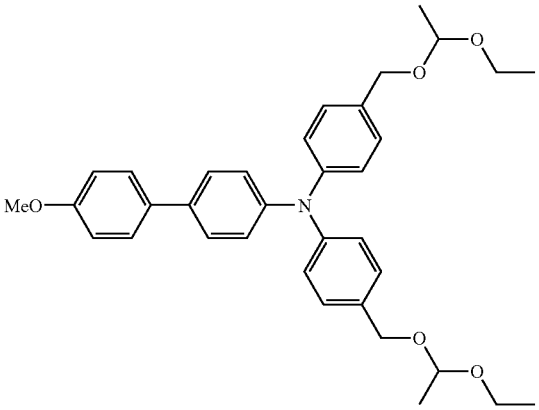

-continued
III-15
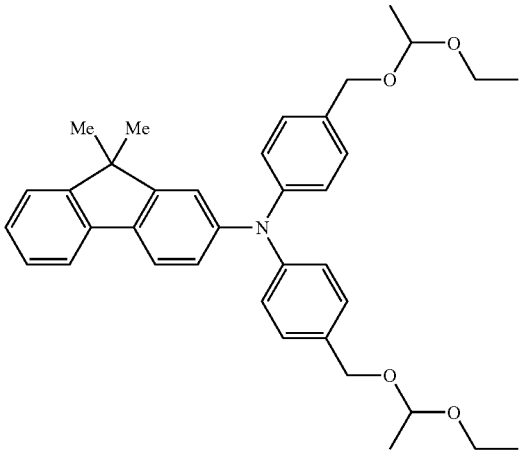
III-16
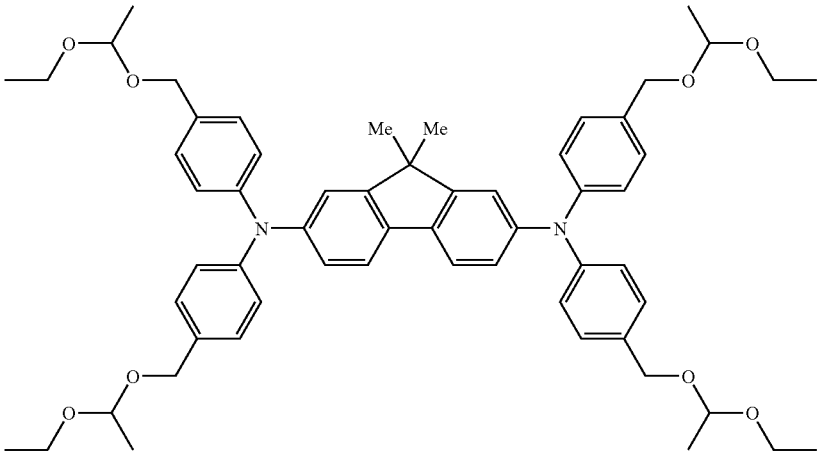
III-17
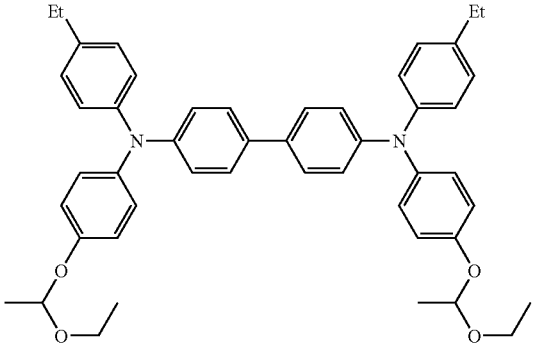
III-18
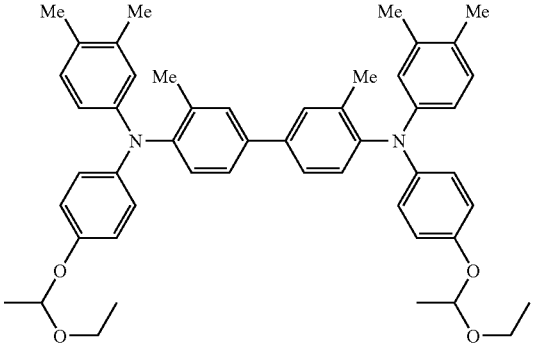

-continued
III-19
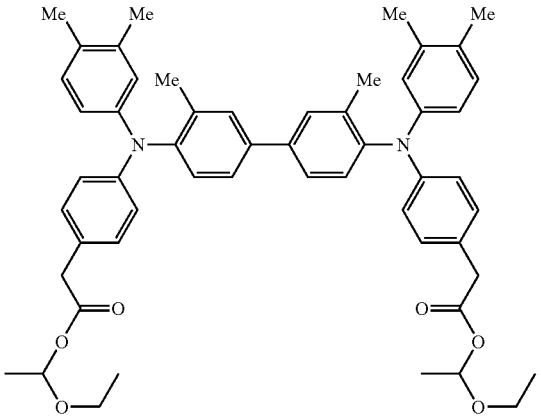
III-20
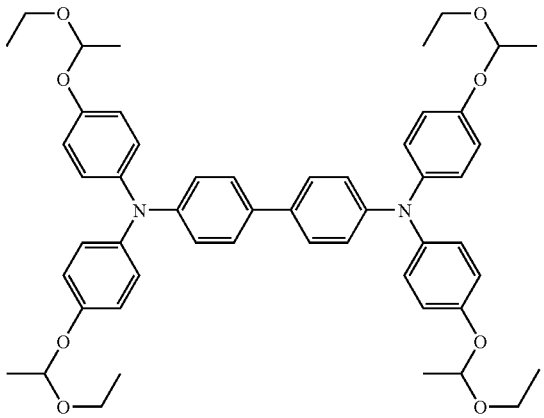
III-21
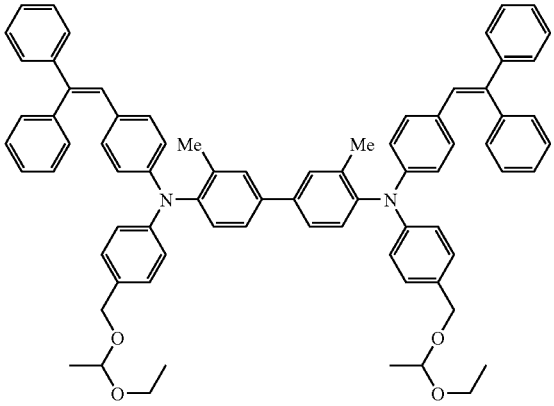
III-22
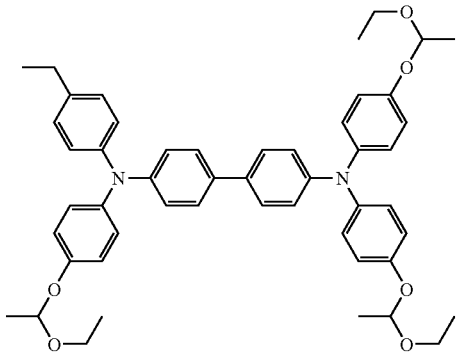
III-23
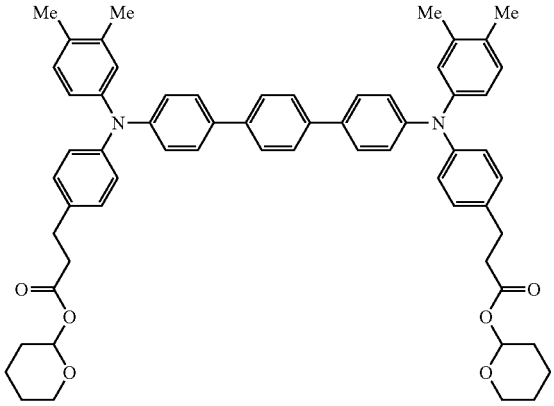
III-24
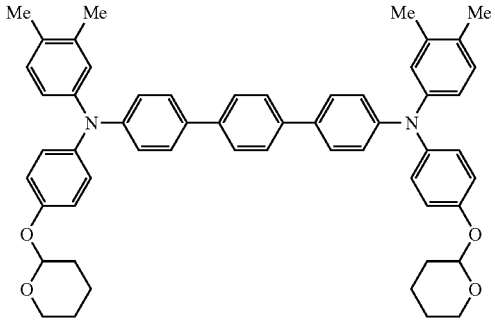

-continued
III-25
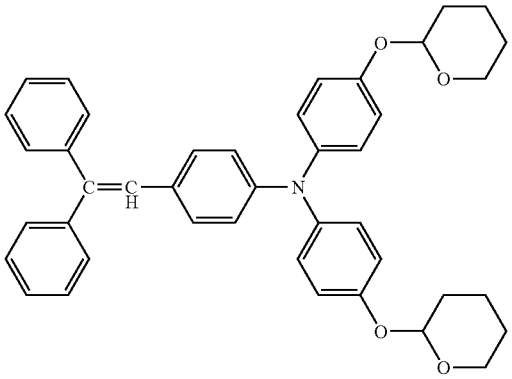
III-26
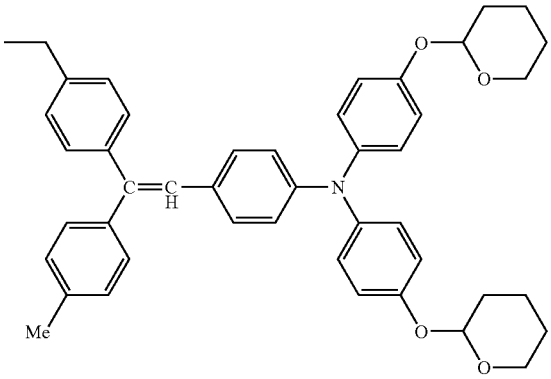
III-27
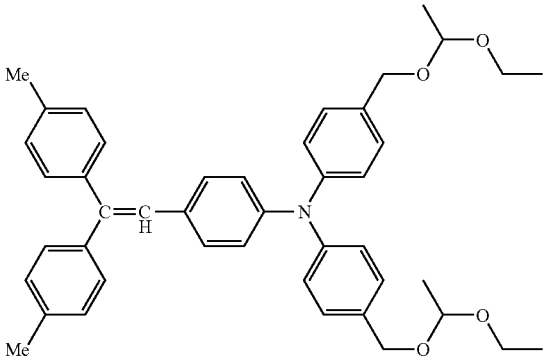
III-28
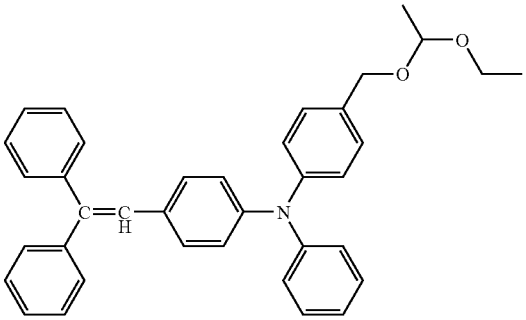
III-29
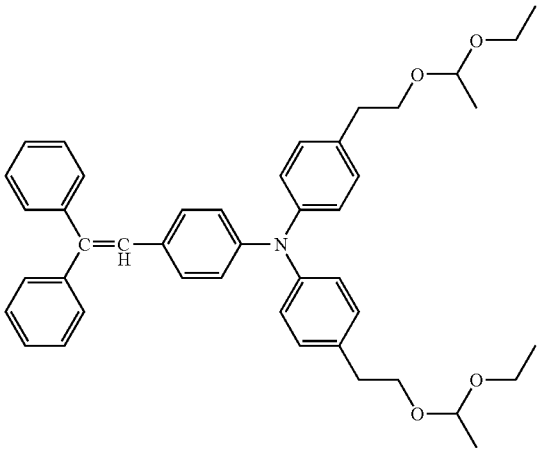
III-30
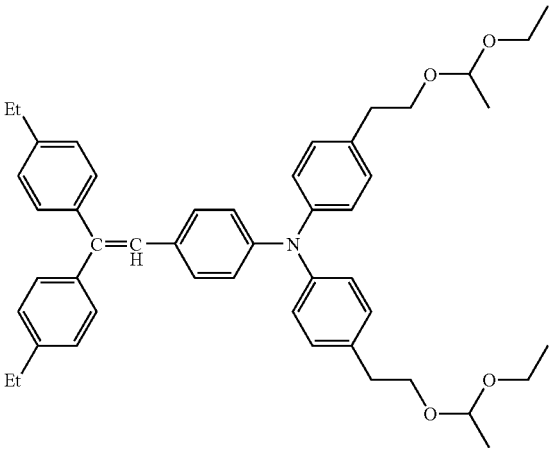

-continued
III-31
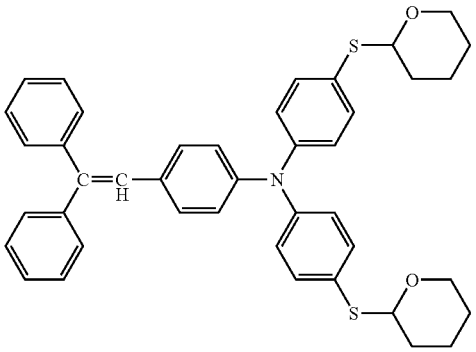
III-32
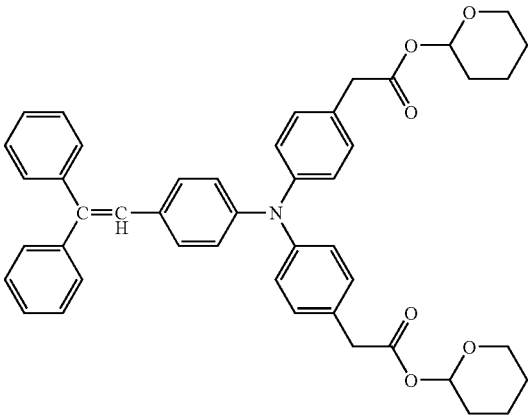
III-33
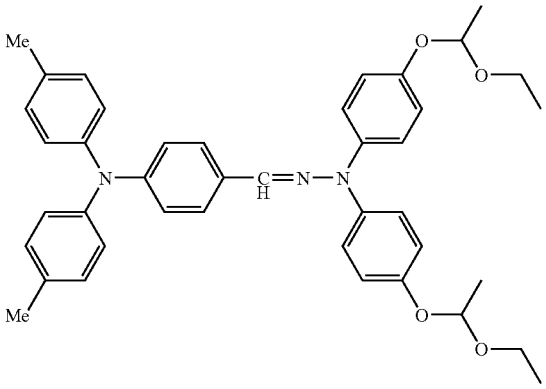
III-34
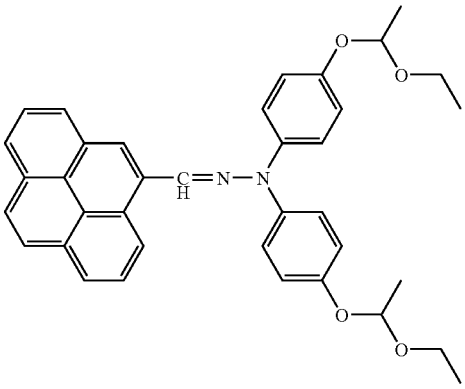
III-35
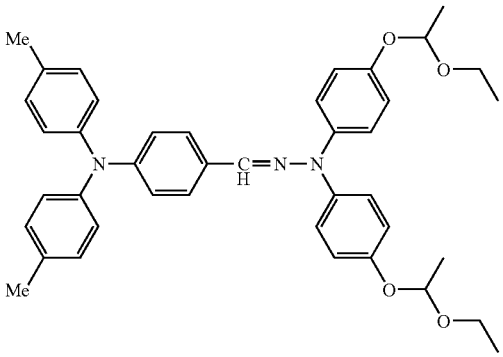
III-36
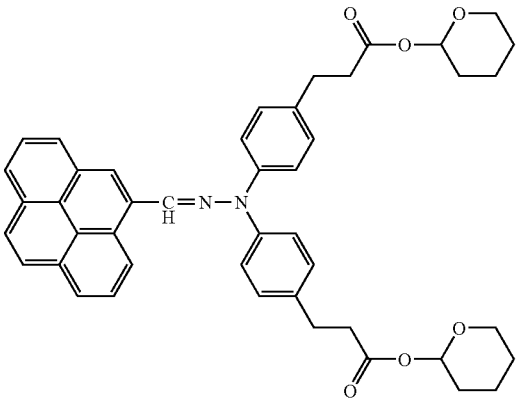

-continued
III-37
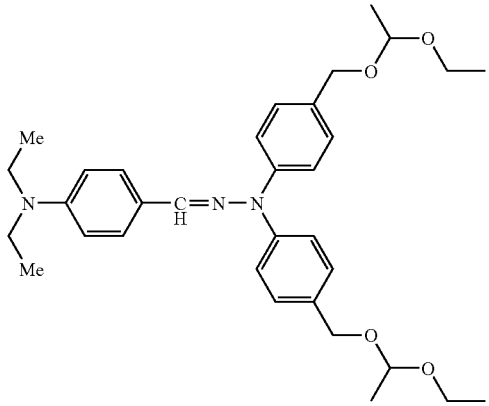
III-38
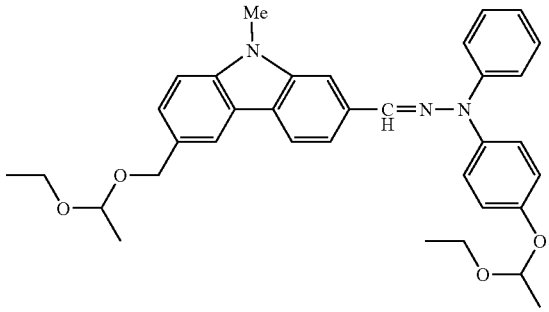
III-39
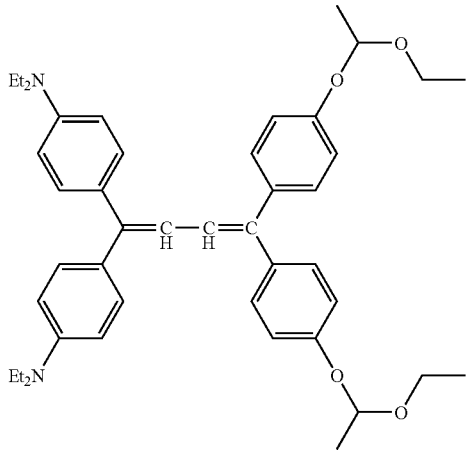
III-40
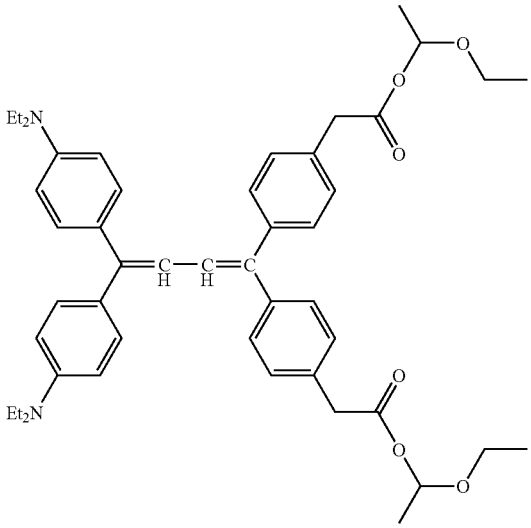
Specific examples of the compounds represented by Formula (IV) above include the compounds represented by the following formulae (IV-1) to (IV-55). In the following, Me and a binding site described with no substituent represent a methyl group.
IV-1
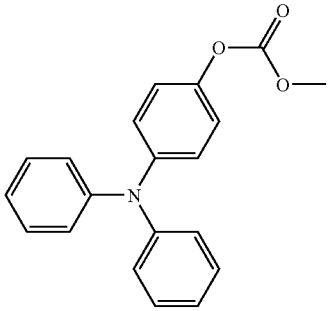
IV-2
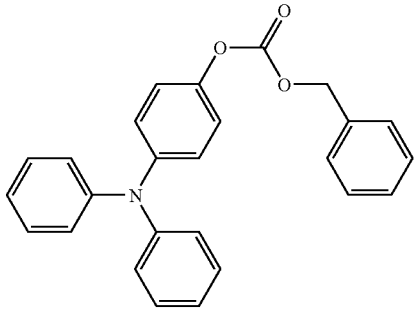

-continued
IV-3
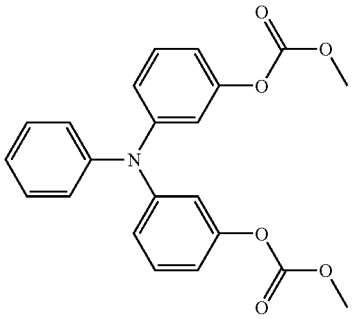
IV-4
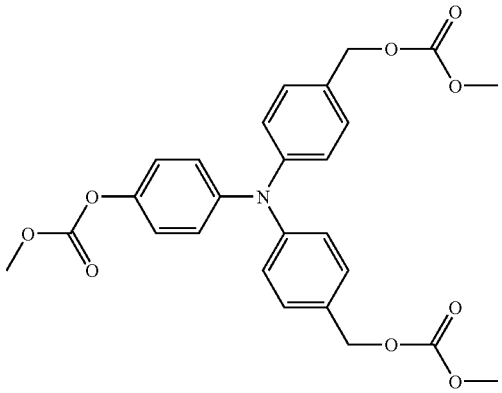
IV-5
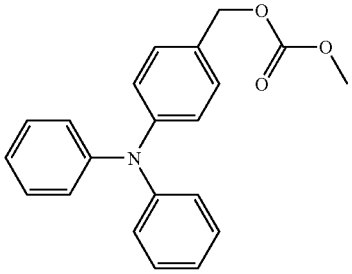
IV-6
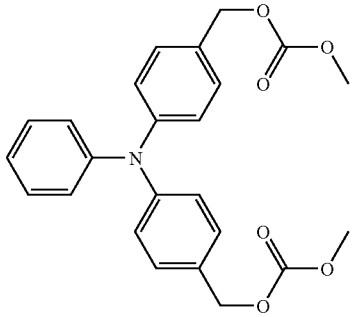
IV-7
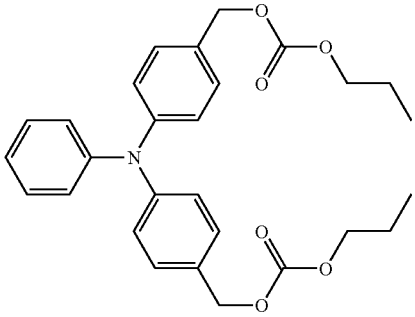
IV-8
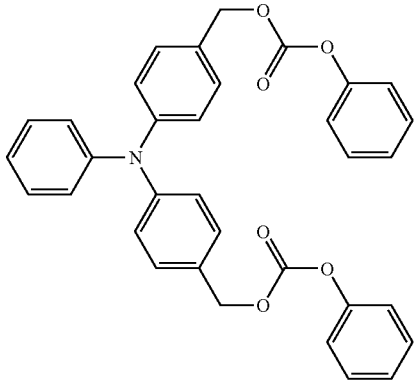
IV-9
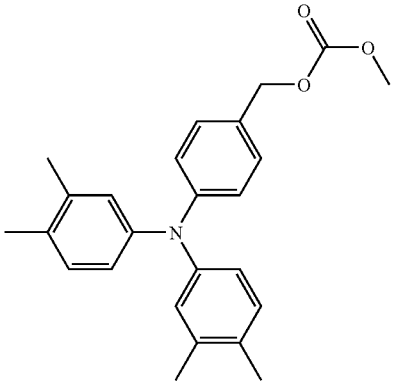
IV-10
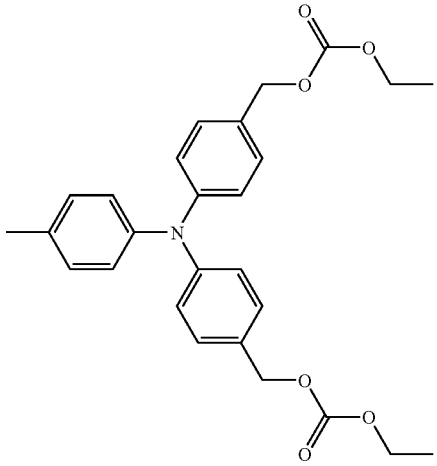

-continued
IV-11
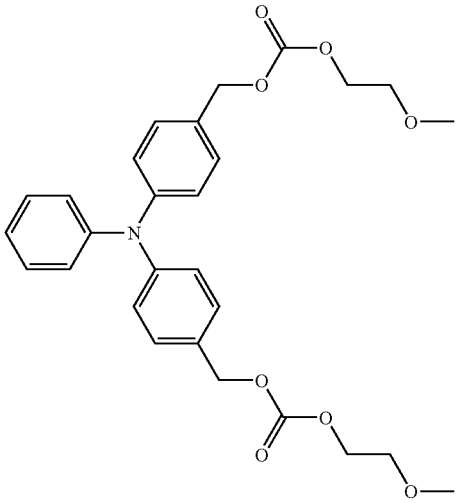
IV-12
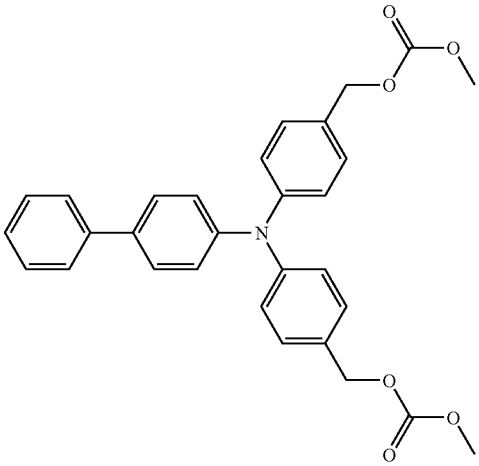
IV-13
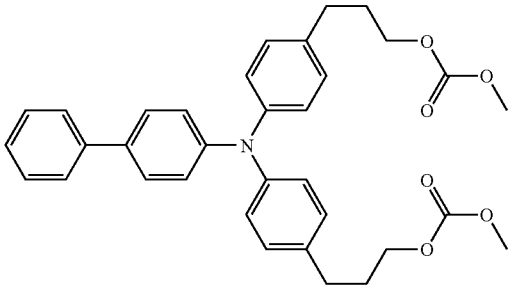
IV-14
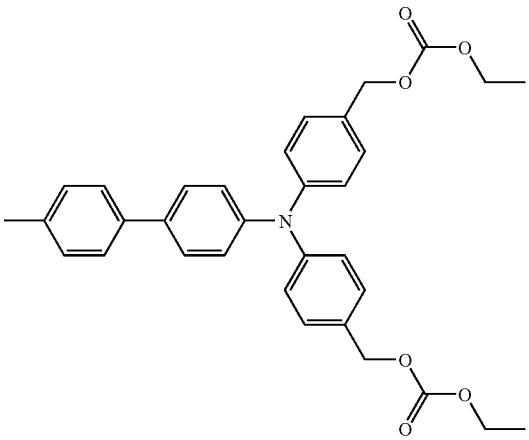
IV-15
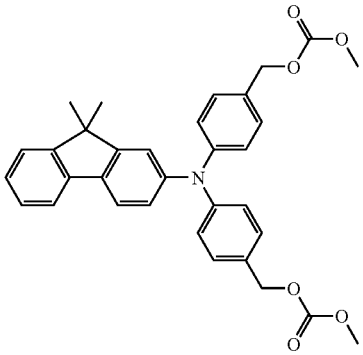
IV-16
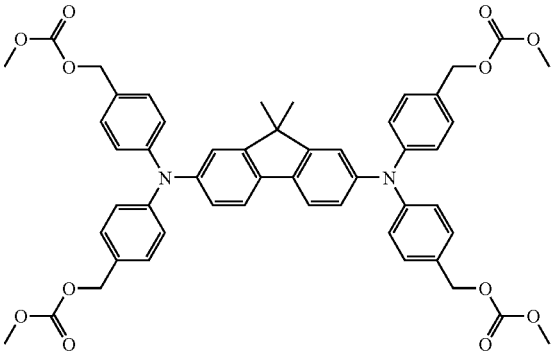

-continued
IV-17
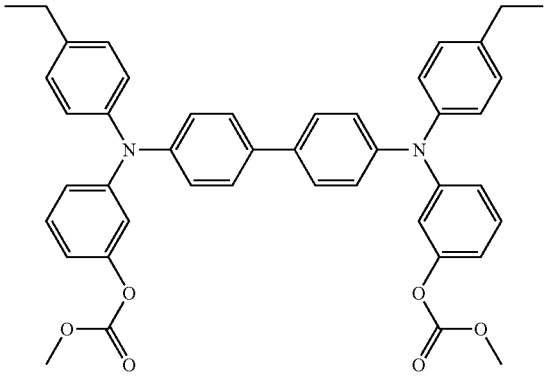
IV-18
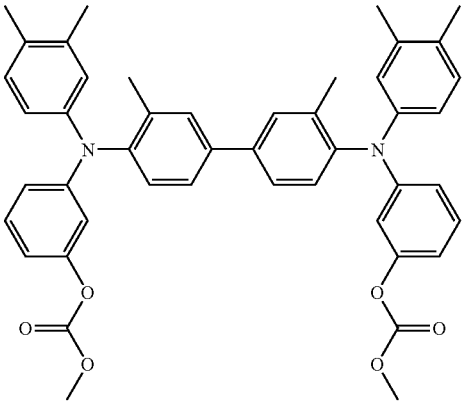
IV-19
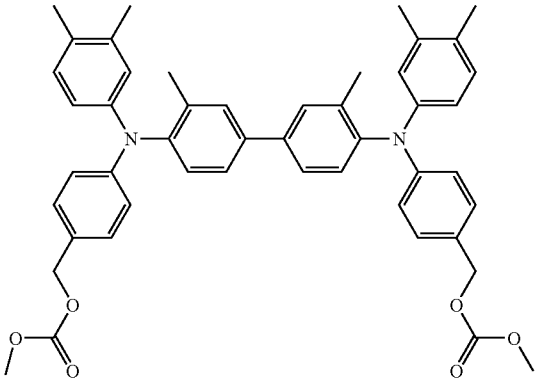
IV-20
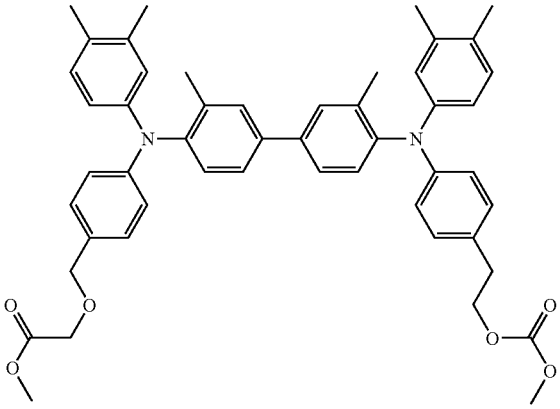
IV-21
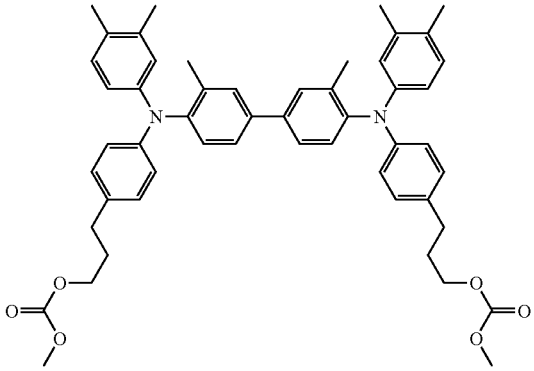
IV-22
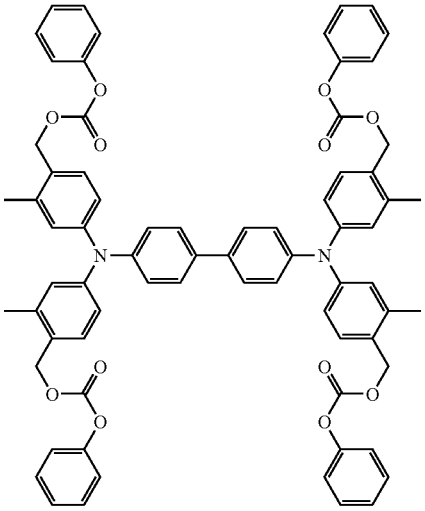

-continued
IV-23
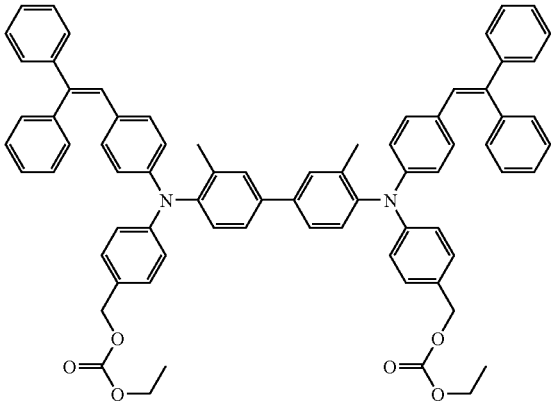
IV-24
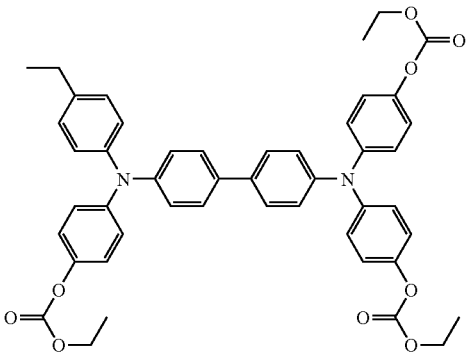
IV-25
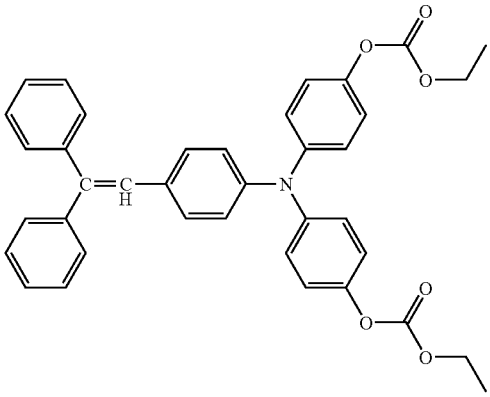
IV-26
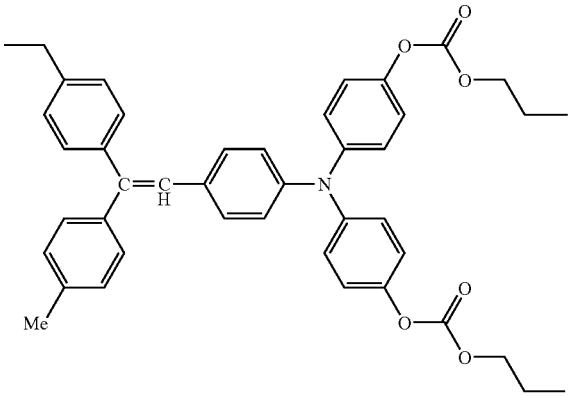
IV-27
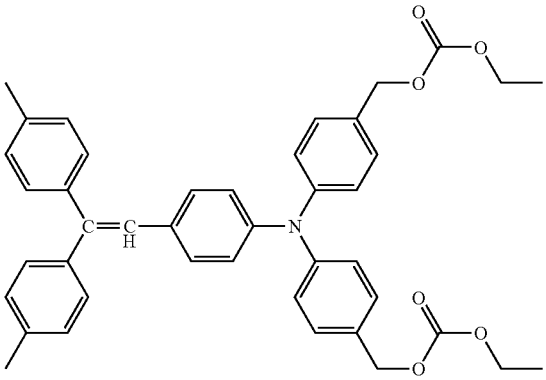
IV-28
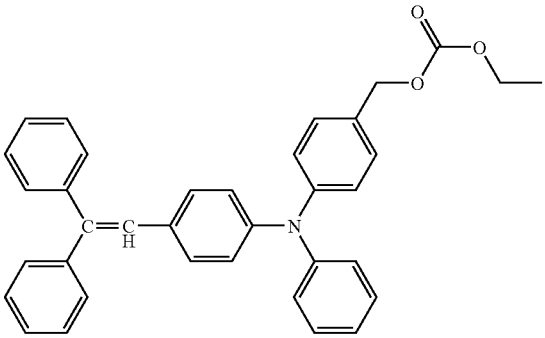

-continued
IV-29
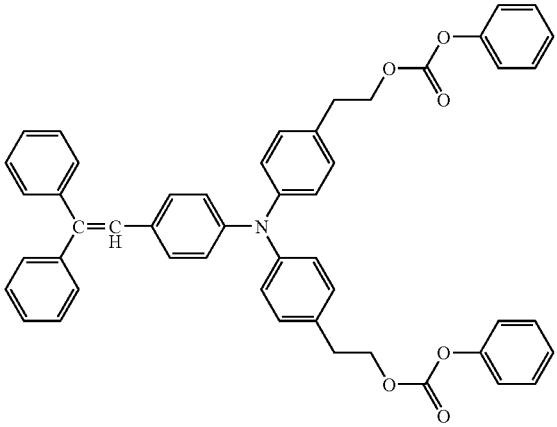
IV-30
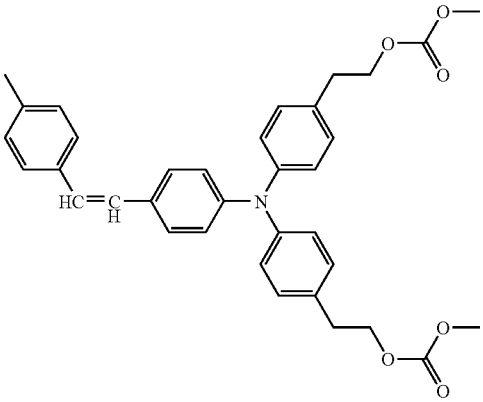
IV-31
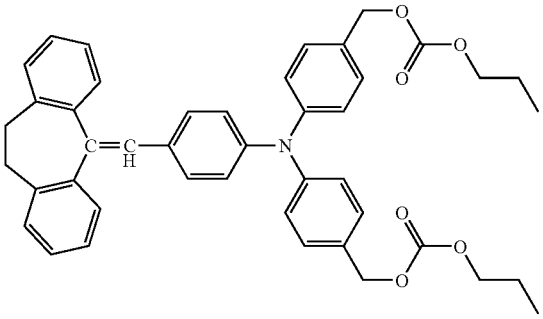
IV-32
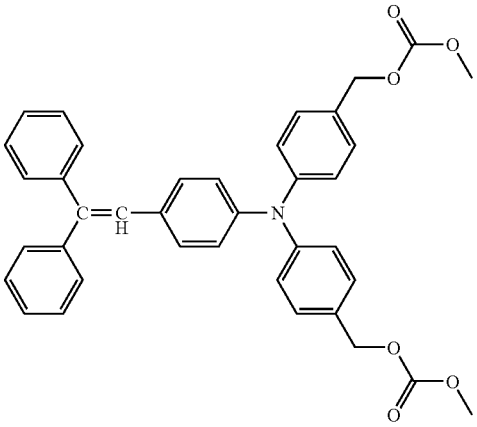
IV-33
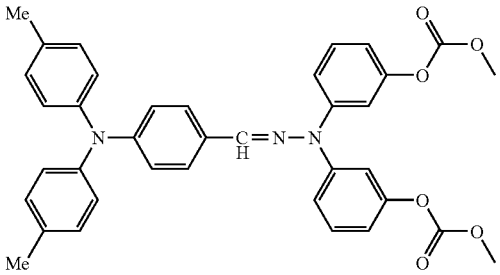
IV-34
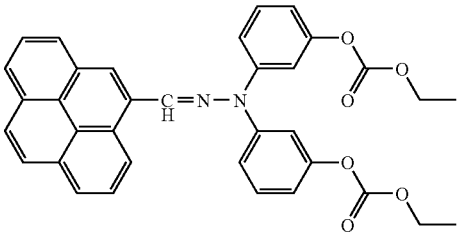
IV-35
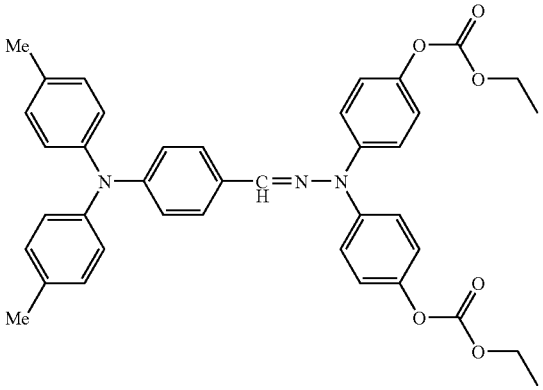
IV-36
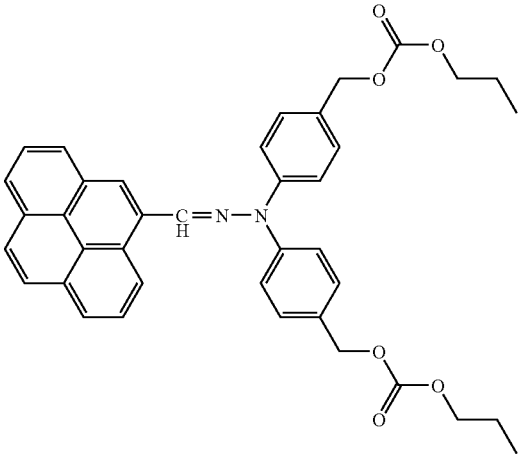

-continued
IV-37
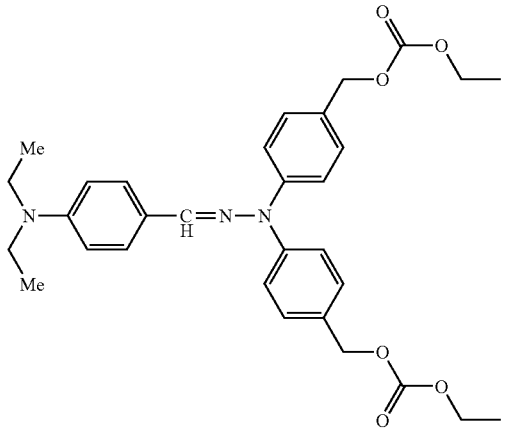
IV-38
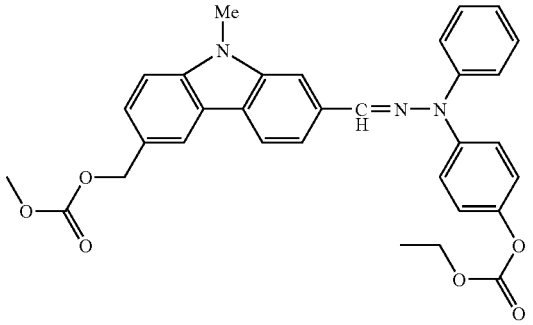
IV-39
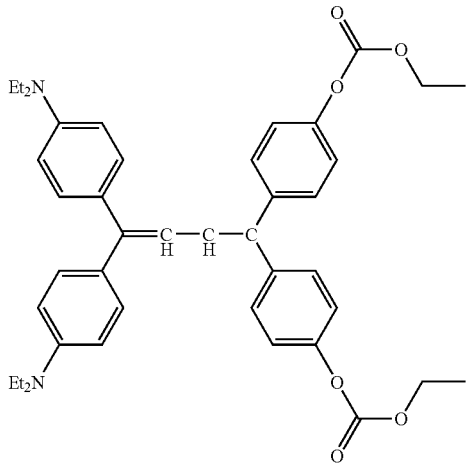
IV-40
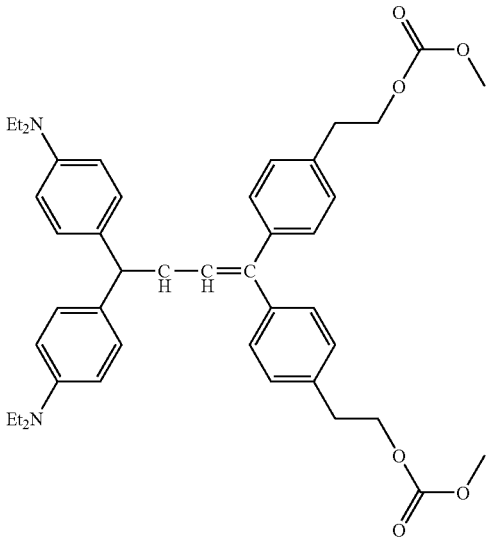
IV-41
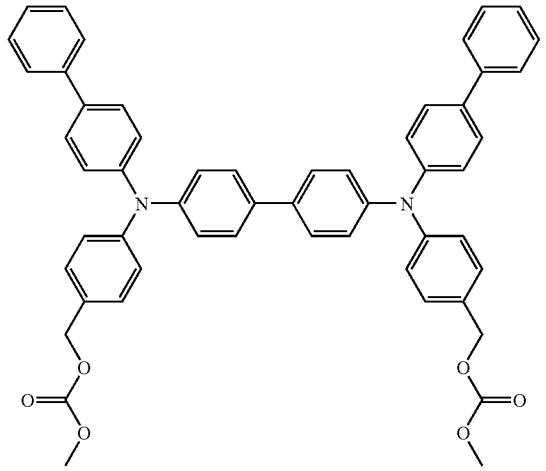
IV-42
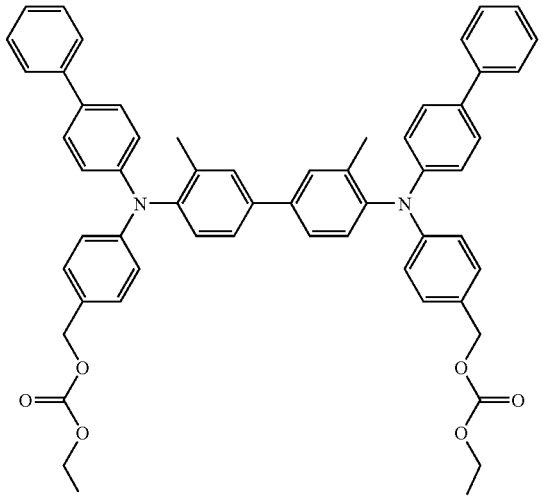

-continued
IV-43
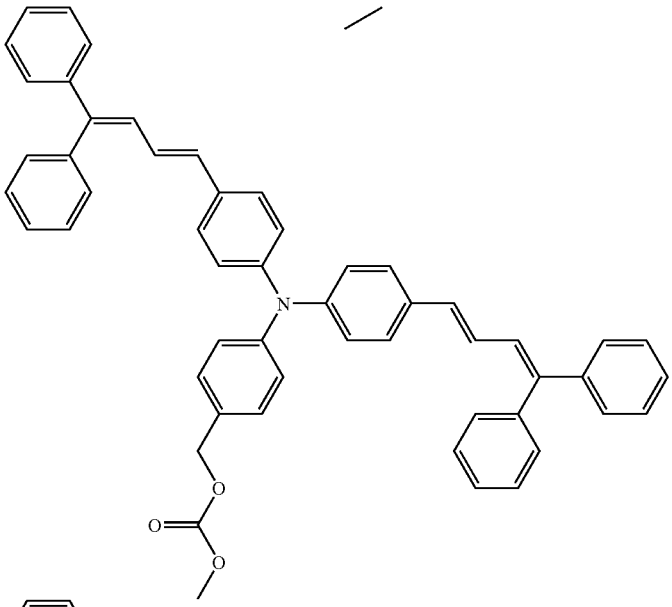
IV-44
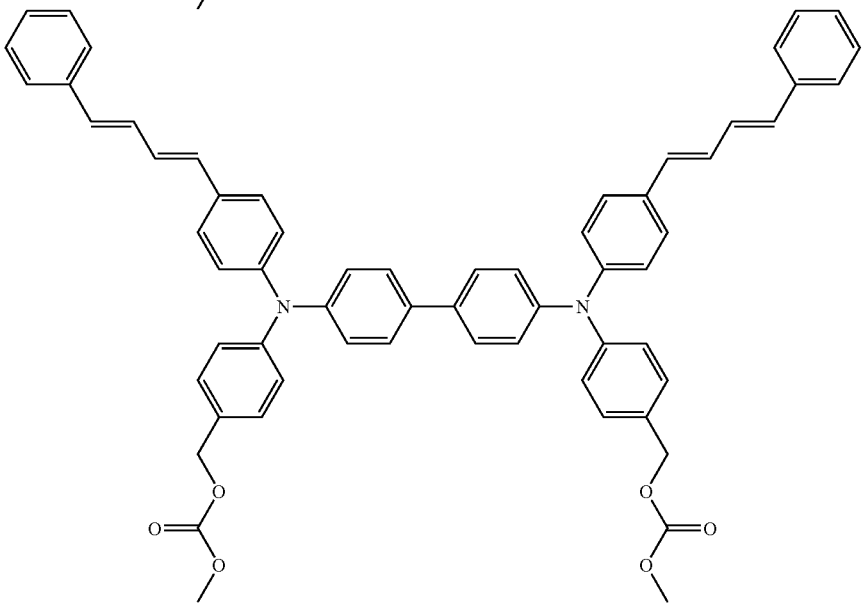
IV-45
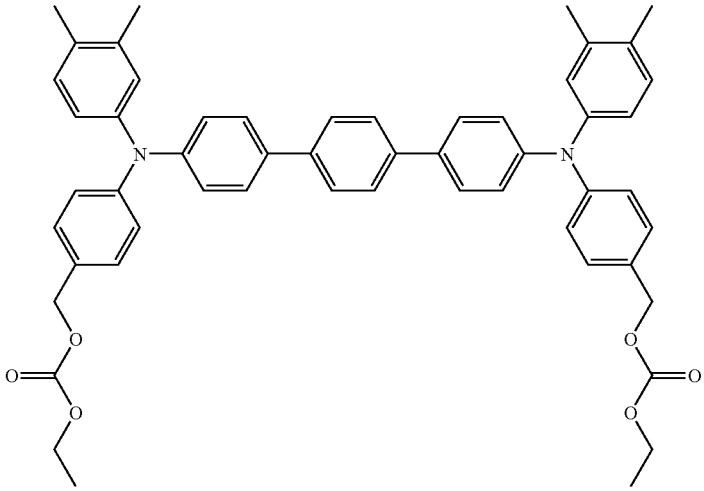

-continued
IV-46
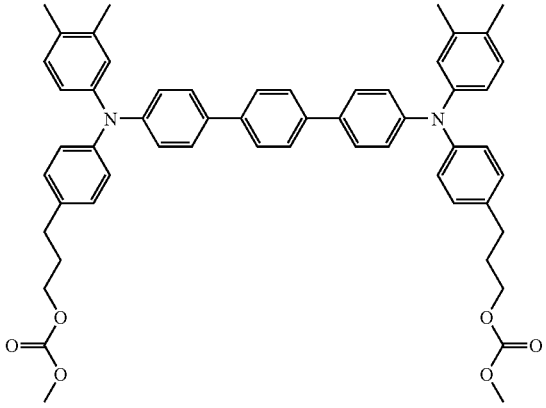
IV-47
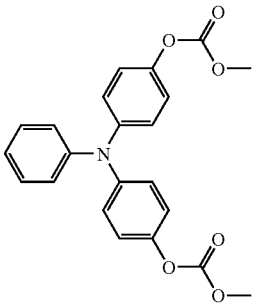
IV-48
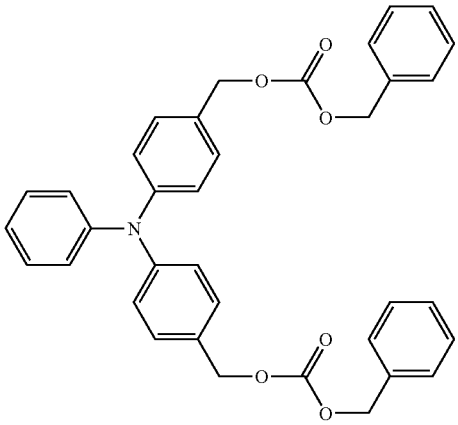
IV-49
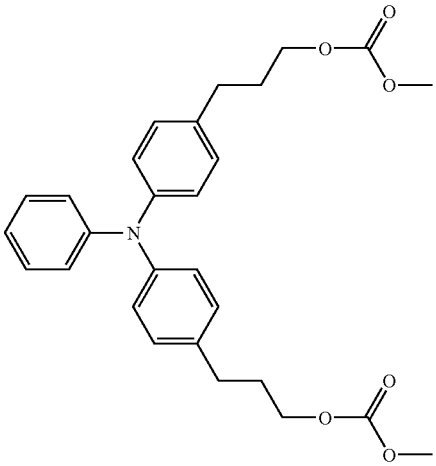
IV-50
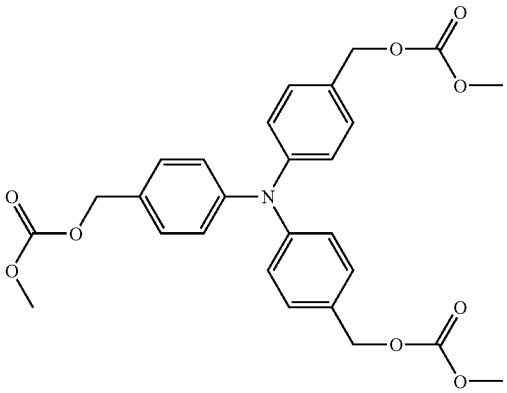
IV-51
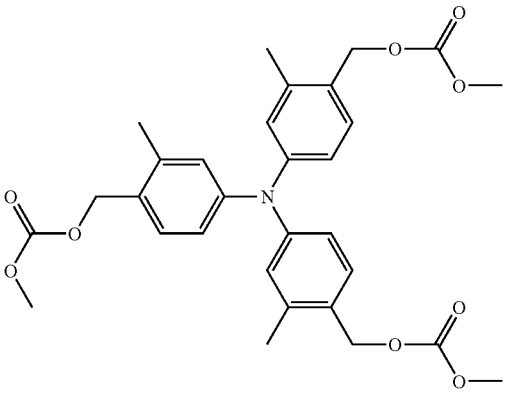

-continued
IV-52
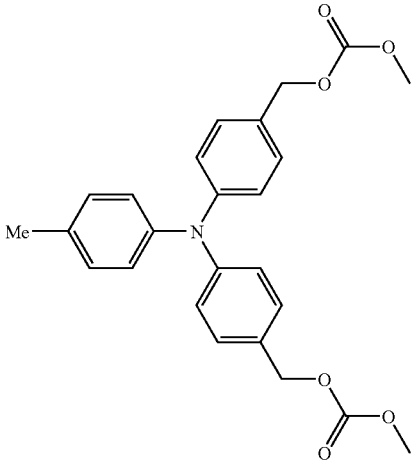
IV-53
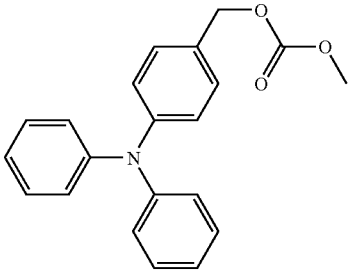
IV-54
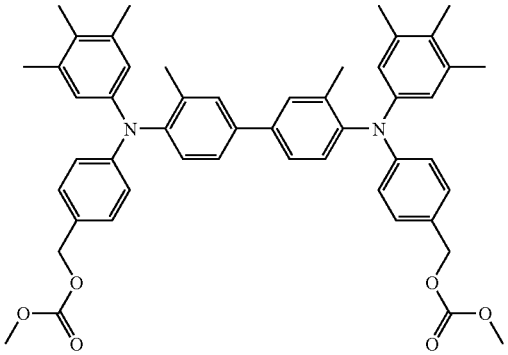
IV-55
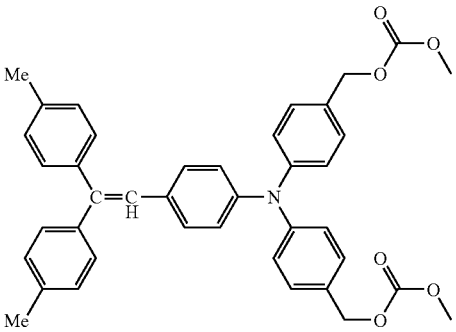
Specific examples of the compounds represented by Formula (V) above include the compounds represented by the following formulae (V-1) to (V-17). In the following, Me represents a methyl group and Et represents an ethyl group.
V-1
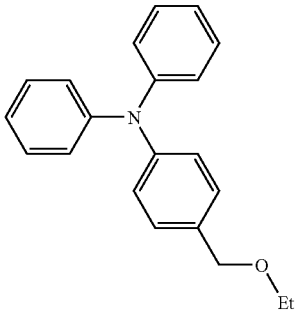
V-2
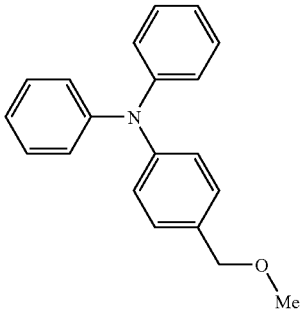
-continued
V-3
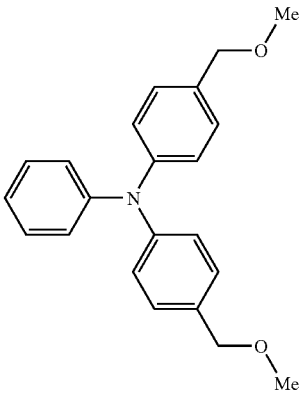
V-4
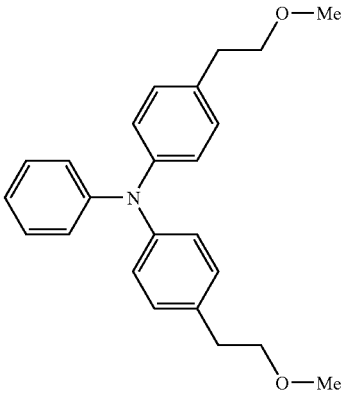

-continued
V-5
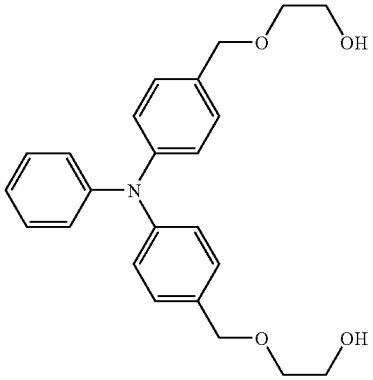
V-6
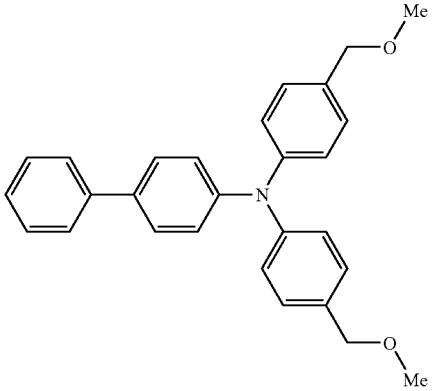
V-7
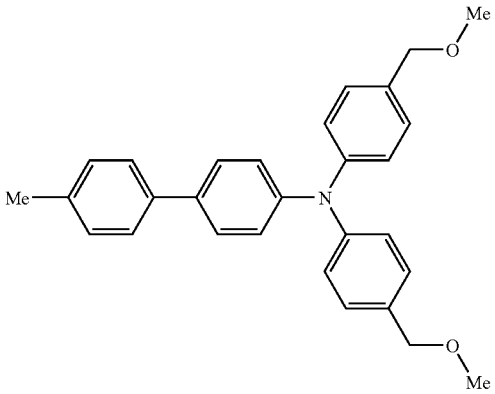
V-8
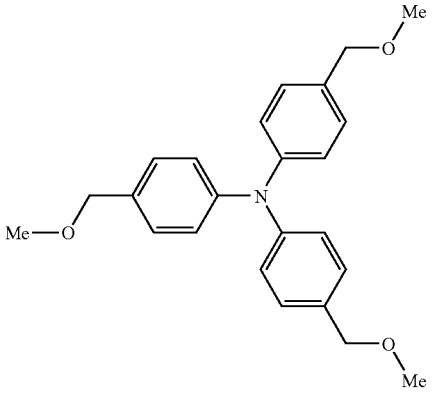
-continued
V-9
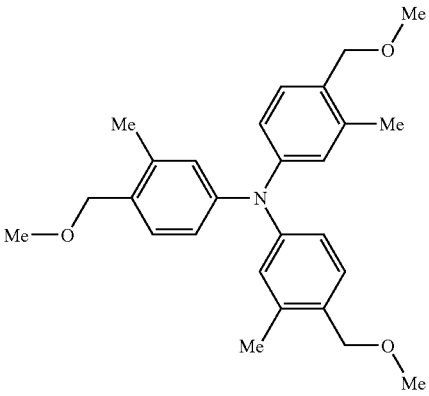
V-10
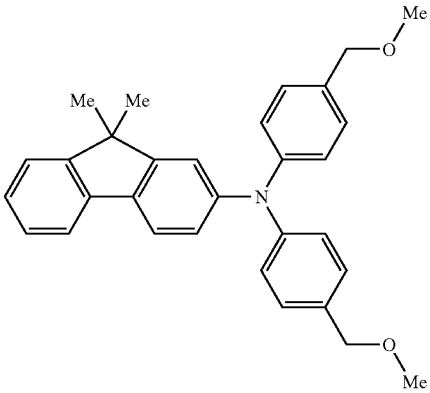
V-11
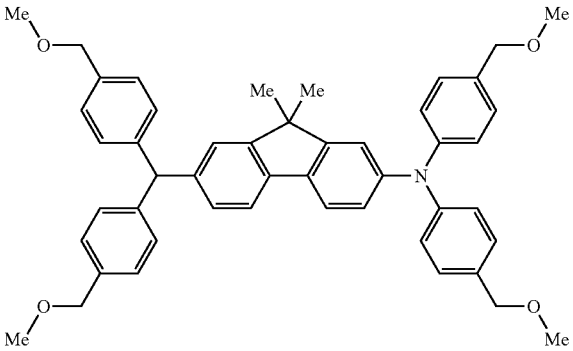
V-12
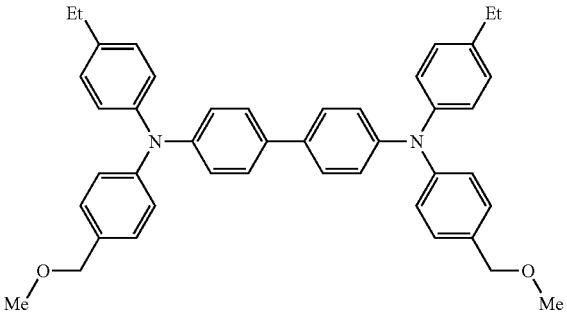

-continued

V-13

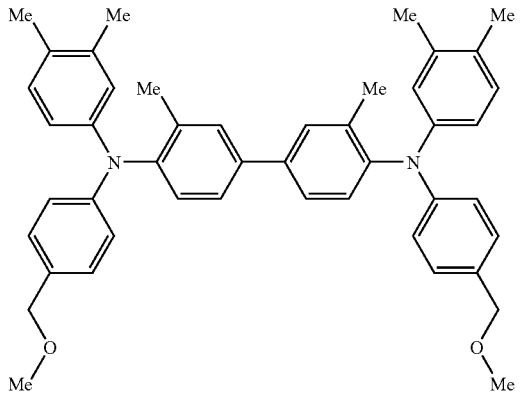

V-14

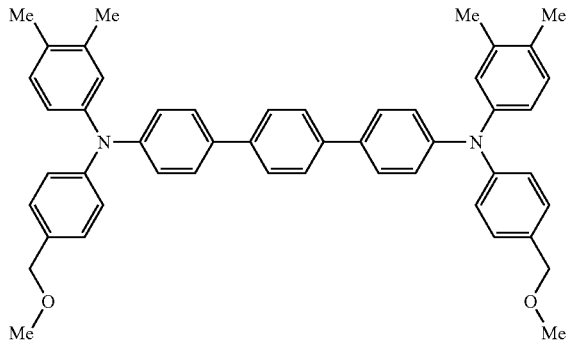

V-15

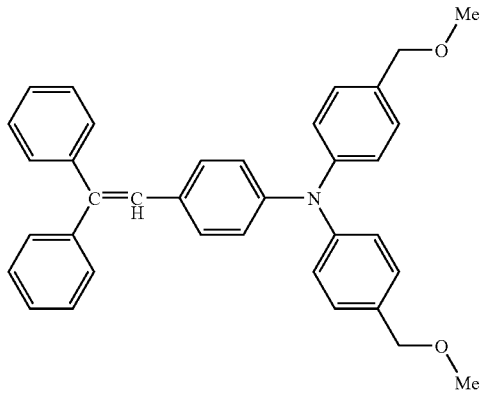

V-16

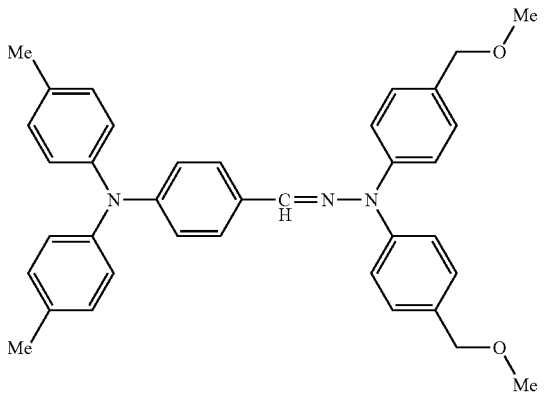

-continued

V-17

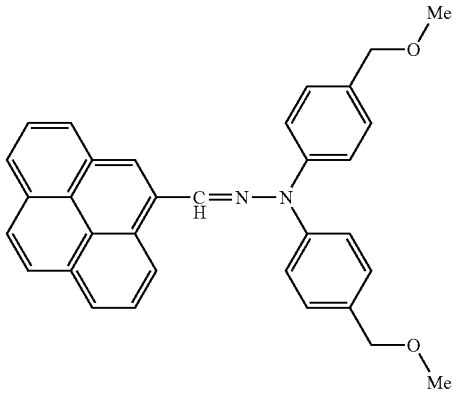

In addition to the components above, the protective layer 7 preferably contains conductive inorganic particles additionally for improvement in electrical properties.

The conductive inorganic particles are made of a metal, a metal oxide, carbon black, or the like. Examples of the metals include aluminum, zinc, copper, chromium, nickel, silver and stainless steel, as well as plastic particles carrying the metal vapor-deposited on the surface, and the like. Examples of the metal oxides include zinc oxide, titanium oxide, tin oxide, antimony oxide, indium oxide, bismuth oxide, tin-doped indium oxide, antimony- or tantalum-doped tin oxide, antimony-doped zirconium oxide, and the like. These compounds may be used alone or in combination of two or more. When used in combination of two or more, the compounds may be simply mixed or used in the form of solid or fused solution. The average diameter of the conductive particles for use in the invention is preferably 0.3 μm or less, more preferably 0.1 μm or less, from the point of transparency of the protective layer. In the invention, among the conductive inorganic particles described above, use of a metal oxide is particularly preferable from the point of transparency. The particle is preferably surface-treated, for example, for control of dispersion. Examples of the processing agents include silane-coupling agents, silicone oils, siloxane compounds, surfactants, and the like. The agent preferably contains fluorine atoms.

A compound represented by the following Formula (XIV) may be added to the protective layer 7, for the purpose of controlling various physical properties such as strength and film resistance of the protective layer 7.

$$Si(R^{50})_{(4-c)}Q_c \qquad \text{(XIV)}$$

In Formula (XIV) above, $R^{50}$ represents a hydrogen atom, an alkyl group or a substituted or unsubstituted aryl group; Q represents a hydrolyzable group; and c is an integer of 1 to 4.

Typical examples of the compounds represented by the Formula (XIV) include the following silane-coupling agents. Examples of the silane-coupling agents include tetrafunctional alkoxysilane (c=4) such as tetramethoxysilane and tetraethoxysilane; trifunctional alkoxysilanes (c=3) such as methyltrimethoxysilane, methyltriethoxysilane, ethyltrimethoxysilane, methyltrimethoxyethoxysilane, vinyltrimethoxysilane, vinyltriethoxyslane, phenyltrimethoxysilane, γ-glycidoxypropylmethyldiethoxysilane, γ-glycidoxypropyltrimethoxysilane, γ-glycidoxypropyltrimethoxysilane, γ-aminopropyltriethoxysilane, γ-aminopropyltrimetlioxysilane, γ-aminopropylmethyldimethoxysilane, N-β-(aminoethyl)-γ-aminopropyltriethoxysilane, (tridecafluoro-1,1,2,2-tetrahydrooctyl)triethoxysilane, (3,3,3-trifluoropropyl)trimethoxysilane, 3-(heptafluoroisopropoxy)propyltriethoxysilane, 1H,1H,2H,2H-perfluoroalkyltriethoxysilane, 1H,1H,2H,2H-perfluorodecyltriethoxysilane, and 1H,1H,2H,2H-perfluorooctyltriethoxysilane; bifunctional alkoxysilanes (c=2) such as dimethyldimethoxysilane, diphenyldimethoxysilane, and metlylphenyldimethoxysilane; monofunctional alkoxysilanes (c=1) such as trimethylmethoxysilane; and the like. In order to improve film strength, tri- and tetra-functional alkoxysilanes are favorably used, and in order to improve flexibility and film-forming property, mono- and bi-functional alkoxysilanes are favorably used.

Silicone-based hard coating agents, which are prepared mainly from these coupling agents, may also be used. Commercially available hard coating agents favorably used include KP-85, X-40-9740, and X-40-2239 (manufactured by Shin-Etsu Silicones), AY42-440, AY42-441, and AY49-208 (manufactured by Dow Corning Toray Silicone Co., Ltd.), and the like.

A compound having two or more silicon atoms represented by the following Formula (XV) is also favorably used in protective layer 7, for the purpose of improving the strength of protective layer 7.

$$B—(Si(R^{51})_{(3-d)}Q_d)_2 \quad (XV)$$

In Formula (XI) above, B represents a bivalent organic group; $R^{51}$ represents a hydrogen atom, an alkyl group or a substituted or unsubstituted aryl group; Q represents a hydrolyzable group; and d is an integer of 1 to 3.

More specific favorable examples of the compounds represented by Formula (XV) above include the following compounds (XV-1) to (XV-16).

$(MeO)_3Si—(CH_2)_2—Si(OMe)_3$ XV-1

$(MeO)_2MeSi—(CH_2)_2—SiMe(OMe)_2$ XV-2

$(MeO)_2MeSi—(CH_2)_6—SiMe(OMe)_2$ XV-3

$(MeO)_3Si—(CH_2)_6—Si(OMe)_3$ XV-4

$(EtO)_3Si—(CH_2)_6—Si(OEt)_3$ XV-5

$(MeO)_2MeSi—(CH_2)_{10}—SiMe(OMe)_2$ XV-6

$(MeO)_3Si—(CH_2)_3—NH—(CH_2)_3—Si(OMe)_3$ XV-7

$(MeO)_3Si—(CH_2)_3—NH—(CH_2)_2—NH—CH_2)_3—Si(OMe)_3$ XV-8

XV-9

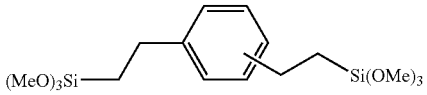

XV-10

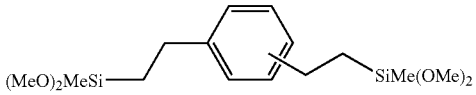

XV-11

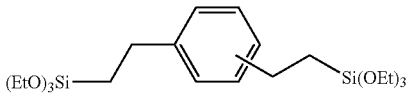

-continued

XV-12

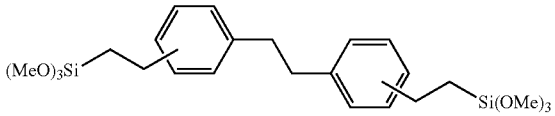

XV-13

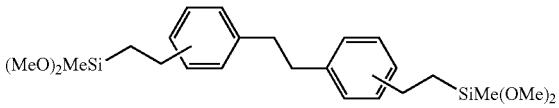

XV-14

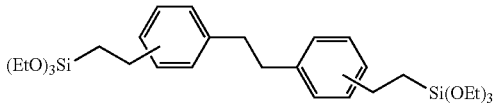

$(MeO)_3SiC_3H_6—O—CH_2CH—[O—C_3H_6Si(OMe)_3]—CH_2—[O—C_3H_6Si(OMe)_3]$ XV-15

$(MeO)_3SiC_2H_4—SiMe_2-O—SiMe_2-O—SiMe_2-C_2H_4Si(OMe)_3$ XV-16

In addition, various resins may be added to the protective layer 7 for the purpose of, for example, improving discharge gas resistance, mechanical strength, scuff resistance, particle dispersibility, viscosity control, and torque reduction, and also of controlling abrasion amount and elongating the pot life. In the present exemplary embodiments, an alcohol-soluble resin is preferably used in addition.

Examples of the alcoholic solvent-soluble resins include polyvinylbutyral resins, polyvinylformal resins, polyvinylacetal resins such as partially acetal-modified polyvinylacetal resins in which some of the butyral groups are modified with methylal or acetoacetal (such as S-LEC B and K, manufactured by Sekisui Chemical Co. Ltd.), polyamide resins, cellulosic resins, and the like. Polyvinylacetal resins are particularly favorable from the viewpoint of improvement in electrical properties.

The weight-average molecular weight of the above resins is preferably 2,000 to 100,000, more preferably 5,000 to 50,000. When the weight-average molecular weight is less than 2,000, desired effects may not be obtained, and when more than 100,000, the degree of solubility may be lowered and addition amount thereof may be limited, or coating defects may be caused during coating. The addition amount of the above resin is preferably 1 wt % to 40 wt %, more preferably 1 wt % to 30 wt %, and most preferably 5 wt % to 20 wt %. When the addition amount is less than 1 wt %, desired effects may not be obtained, and when the addition amount is more than 40 wt %, image blurring may become easier to occur under high temperature and high humidity (e.g., 28° C. and 80% RH). These resins may be used alone or in combination.

A cyclic compound having the repeating structural unit represented by the following Formula (XVI) or a derivative thereof is preferably used in the protective layer 7, for the purpose of extending the pot life of the protective layer forming solution and controlling the film characteristics.

(XVI)

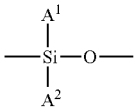

In Formula (XVI) above, $A^1$ and $A^2$ each independently represent a monovalent organic group.

The cyclic compounds having the repeating structural unit represented by Formula (XVI) may include commercially available cyclic siloxanes. Typical examples thereof include cyclic dimethylcyclosiloxanes such as hexamethylcyclotrisiloxane, octamethylcyclotetrasiloxane, decamethylcyclopentasiloxane, and dodecamethylcyclohexasiloxane; cyclic methylphenylcyclosiloxanes such as 1,3,5-trimethyl-1,3,5-triphenylcyclotrisiloxane, 1,3,5,7-tetramethyl-1,3,5,7-tetraphenylcyclotetrasiloxane, and 1,3,5,7,9-pentamethyl-1,3,5,7,9-pentaphenylcyclopentasiloxane; cyclic phenylcyclosiloxanes such as hexaphenylcyclotrisiloxane; fluorine atom containing cyclosiloxanes such as 3-(3,3,3-trifluoropropyl)methylcyclotrisiloxane; hydrosilyl group-containing cyclosiloxanes such as a methylhydrosiloxane mixture, pentamethylcyclopentasiloxane, and phenylhydrocyclosiloxane; vinyl group-containing cyclosiloxanes such as pentavinylpentamethylcyclopentasiloxane, and the like. These cyclic siloxane compounds may be used alone or in combination of two or more.

Further, various particles may be added to the protective layer 7, for the purpose of controlling the anti-staining property, lubricity, and hardness of the electrophotographic photoreceptor surface. These particles may be used alone or in combination of two or more.

An example of the above particles is silicon atom containing particles. The silicon atom containing particles are particles containing silicon as a component element, and typical examples thereof include colloidal silica, silicone particles, and the like. The colloidal silica used as the silicon atom containing particles preferably has a volume-average particle diameter of 1 nm to 100 nm, more preferably 10 nm to 30 nm, and is dispersed in an acidic or alkaline aqueous medium or in an organic solvent such as alcohol, ketone, and ester. The colloidal silica may be a commercially available product. The solid matter content of colloidal silica in the curable resin composition is not particularly limited, but is preferably in the range of 0.1 wt % to 50 wt %, more preferably in the range of 0.1 wt % to 30 wt % with respect to the total solid matter content in the curable resin composition, form the viewpoints of film forming property, electrical properties, and strength.

The silicone particles used as the silicon atom containing particles have a spherical shape and a volume-average particle diameter of preferably 1 nm to 500 nm, more preferably 10 nm to 100 nm, and are selected from silicone resin particles, silicone rubber particles and silicone-surface-treated silica particles. Commercially available products may be used as the silicone particles.

The silicone particles are fine particles that are chemically inactive and have a superior dispersibility into a resin, and because of a small content thereof necessary for obtaining favorable characteristics, surface conditions of an electrophotographic photoreceptor can be improved without inhibiting crosslinking reaction. Therefore, the silicone particles, being uniformly contained in a strong crosslinked structure, improve the lubricity and water repellency of the surface of the electrophotographic photoreceptor, and provide favorable abrasion resistance and anti-staining resistance over an extended period of time. The content of the silicone particles in the curable resin composition is preferably in the range of 0.1 wt % to 30 wt %, and more preferably in the range of 0.5 wt % to 10 wt %, with respect to the total solid matter in the curable resin composition.

Examples of the other particles include fluorine-based particles such as those of tetrafluoroethylene, trifluoroethylene, hexafluoropropylene, vinyl fluoride, and vinylidene fluoride; particles of a resin obtained by copolymerizing a fluorocarbon resin and a monomer containing a hydroxyl group, such as those described on page 89 of "Preprint for the 8th Polymer Material Forum"; and semiconductive metal oxides such as $ZnO—Al_2O_3$, $SnO_2—Sb_2O_3$, $In_2O_3—SnO_2$, $ZnO—TiO_2$, $MgO—Al_2O_3$, $FeO—TiO_2$, $TiO_2$, $SnO_2$, $In_2O_3$, ZnO, and MgO; and the like.

In addition, an oil such as silicone oil may also be added, for the similar purposes to that of the aforementioned particles. Examples of the silicone oils include silicone oils such as dimethylpolysiloxane, diphenylpolysiloxane, and phenylmethylsiloxane; reactive silicone oils such as amino-modified polysiloxanes, epoxy-modified polysiloxanes, carboxyl-modified polysiloxanes, carbinol-modified polysiloxanes, methacryl-modified polysiloxanes, mercapto-modified polysiloxanes, and phenol-modified polysiloxanes; and the like. The oil may be added to the protective layer forming solution, or impregnated into the photoreceptor under reduced pressure or under pressure, after the preparation of the photoreceptor.

In addition, additives such as a plasticizer, surface modifier, antioxidant, and photodegradation inhibitor may be added to the protective layer 7. Examples of the plasticizers include biphenyl, biphenyl chloride, terphenyl, dibutyl phthalate, diethylene glycol phthalate, dioctyl phthalate, triphenylphosphoric acid, methylnaphthalene, benzophenone, chlorinated paraffins, polypropylene, polystyrene, various fluorohydrocarbons, and the like.

An antioxidant such as those having a partial structure of hindered phenol, hindered amine, thioether or phosphite may be added to the protective layer 7, which is effective in improving stability in electric potential and image quality under environment changes.

Examples of the antioxidants include the following compounds: hindered phenol-based antioxidants such as "Sumilizer BHT-R", "Sumilizer MDP-S", "Sumilizer BBM-S", "Sumilizer WX-R", "Sumilizer NW", "Sumilizer BP-76", "Sumilizer BP-101", "Sumilizer GA-80", "Sumilizer GM", and "Sumilizer GS", manufactured by Sumitomo Chemicals; "IRGANOX 1010", "IRGANOX 1035", "IRGANOX 1076", "IRGANOX 1098", "IRGANOX 1135", "IRGANOX 1141", "IRGANOX 1222", "IRGANOX 1330", "IRGANOX 1425WL", "IRGANOX 1520L", "IRGANOX 245", "IRGANOX 259", "IRGANOX 3114", "IRGANOX 3790", "IRGANOX 5057", and "IRGANOX 565" manufactured by Ciba Specialty Chemical; "Adeca Stab AO-20", "Adeca Stab AO-30", "Adeca Stab AO-40", "Adeca Stab AO-50", "Adeca Stab AO-60", "Adeca Stab AO-70", "Adeca Stab AO-80", and "Adeca Stab AO-330" manufactured by ADEKA Corporation; hindered amine-based antioxidants such as "Sanol LS2626", "Sanol LS765", "Sanol LS770", and "Sanol LS744" manufactured by Sankyo LifeTech Co., Ltd; "Tinuvin 144" and "Tinuvin 622LD" manufactured by Ciba Specialty Chemicals; "MARK LA57", "MARK LA67", "MARK LA62", "MARK LA68", and "MARK LA63" manufactured by ADEKA Corporation: and "Sumilizer TPS" manufactured by Sumitomo Chemical Co., Ltd.; thioether-based antioxidants such as "Sumilizer TP-D" manufactured by Sumitomo Chemical Co., Ltd.; and phosphite-based antioxidants such as "MARK 2112", "MARK PEP.8", "MARK PEP.24G", "MARK PEP.36", "MARK 329K", and "MARK HP.10" manufactured by ADEKA Corporation.

Among the above, hindered phenol- and hindered amine-based antioxidants are particularly favorable. These antioxidants may be modified by a substituent that is crosslinkable with the crosslinked film-forming material, such as alkoxysilyl.

In addition, the protective layer 7 may contain an insulating resin such as polyvinylbutyral resins, polyarylate resins (e.g., polymers of bisphenol A and phthalic acid), polycarbonate resins, polyester resins, vinyl chloride-vinyl acetate copolymers, polyamide resins, acrylic resins, polyacrylamide resins, polyvinylpyridine resins, cellulosic resins, urethane resins, casein, polyvinylalcohol resins, and polyvinylpyrrolidone resins. In such a case, the insulating resin may be added at an appropriate rate, and addition thereof is effective in improving adhesiveness between the protective layer and the charge transporting layer 6, and reducing the film defects caused by heat shrinkage, cissing and the like. The "insulating" here refers to a situation where a volume resistivity is $10^{13}$ Ωcm or more.

The protective layer 7 described above is prepared by applying a protective layer forming solution containing the components described above, for example, onto a lower layer (charge transporting layer 6 in the present exemplary embodiment), and hardening the film by polymerization or crosslinking with heat or acid, as needed.

Various solvents including alcohols such as methanol, ethanol, propanol, and butanol; ketones such as acetone and methylethylketone; ethers such as tetrahydrofuran, diethylether, and dioxane, and others may be used as needed in the protective layer forming solution. In the case of applying a dip coating method, which is commonly practiced in preparation of an electrophotographic photoreceptor, use of an alcoholic solvent, ketone solvent, or a mixture solvent thereof is desirable. The boiling point of the solvent for use is desirably 50° C. to 150° C., and such solvents may be used as mixed at an arbitrary rate.

Since an alcoholic solvent, ketone solvent, and a mixture solvent are desirable as the solvent, as mentioned above, the charge transporting material used in preparation of the protective layer 7 is preferably soluble in such solvents.

The amount of the solvent may be set as appropriate, but when the amount of the solvent is too small, precipitation of the components tends to occur. Therefore, the amount of the solvent is preferably 0.5 part by weight to 30 parts by weight, more preferably 1 part by weight to 20 parts by weight, with respect to 1 part by weight of the total solid matter contained in the protective layer forming solution.

Any common methods such as blade coating, wire bar coating, spray coating, dip coating, bead coating, air knife coating, or curtain coating may be used in forming the protective layer 7 by using the protective layer forming solution. If it is not possible to obtain a desirable film thickness by a single coating step, a film with a desirable thickness may be obtained by repeating application of the coating solution. When the application of the solution is carried out multiple times, the heat treatment may be performed each time after coating, or may be performed at once after the multiple times of coating.

A catalyst may be added to the protective layer forming solution at the time of preparing the solution. Examples of the catalysts include inorganic acids such as hydrochloric acid, acetic acid, and sulfuric acid; organic acids such as formic acid, propionic acid, oxalic acid, benzoic acid, phthalic acid, and maleic acid; alkali catalysts such as potassium hydroxide, sodium hydroxide, calcium hydroxide, ammonia, and triethylamine; and insoluble solid catalysts such as those shown below.

Examples of the insoluble solid catalysts include cation-exchange resins such as Amberlite 15, Amberlite 200C, and Amberlyst 15E (manufactured by Rohm and Haas Company), Dowex MWC-1-H, Dowex 88, and Dowex HCR-W2 (manufactured by the Dow Chemical Company), Lewatit SPC-108 and Lewatit SPC-118 (manufactured by Bayer). Diaion RCP-150H (manufactured by Mitsubishi Chemical Corp.), Sumikaion KC-470, Duolite C26-C, Duolite C-433, and Duolite-464 (manufactured by Sumitomo Chemical Co., Ltd.), and Nafion H (manufactured by E.I. du Pont de Nemours and Company); anion-exchange resins such as Amberlite IRA-400 and Amberlite IRA-45 (manufactured by Rohm and Haas Company); inorganic solids having a protonic acid group-containing group bound to the surface thereof, such as $Zr(O_3PCH_2CH_2SO_3H)_2$ and $Th(O_3PCH_2CH_2COOH)_2$; protonic acid-containing polyorganosiloxanes such as a sulfonic acid-containing polyorganosiloxane; heteropolyacids such as cobalttungstic acid and phosphomolybdenic acid; isopolyacids such as niobic acid, tantalic acid, and molybdenic acid; single metal oxides such as silica gel, alumina, chromia, zirconia, CaO, and MgO; composite metal oxides such as silica-alumina, silica-magnesia, silica-zirconia, and zeolite; clay minerals such as acidic clay, activated clay, montmorillonite, and kaolinite; metal sulfate salts such as $LiSO_4$ and $MgSO_4$; metal phosphate salts such as zirconia phosphate and lanthanum phosphate; metal nitrate salts such as $LiNO_3$ and $Mn(NO_3)_2$; inorganic solids having an amino group-containing group bound to the surface thereof, such as a solid obtained by reacting aminopropyltriethoxysilane with the surface of silica gel; amino group-containing polyorganosiloxanes such as an amino-modified silicone resin; and the like.

A solid catalyst that is insoluble in an medium such as an optically functional compound, reaction product, water, solvent and the like is preferably used in preparation of the protective layer forming solution, since it may lead to stabilization of the coating solution. The insoluble solid catalyst is not particularly limited, as long as the catalyst component is insoluble in a medium such as the aforementioned organic charge transporting compound having a reactive functional group, other additives, water, solvent, and the like.

The amount of such a solid catalyst that is insoluble in the system is not particularly limited, but is preferably 0.1 part by weight to 100 parts by weight with respect to 100 parts by weight of the organic charge transporting compound. The solid catalyst, which is insoluble in raw material compounds, reaction products, solvent and the like, as described above, can be easily separated after reaction by a common method.

The reaction temperature and the reaction time are appropriately determined according to the kinds and amounts of the raw material compounds and the solid catalyst used, but the reaction temperature is normally 0° C. to 100° C., preferably 10° C. to 70° C., and more preferably 15° C. to 50° C. The reaction time is preferably 10 minutes to 100 hours. When the reaction time exceeds the above upper limit, gel formation may be easily caused.

When an catalyst that is insoluble in the system is used in preparation of the protective layer forming solution, a catalyst that is soluble in the system is preferably used in combination, for example, for improvement in strength and liquid storage stability. Examples of these catalysts include, in addition to those described above, organic aluminum compounds such as aluminum triethylate, aluminum triisopropylate, aluminum tri(sec-butyrate), mono(sec-butoxy)aluminum diisopropylate, diisopropoxyaluminum(ethylacetoacetate), aluminum tris(ethylacetoacetate), aluminum bis(ethylacetoacetate) monoacetylacetonate, aluminum tris(acetylacetonate), aluminum diisopropoxy(acetylacetonate), aluminum isopropoxy-bis(acetylacetonate), aluminum tris (trifluoroacetylacetonate), and aluminum tris (hexafluoroacetylacetonate).

Favorable catalysts other than the organic aluminum compounds include organic tin compounds such as dibutyltin dilaurate, dibutyltin dioctylate, and dibutyltin diacetate; organic titanium compounds such as titanium tetrakis(acetylacetonate), titanium bis(butoxy)bis(acetylacetonate), and titanium bis(isopropoxy)bis(acetylacetonate); zirconium compounds such as zirconium tetrakis(acetylacetonate), zirconium bis(butoxy)bis(acetylacetonate), and zirconium bis (isopropoxy)bis(acetylacetonate); and the like. However, an organic aluminum compound is favorably used, and an aluminum chelate compound is particularly favorably used, from the viewpoints of stability, cost, and pot life.

The amount of the catalyst soluble in the system is not particularly limited, but is preferably 0.1 part by weight to 20 parts by weight, particularly preferably 0.3 part by weight to 10 parts by weight, with respect to 100 parts by weight of the organic charge transporting compound having a reactive functional group.

When an organic metal compound is used as the catalyst in forming the protective layer 7 by using the protective layer forming solution, a multidentate ligand is favorably added from the viewpoints of pot life and hardening efficiency. Examples of the multidentate ligands include, but are not limited to, those shown below and the derivatives thereof: bidentate ligands including β-diketones such as acetylacetone, trifluoroacetylacetone, hexafluoroacetylacetone and dipivaloylmethyl acetone, acetoacetate esters such as methyl acetoacetate and ethyl acetoacetate, bipyridine and the derivatives thereof, glycine and the derivatives thereof, ethylenediamine and the derivatives thereof, 8-oxyquinoline and the derivatives thereof, salicylic aldehyde and the derivatives thereof, catechol and the derivatives thereof and 2-oxyazo compounds; tridentate ligands including diethyl triamine and the derivatives thereof, and nitrilotriacetate and the derivatives thereof, hexadentate ligands including ethylenediamine tetraacetic acid (EDTA) and the derivatives thereof, and the like. Examples other than the organic ligands above include inorganic ligands such as pyrophosphoric acid and triphosphoric acid. The multidentate ligand is particularly preferably a bidentate ligand, and typical examples thereof include the bidentate ligands above and those represented by the following Formula (XVII).

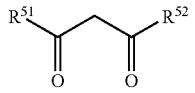

(XVII)

In Formula (XVII) above, $R^{51}$ and $R^{52}$ each independently represent an alkyl group having 1 to 10 carbon atoms, a fluoroalkyl group, or an alkoxy group having 1 to 10 carbon atoms.

The multidentate ligand is preferably a bidentate ligand represented by the above Formula (XVII), and particularly preferably the ligand represented by Formula (XVII) above in which $R^{51}$ and $R^{52}$ are the same groups. When the groups represented by $R^{51}$ and $R^{52}$ are the same, the ligand coordination force at around room temperature (e.g., 25° C.) can be strengthened and the curable resin composition can be further stabilized.

The blending rate of the multidentate ligand can be appropriately set, but is preferably 0.01 mole or more, more preferably 0.1 mole or more, and particularly preferably 1 mole or more, with respect to 1 mole of the organic metal compound used.

The reaction temperature and the reaction time for hardening the protective layer forming solution are not particularly limited, but the reaction temperature is preferably 60° C. or higher, and more preferably 80° C. to 200° C., and the reaction time is preferably 10 minutes to 5 hours, in view of the mechanical strength and chemical stability of the formed protective layer 7. It is also effective, in stabilizing the properties of the protective layer 7, to keep the protective layer 7 obtained by hardening the curable resin composition at high humidity. In addition, the protective layer 7 may be hydrophobilized by surface treatment, for example, by treating with hexamethyldisilazane or trimethylchlorosilane, depending on usage.

The thickness of the protective layer 7 is preferably 0.5 μm to 15 μm, more preferably 1 μm to 10 μm, and still more preferably 1 μm to 5 μm.

The aforementioned are favorable examples of the electrophotographic photoreceptor in the present exemplary embodiment, but the invention is not limited thereto. For example, the undercoat layer 4 may not be provided in the electrophotographic photoreceptor in another exemplary embodiment.

Figure 2:
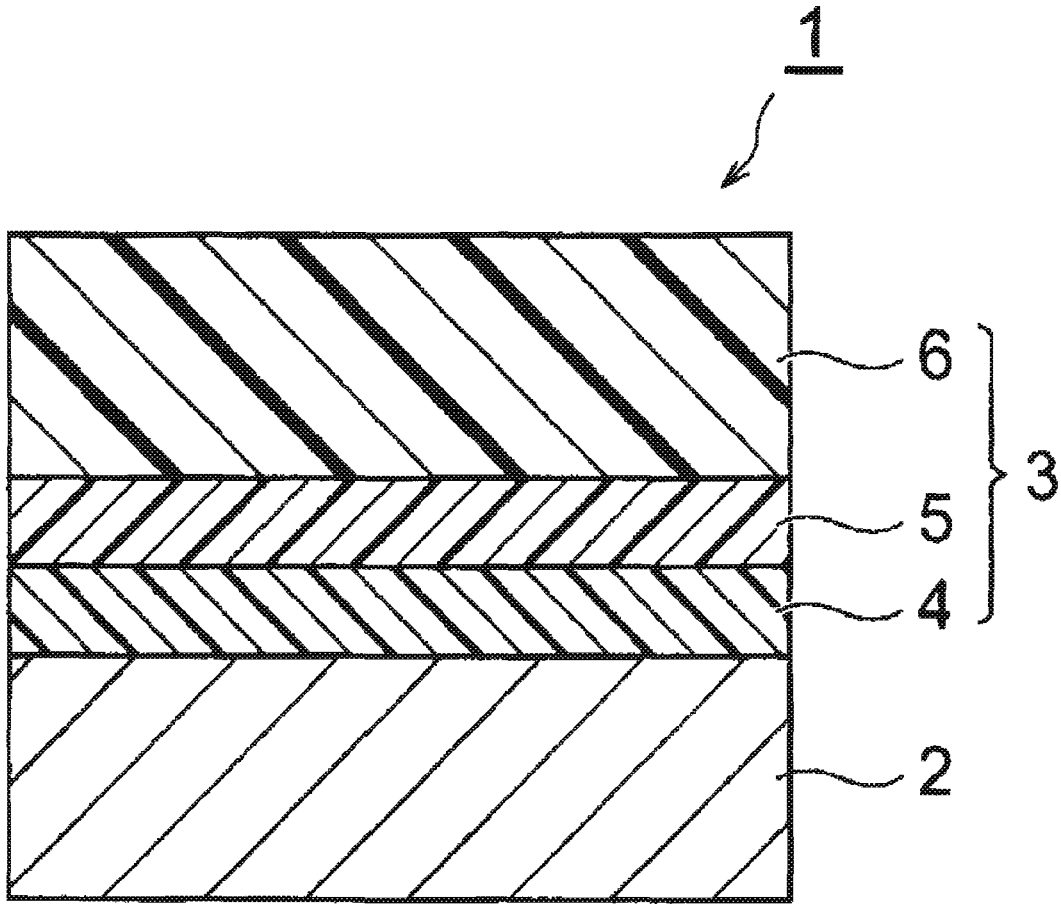
FIGS. 2 to 5 are schematic sectional views of other exemplary embodiments of the electrophotographic photoreceptor of the invention.

The electrophotographic photoreceptor 1 shown in FIG. 1 has the protective layer 7 of the cured product of a composition containing a curable resin, a fluorine atom containing surfactant, and at least one organic charge transporting compounds represented by any one of the aforementioned Formulae (I) to (V). This cured product, having superior mechanical strength and a high degree of photoelectric property, may also be used as it is as the charge transporting layer of a laminate-type photoreceptor. An example of the electrophotographic photoreceptor is shown in FIG. 2. The electrophotographic photoreceptor 1 shown in FIG. 2 has a structure consisting of a conductive support 2, onto which an undercoat layer 4, a charge generating layer 5 and a charge transporting layer 6 are sequentially laminated thereon, wherein the outmost layer composed of the cured product is the charge transporting layer 6. In FIG. 2, the undercoat layer 4 and the charge generating layer 5 formed on the conductive support 2 are the same as those in the electrophotographic photoreceptor shown in FIG. 1 (the same shall apply hereinafter).

Figure 3:
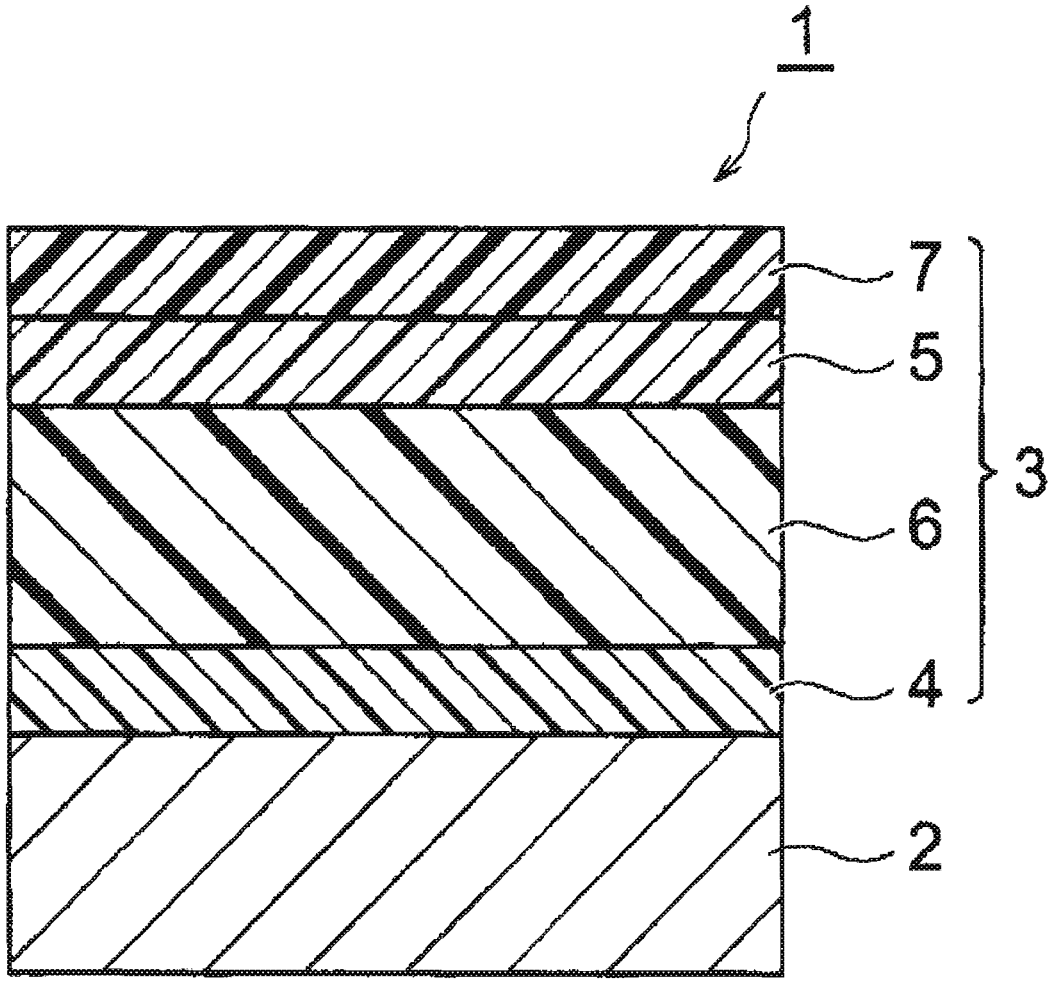

The lamination order of the charge generating layer 5 and the charge transporting layer 6 shown in the exemplary embodiment above may be in a reverse order. An example of such an electrophotographic photoreceptor is shown in FIG. 3. The electrophotographic photoreceptor 1 shown in FIG. 3 has a structure consisting of a conductive support 2, onto which an undercoat layer 4, a charge transporting layer 6, a charge generating layer 5 and a protective layer 7 are sequentially laminated, and the outmost layer composed of the cured product is the protective layer 7.

The electrophotographic photoreceptor 1, shown in FIG. 1 as a function separated-type photoreceptor, may also have a layer containing both of a charge generating substance and a charge transporting substance (charge generating/transporting layer; hereinafter, referred to as single-layer photosensitive layer). Examples of the electrophotographic photoreceptors having a single-layer photosensitive layer are shown in FIGS. 4 and 5.

Figure 4:
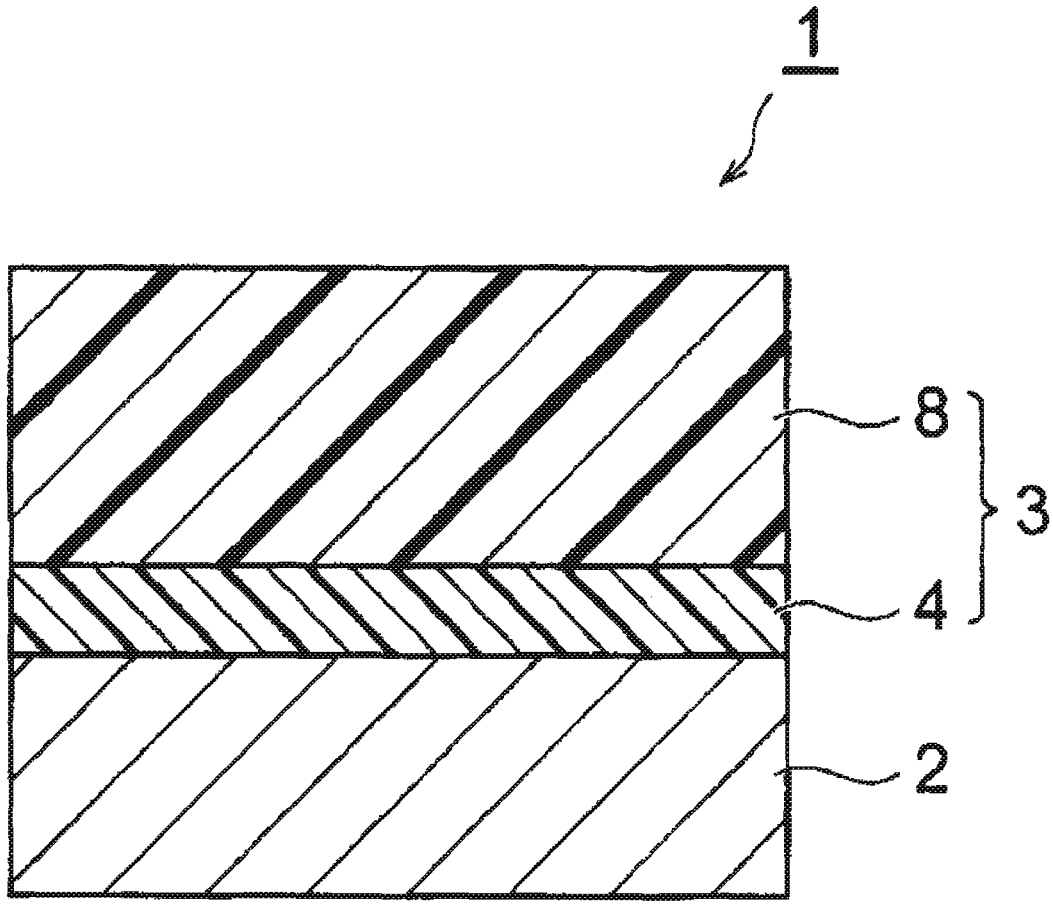

The electrophotographic photoreceptor 1 shown in FIG. 4 has a structure consisting of a conductive support 2, onto which an undercoat layer 4 and a single-layer photosensitive layer 8 are sequentially laminated, and the outmost layer composed of the cured product is the single-layer photosensitive layer 8. The single-layer photosensitive layer 8 can be prepared by using a coating solution containing, in addition to the configuration described in the protective layer 7, a charge generating substance, and as needed a binder resin other than the curable resin and other additives. Those used in the charge generating layer in the function separated-type photosensitive layer may be used as the charge generating substances. Examples of the binder resins other than the curable resins include polyvinylacetal resins such as polyvinylbutyral resins, polyvinylformal resins, and partially acetal-modified polyvinylacetal resins wherein part of the butyral groups are modified by formal, acetoacetal or the like (e.g., S-LEC B and K, manufactured by Sekisui Chemical Co., Ltd.), polyamide resins, cellulosic resins, and the like. The content of the charge generating substance in the single-layer photosensitive layer 8 is preferably 10 wt % to 85 wt %, and more preferably 20 wt % to 50 wt %, with respect to the total solid matter in the single-layer photosensitive layer 8. Other charge transporting materials and other polymer charge transporting materials may be added to the single-layer photosensitive layer 8, for improvement in photoelectric property and the like. The addition amount the above is preferably 5 wt % to 50 wt %, with respect to the total solid matter in the single-layer photosensitive layer 8. The solvent and the application method used in the coating process of the single-layer photosensitive layer 8 may be the same as those used in preparation of the aforementioned layers. The thickness of the single-layer photosensitive layer 8 is preferably about 5 μm to 50 μm, and more preferably about 10 μm to 40 μm.

Figure 5:
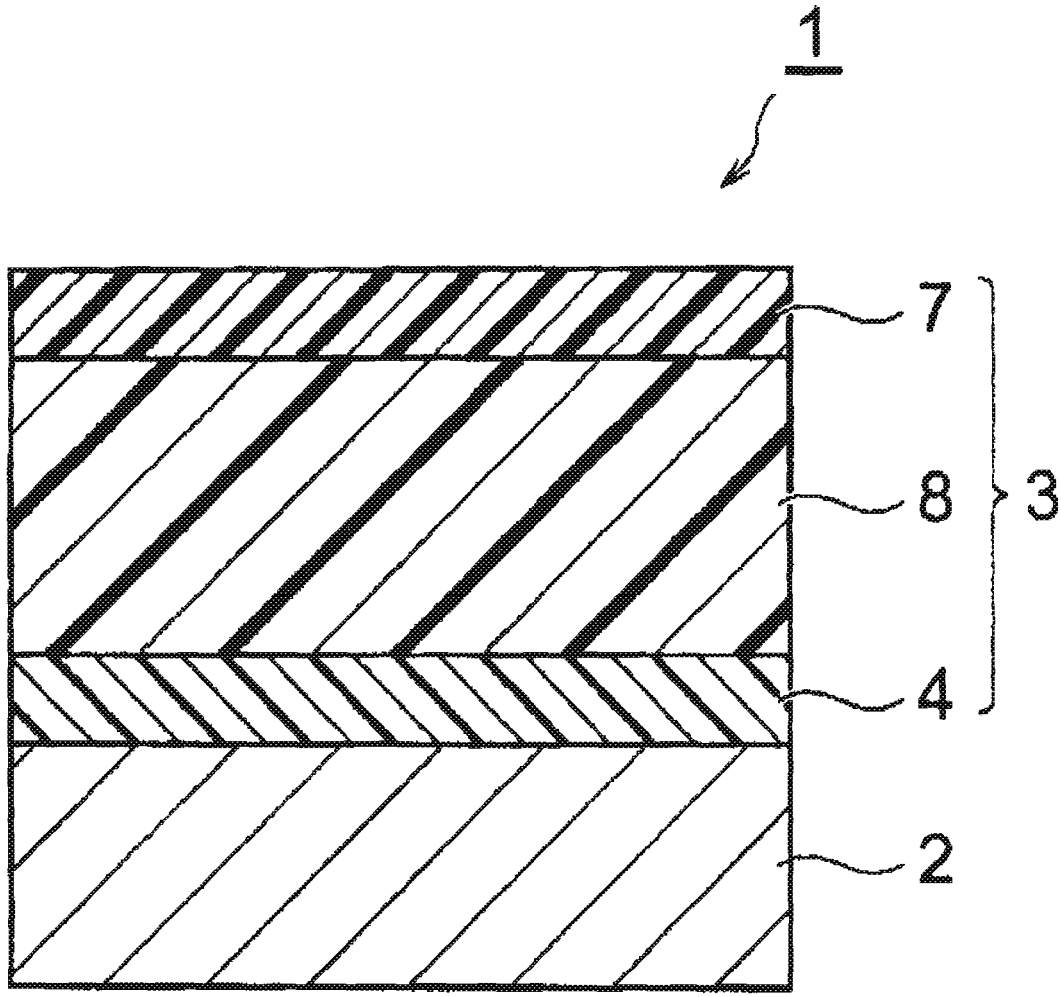

The electrophotographic photoreceptor 1 shown in FIG. 5 has a structure consisting of a conductive support 2, onto which an undercoat layer 4, a single-layer photosensitive layer 8 and a protective layer 7 are sequentially laminated, and the outermost layer composed of the cured product is the protective layer 7.

(Image Formation Apparatus and Process Cartridge)

Figure 6:
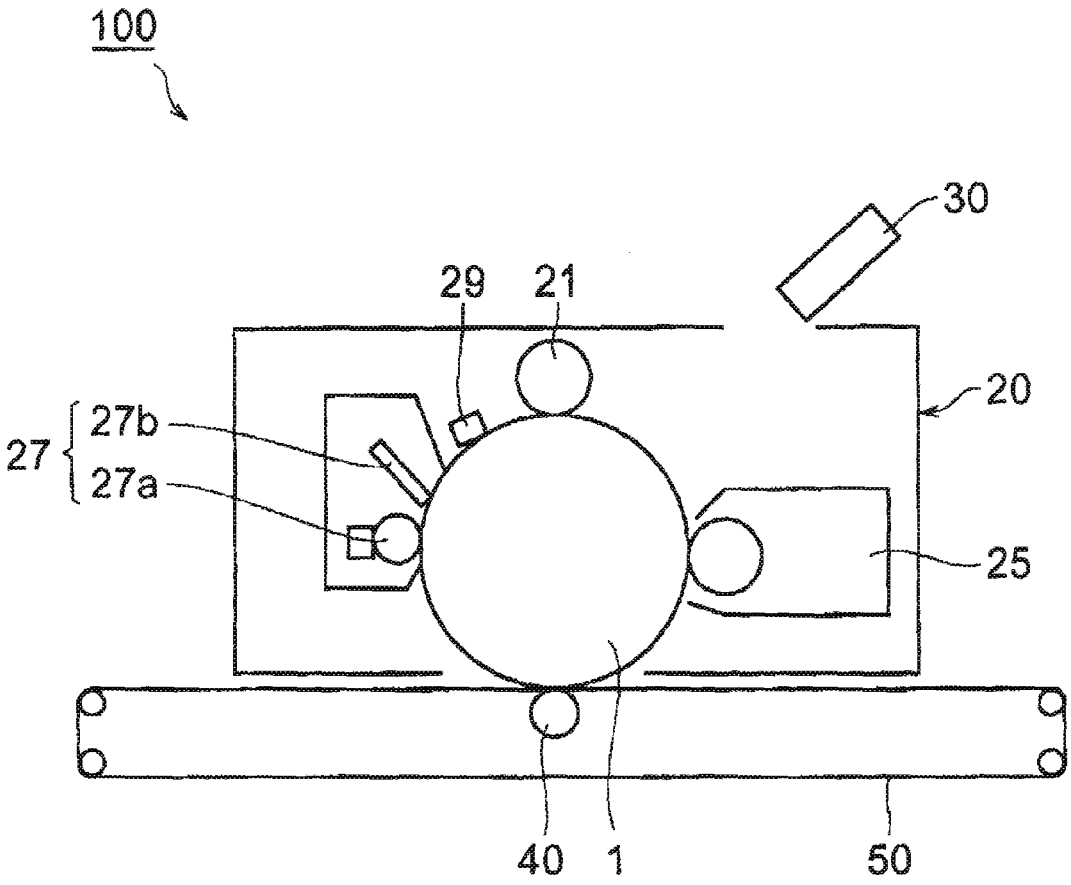
FIG. 6 is a schematic view of an exemplary embodiment of the electrophotographic photoreceptor of the invention.

FIG. 6 is a schematic view illustrating an image formation apparatus in the present exemplary embodiment. The image formation apparatus 100 shown in FIG. 6 has an image formation apparatus main body (not shown in the figure), and a process cartridge 20 containing an electrophotographic photoreceptor in the present exemplary embodiment 1 described above, a exposing unit 30, a transfer unit 40, and an intermediate transfer body 50. In the image formation apparatus 100, the exposing unit 30 is placed at a position at which the unit can irradiate the electrophotographic photoreceptor 1 from the opening of the process cartridge 20; and the transfer unit 40 is placed at a position at which the unit faces the electrophotographic photoreceptor 1 via the intermediate transfer body 50; and the intermediate transfer body 50 is placed such that at least a part thereof is in contact with the electrophotographic photoreceptor 1.

The process cartridge 20 is a combination of the electrophotographic photoreceptor 1 and also a charging unit 21, a developing unit 25, a cleaning unit 27 and a fibrous member (flat brush-shaped) 29 integrated in a case. The case enclosing the integrated unit has an opening for exposure.

The charging unit 21 charges the electrophotographic photoreceptor 1 by a contact method. The developing unit 25 develops an electrostatic latent image formed on the electrophotographic photoreceptor 1, and forms a toner image.

Hereinafter, the toner used in the developing unit 25 will be described. The toner preferably has an average shape factor ($ML^2/A\times\pi/4\times100$, where ML represents the maximum length of a toner particle; and A represents the projected area of the toner particle) of 100 to 150, and more preferably 100 to 140. The volume-average particle diameter of the toner is preferably 2 μm to 12 μm, more preferably 3 μm to 12 μm, and still more preferably 3 μm to 9 μm. By using a toner satisfying the above requirements, superior development and transfer efficiencies and image quality can be achieved, as compared with the case where the other toner is used.

The type of the toner is not particularly limited by a production method thereof, as long as the toner satisfies the aforementioned requirements in the average shape factor and volume-average particle size.

Such a toner can be produced, for example, by a kneading pulverization method in which a binder resin, a coloring agent and a releasing agent, and also an antistatic agent and others as needed, are kneaded, pulverized and classified; a method in which the shape of the particles obtained by the kneading pulverization method is changed under mechanical impulsive force or heat energy; an emulsion-polymerization aggregation method in which emulsion-polymerization of a polymerizable monomer for a binder resin is performed, and the formed dispersion, a colorant and a releasing agent, and an antistatic agent and others as needed are mixed, aggregated and heat-fused to form toner particles; a suspension polymerization method in which a polymerizable monomer for a binder resin and a solution containing a coloring agent and a releasing agent, and an antistatic agent and others as needed, are suspended in an aqueous medium and polymerized; a dissolution suspension method in which a polymerizable monomer for a binder resin and a solution containing a coloring agent and a releasing agent, and an antistatic agent and others as needed, are suspended in an aqueous medium and granulation is performed; and the like.

Any known method, for example a method of depositing aggregate particles, onto the toner obtained by the above method as core, and fusing the composite under heat to form a toner having a core-shell structure, may also be used. As for the method of producing a toner, the suspension polymerization method, emulsion-polymerization aggregation method, and dissolution suspension method, i.e., the methods in which the toner is formed in an aqueous medium, are preferable, and the emulsion-polymerization aggregation method is particularly preferable, in view of controlling the shape and the particle diameter distribution of the toner particles.

The toner mother particles contain a binder resin, a coloring agent and a releasing agent, and also silica and an antistatic agent as needed.

Examples of the binder resins for the toner mother particles include homopolymers and copolymers of styrenes such as styrene and chlorostyrene: monoolefins such as ethylene, propylene, butylene, and isoprene; vinyl esters such as vinyl acetate, vinyl propionate, vinyl benzoate, and vinyl butyrate; α-methylene fatty monocarboxylic esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate; vinyl ethers such as vinylmethylether, vinylethylether, and vinylbutylether; vinyl ketones such as vinylmethylketone, vinylhexylketone, and vinylisopropenylketone; as well as polyester resins obtained by copolymerization of a dicarboxylic acid and a diol; and the like.

Particularly representative examples of the binder resins among the above include polystyrene, styrene-alkyl acrylic acid copolymers, styrene-alkyl methacrylic acid copolymers, styrene-acrylonitrile copolymers, styrene-butadiene copolymers, styrene-maleic anhydride copolymers, polyethylene, polypropylene, polyester resins, and the like. Polyurethane, epoxy resins, silicone resins, polyamide, modified rosins, paraffin wax, and the like are also included in the examples.

Examples of the coloring agents include magnetic powders such as magnetite and ferrite, carbon black, aniline blue, Calco Oil blue, chromium yellow, ultramarine blue, du Pont Oil Red, quinoline yellow, methylene blue chloride, phthalocyanine blue, malachite green oxalate, lamp black, rose bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1, C.I. Pigment Blue 15:3, and the like.

Typical examples of the releasing agents include low-molecular weight polyethylene, low-molecular weight polypropylene, Fischer-Tropsch wax, montan wax, carnauba wax, rice wax, candelilla wax, and the like.

Any known compound may be used as the antistatic agent, and favorable examples thereof include azo-based metal complex compounds, salicylic acid metal complex compounds, and polar group-containing resin-type antistatic agents. When a toner is produced in a wet production process, use of materials less soluble in water is preferable, from the viewpoints of controllability of ionic strength and reduction of wastewater pollutions. The toner may be either a magnetic toner containing a magnetic material therein, or a nonmagnetic toner containing no magnetic material therein.

The toner for use in the developing unit 25 is produced by mixing the toner mother particles and the aforementioned external additives, with a Henschel Mixer, a V blender, or the like. When the toner mother particles are produced in a wet process, these additives may be externally added.

Lubricant particles may be added to the toner for use in the developing unit 25. Examples of the lubricant particles for use include solid lubricants such as graphite, molybdenum disulfide, talc, fatty acids, and fatty acid metal salts; low-molecular weight polyolefins such as polypropylene, polyethylene, and polybutene; silicones that are softened under heat; aliphatic amides such as oleic amide, erucic amide, ricinoleic amide, and stearic amide; vegetable waxes such as carnauba wax, rice wax, candelilla wax, Japan tallow, and jojoba oil; animal waxes such as beeswax; mineral/petroleum waxes such as montan wax, ozokerite, ceresin, paraffin wax, microcrystalline wax, and Fischer-Tropsch wax; and the modified derivatives thereof. These substances may be used alone or in combination of two or more. However, the volume average diameter of the particles is preferably in the range of 0.1 μm to 10 μm, and the particles may be obtained by pulverizing a material having the above chemical structure and regulating the particle diameter thereof. The addition amount of the lubricant particles to the toner is preferably in the range of 0.05 wt % to 2.0 wt %, and more preferably 0.1 wt % to 1.5 wt %.

Inorganic particles, organic particles, or composite particles composed of organic particles onto which inorganic particles are deposited, may be added to the toner for use in the developing unit 25, for the purposes of removing an attached substance or deteriorated substance on the surface of the electrophotographic photoreceptor.

Favorable examples of the inorganic particles for use include various inorganic oxides, nitrides, borides and others, such as silica, alumina, titania, zirconia, barium titanate, aluminum titanate, strontium titanate, magnesium titanate, zinc oxide, chromium oxide, cerium oxide, antimony oxide, tungsten oxide, tin oxide, tellurium oxide, manganese oxide, boron oxide, silicon carbide, boron carbide, titanium carbide, silicon nitride, titanium nitride, and boron nitride.

The inorganic particles may also be treated, for example, with a titanium coupling agent such as tetrabutyl titanate, tetraoctyl titanate, isopropyl triisostearoyl titanate, isopropyltridecylbenzenesulfonyl titanate, or bis(dioctyl pyrophosphate)oxyacetate titanate; a silane coupling agent such as γ-(2-aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride salt, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, or p-methylphenyltrimethoxysilane; or the like. Inorganic particles subjected to a hydrophobilizing treatment with a silicone oil or a higher fatty acid metal salt such as aluminum stearate, zinc stearate, or calcium stearate are also favorably used.

Examples of the organic particles include styrene resin particles, styrene acrylic resin particles, polyester resin particles, urethane resin particles, and the like.

As for the particle diameter, the volume average particle diameter is preferably 5 nm to 1,000 nm, more preferably 5 nm to 800 nm, and still more preferably 5 nm to 700 nm. When the volume-average particle diameter is less than the lower limit above, polishing properties of the particles tend to be insufficient, and when the volume-average particle diameter is larger than the upper limit above, the particles tend to cause scratches on the surface of the electrophotographic photoreceptor surface. The total addition amount of the particles described above and the aforementioned lubricant particles is preferably 0.6 wt % or more.

As for the other inorganic oxides added to the toner, it is preferable to use small inorganic oxide particles having a primary particle diameter of 40 nm or less, for the purpose of controlling powder fluidity, electrostatic charge and the like, and further inorganic oxide particles having a larger particle diameter, for the purpose of reducing adhesive force and controlling electrostatic charge. Any known inorganic oxide particles may be used, but are preferably particles of silica and titanium oxide in combination, in view of accurate control of electrostatic charge. Further, by performing a surface treatment to the inorganic particles having a small diameter to heighten the dispersibility thereof, the effect of improving powder fluidity of the toner can be enhanced. Addition of other inorganic minerals, for example, a carbonate salt such as calcium carbonate or magnesium carbonate, or hydrotalcite, is also desirable for the purpose of removing undesired discharge products.

The electrophotographic color toner is used by mixing with a carrier, and examples of the carriers for use include iron powder, glass beads, ferrite powder, nickel powder, and those having the surface coated with a resin. The mixing rate of the carrier to the toner can be appropriately determined.

The cleaning unit 27 has a fibrous member (roll-shaped) 27*a* and a cleaning blade (blade member) 27*b*.

The cleaning unit 27 shown in the drawings is equipped with both of the fibrous member 27*a* and cleaning blade 27*b*, but the unit may have only one of them. The fibrous member 27*a* may also be toothbrush-shaped (flat brush-shaped). The fibrous member 27*a* may be either fixed to or rotatably supported on the cleaning unit main body, or may be supported in an axial direction of the photoreceptor in such a manner that the member can oscillate. The fibrous member 27*a* may have, for example, a shape of a cloth of polyester, nylon, acrylic or the like, or of an ultrafine fiber such as Toraysee (trade name, manufactured by Toray Industries Inc.); or alternatively, a shape of a brush onto which resinous filaments of nylon, acrylic, polyolefin, or polyester, are grafted in a manner of support or carpet. In addition to the fibrous members described above, a member imparted with conductivity by a conductive powder or an ion-conductive substance, or a member having a conductive layer inside or outside of respective filaments, may also be used as the fibrous member 27*a*. When the filament is conductive, the resistance of the filament itself is preferably $10^2\Omega$ to $10^9\Omega$. The thickness of the filament in the fibrous member 27*a* is preferably 30 d (denier) or less, more preferably 20 d or less, and the density of the filaments is preferably 20,000/inch$^2$ or more, and more preferably 30,000/inch$^2$ or more.

In the cleaning unit 27, it is required that the cleaning blade and/or the cleaning brush remove a substance attached on the photoreceptor surface (e.g., discharge products). In order to achieve the above object over an extended period of time and to stabilize the function of the cleaning unit, it is desirable that a lubricating substance (lubricant) such as metal soap, higher alcohol, wax, or silicone oil is supplied to the cleaning unit.

For example, when a roll-shaped article is used as the fibrous member 27*a*, it is desirable to supply, by contacting, a lubricating substance such as metal soap or wax onto the surface of the electrophotographic photoreceptor surface. A common rubber blade can be used as the cleaning blade 27*b*. When a rubber blade is used as the cleaning blade 27*b* in this way, supplying a lubricant onto the surface of the electrophotographic photoreceptor is particularly effective in preventing chipping or abrasion of the blade.

The process cartridge 20 described above is placed removably in the image formation apparatus main body, and constitutes an image formation apparatus together with the image formation apparatus main body.

The exposing unit 30 is not particularly limited, as long as it forms an electrostatic latent image on the charged electrophotographic photoreceptor 1 by exposure. A multibeam surface-emission laser is preferably used as the light source for the exposing unit 30.

The transfer unit 40 is not particularly limited, as long as it transfers the toner image formed on the electrophotographic photoreceptor 1 onto the image-receiving medium (intermediate transfer body 50), and for example, a common roll-shaped unit is used.

As the intermediate transfer body 50, a belt-shaped article (intermediate transfer belt) of a semiconductivity-imparted material such as polyimide, polyamide-imide, polycarbonate, polyarylate, polyester, or rubber is used. The intermediate transfer body 50 may also be drum-shaped. There are image formation apparatuses of the direct transfer type that have no intermediate transfer body, and the electrophotographic photoreceptor in the present exemplary embodiment is also favorably used in such a type of image formation apparatus.

The image-receiving medium is not particularly limited, as long as it receives a toner image transferred from the electrophotographic photoreceptor 1. For example, when the image is transferred directly from the electrophotographic photoreceptor 1 onto paper and the like, the paper and the like corresponds to the image-receiving medium. When the intermediate transfer body 50 is used, the intermediate transfer body corresponds to the image-receiving medium.

Figure 7:
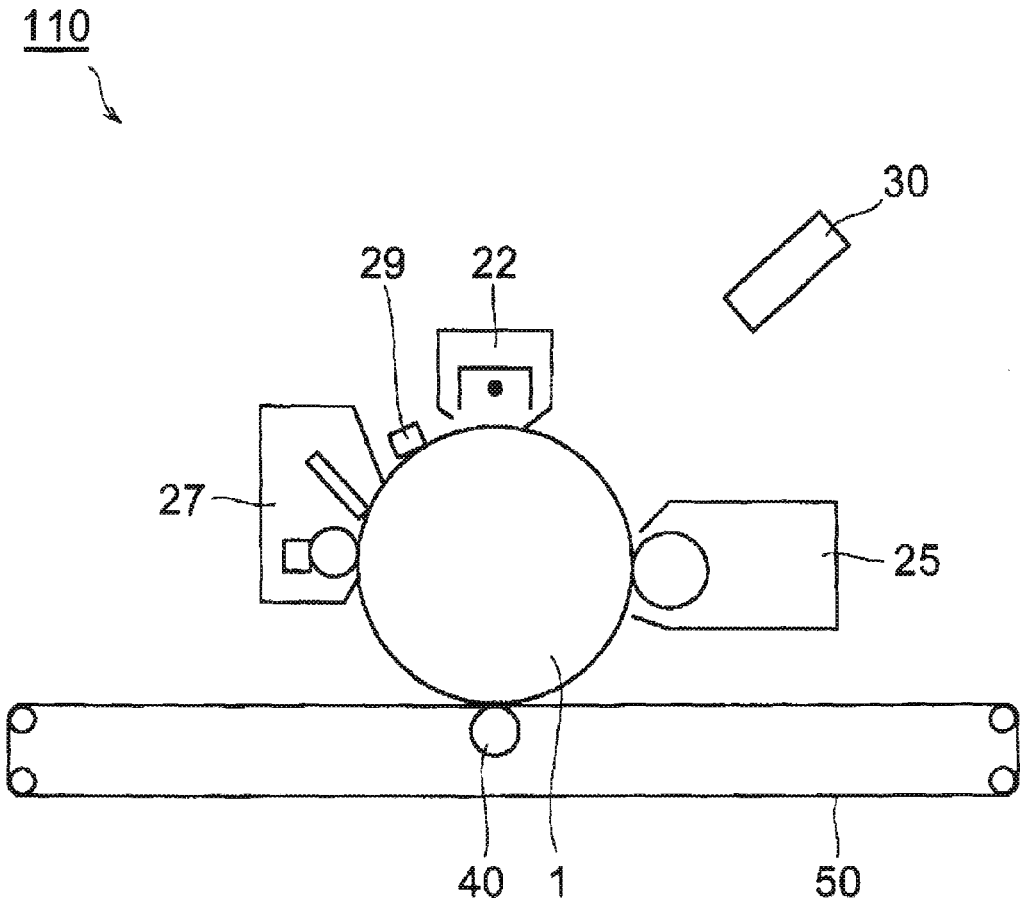
FIGS. 7 to 9 are schematic views of other exemplary embodiments of the electrophotographic photoreceptor of the invention.

FIG. 7 is a schematic view illustrating the image formation apparatus in another exemplary embodiment. In the image formation apparatus 110 shown in FIG. 7, the electrophotographic photoreceptor 1 is fixed on the image formation apparatus main body; and the charging unit 22, the developing unit 25 and the cleaning unit 27 are configured as an electrostatic charging cartridge, development cartridge, and cleaning cartridge, respectively. The charging unit 22 contains a charging unit that electrostatically charges the photoreceptor by corona discharge.

In the image formation apparatus 110, the electrophotographic photoreceptor 1 and the other units are separable from each other, and the charging unit 22, the developing unit 25 and the cleaning unit 27 can be detachably attached by push-and-pull operation to the image formation apparatus main body, without using a screw or nut, or by adhesion or welding.

The electrophotographic photoreceptor in the present exemplary embodiment is superior in durability and thus, may not necessarily be configured into a cartridge. Therefore, the cost per print for the members can be reduced by making the charging unit 22, the developing unit 25 and the cleaning unit 27 detachably attachable by push-and-pull operation in the main unit, instead of fixing it to the main body with a screw or nut or by adhesion or welding. It is also possible to further reduce the cost per print by integrating two or more of these units into a single cartridge and making it detachable.

The image formation apparatus 110 has the same configuration as that of the image formation apparatus 100, except that the charging unit 22, the developing unit 25 and the cleaning unit 27 are respectively integrated into cartridges.

Figure 8:
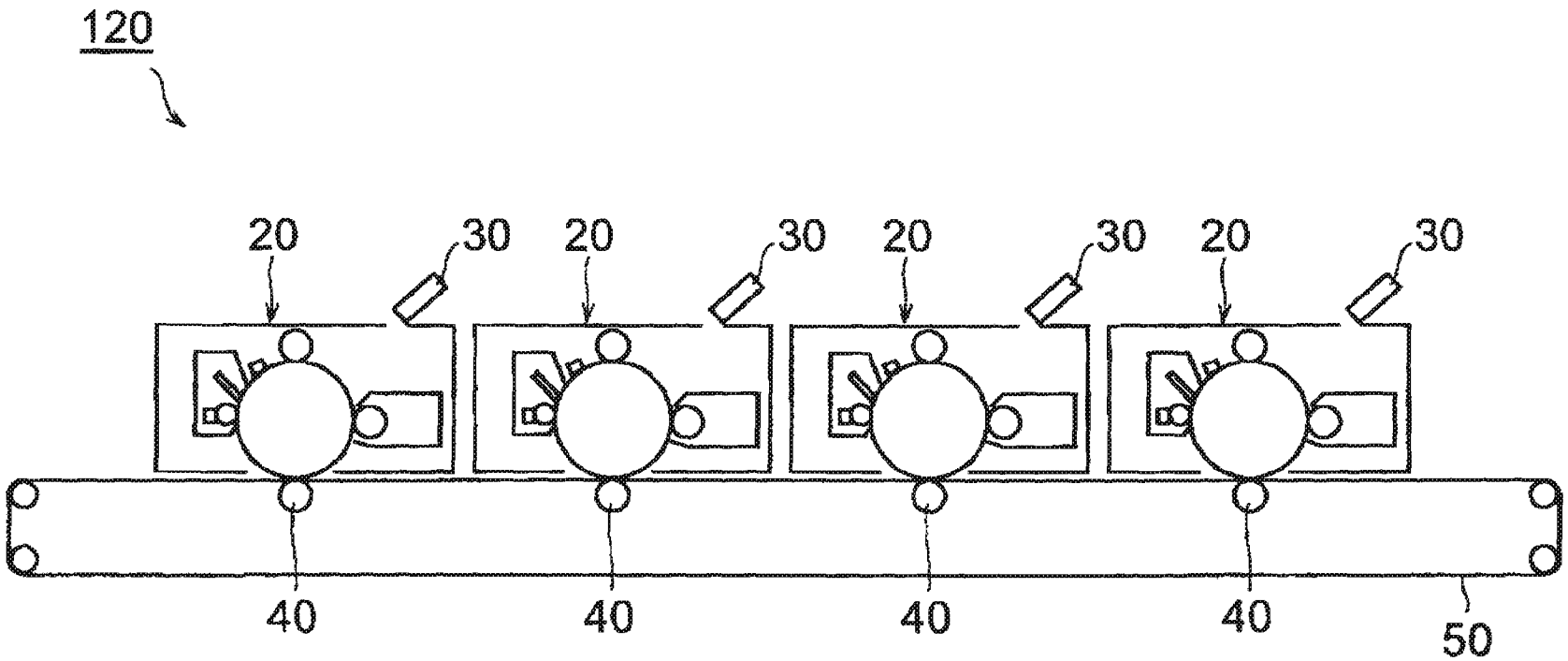

FIG. 8 is a schematic view illustrating the image formation apparatus in yet another exemplary embodiment. The image formation apparatus 120 is a tandem full-color image formation apparatus having four process cartridges 20. The image formation apparatus 120 has a configuration wherein four process cartridges 20 are respectively placed in parallel on the intermediate transfer body 50, and each electrophotographic photoreceptor is used for one color. The image formation apparatus 120 has the same configuration as that of the image formation apparatus 100, except that it is a tandem image formation apparatus.

In such a tandem image formation apparatus 120, the abrasion rate of each electrophotographic photoreceptor varies according to the frequency of use of the color, and thus the electrical properties of each electrophotographic photoreceptor may vary over time. Accordingly, gradual deterioration in toner development characteristics from the initial state may lead to fluctuation in the tint of the print image, prohibiting the formation of reliable images. In particular, an increasing number of small-diameter electrophotographic photosensitive bodies has been increasingly used in order to reduce the size of the image formation apparatus, and the aforementioned tendency is particularly distinctive when a photoreceptor having a diameter of 30 mmϕ or less is used. In this case, if the electrophotographic photoreceptor in the present exemplary embodiment is used as the electrophotographic photoreceptor, it is possible to reduce the surface abrasion, even when the diameter thereof is 30 mmϕ or less. Thus, the electrophotographic photoreceptor in the present exemplary embodiment is particularly effective when used in such a tandem image formation apparatus.

Figure 9:
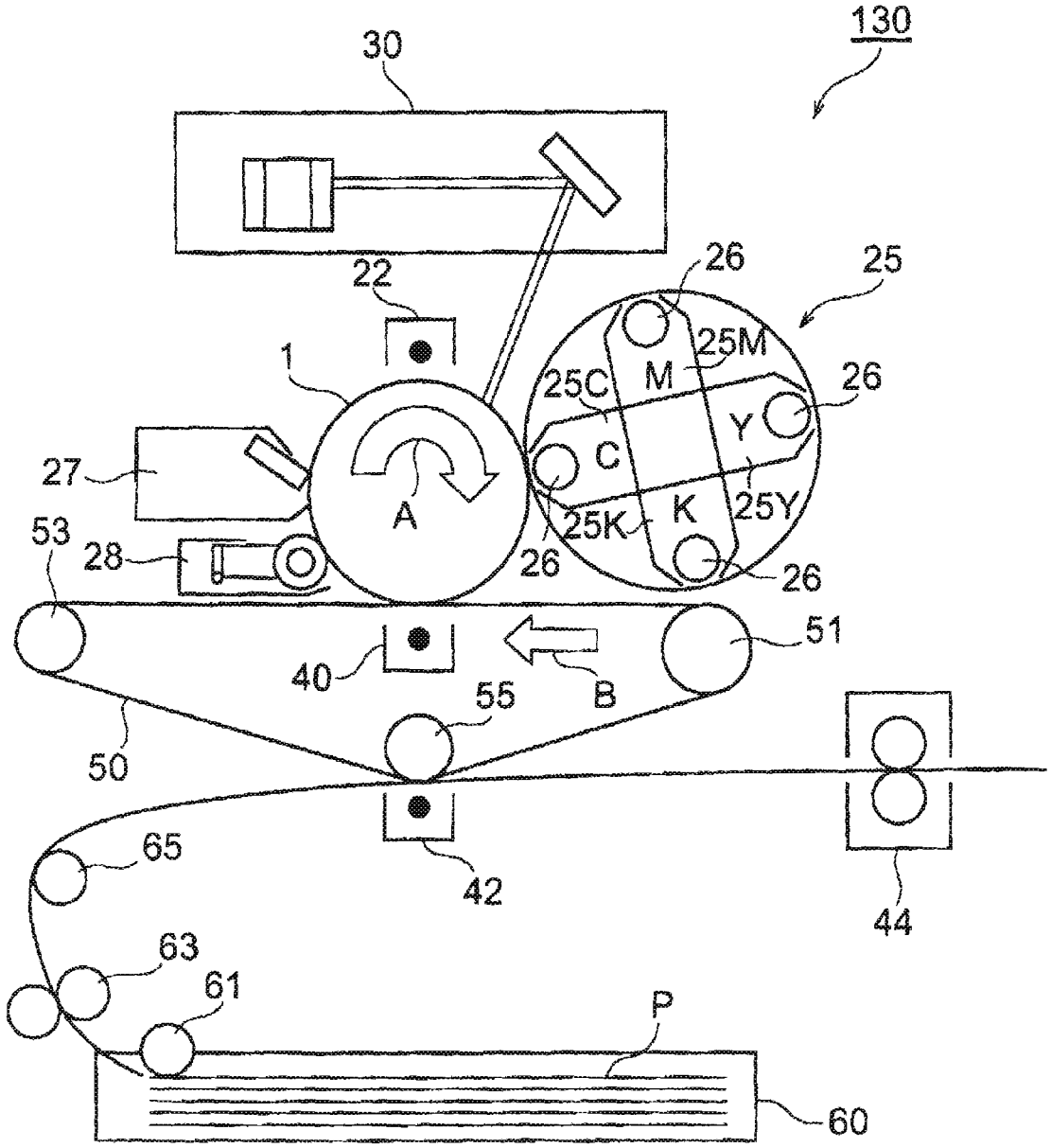

FIG. 9 is a schematic view illustrating the image formation apparatus in yet another exemplary embodiment. The image formation apparatus 130 shown in FIG. 9 is a so-called tour-cycle image formation apparatus that forms a toner image in multiple colors with a single electrophotographic photoreceptor. The image formation apparatus 130 has a photosensitive drum 1 that is revolved in a direction indicated by the arrow A in Figure at a certain rotation velocity by a drive unit (not shown in the figure), and a charging unit 22 that charges the surface of the photosensitive drum 1 is installed above the photosensitive drum 1.

An exposing unit 30 having a surface-emission laser array as an exposure light source is installed above the charging unit 22. The exposing unit 30 modulates multiple laser beams emitted from the light source according to the image to be formed, deflects the beams in a fast scanning direction, and scans the surface of the photosensitive drum 1 in a direction parallel with the shaft line of the photosensitive drum 1. An electrostatic latent image is thus formed on the surface of the charged photosensitive drum 1.

A developing unit 25 is installed at a position beside the photosensitive drum 1. The developing unit 25 is equipped with a roller-shaped container rotatably placed. The container has four compartments inside, and respective compartments have respective developing units 25Y, 25M, 25C and 25K. The developing units 25Y, 25M, 25C and 25K have respective development rollers 26, and respectively contains toners of yellow (Y), magenta (M), cyan (C), and black (K).

A full color image is formed in the image formation apparatus 130 by performing an image formation process for four times. Specifically, during performing the formation for four times on the photosensitive drum 1, the charging unit 22 charges the surface of the photosensitive drum 1, and the exposing unit 30 scans on the surface of photosensitive drum 1 with a laser beam modulated according to one of the image data of Y, M, C, and K corresponding to the color image to be formed, and the above process is repeated while changing the image data used for modulation of the laser beam, after each process of image formation is performed on the photosensitive drum 1. In addition, the developing unit 25 activates one of the developing units at a position of facing the external peripheral surface, while one of the development rollers 26 of any one of developing units 25Y, 25M, 25C, and 25K is in contact with the surface of the photosensitive drum 1, develops the electrostatic latent image in a particular color formed on the external peripheral surface of the photosensitive drum 1, and forms a toner image of the particular color on the surface of the photosensitive drum 1. The above operation is repeated, after each of the images is formed on the photosensitive drum 1, as the container is rotated so that the developing unit used for developing the electrostatic latent image can be switched. In this way, toner images of Y, M, C and K are sequentially formed on the surface of the photosensitive drum 1, during one cycle of image formation rotation of the photosensitive drum 1.

An endless intermediate transfer belt 50 is placed below the photosensitive drum 1. The intermediate transfer belt 50 is trained around rollers 51, 53 and 55, and is placed such that the surface thereof is in contact with the surface of the photosensitive drum 1. The rollers 51, 53 and 55 are revolved by a driving force of a motor (not shown in the Figure) to rotate the intermediate transfer belt 50 in a direction indicated by the arrow B in the figure.

A transfer unit (transfer member) 40 is installed at a position facing the photosensitive drum 1 via the intermediate transfer belt 50, and the toner images of Y, M, C and K formed sequentially on the surface of the photosensitive drum 1 are transferred in a one-by-one manner by the transfer unit 40 onto the image-forming face of the intermediate transfer belt 50, and finally giving a superimposed image composed of the images of Y, M, C and K on the intermediate transfer belt 50.

A lubricant-supplying unit 29 and a cleaning unit 27 are placed on the surface of the photosensitive drum 1, facing the developing unit 25 via the photosensitive drum 1. When the toner image formed on the surface of the photosensitive drum 1 is transferred onto the intermediate transfer belt 50, the lubricant-supplying unit 19 supplies a lubricant to the surface of the photosensitive drum 1, and the region where there was the toner image transferred onto the peripheral surface is cleaned by the cleaning unit 27.

A paper-feeding unit 60 is installed below the intermediate transfer belt 50, and a multiple number of paper sheets P as recording materials are stacked and stored in the paper feeding unit 60. A pickup roller 61 is placed leftward atop the paper feeding unit 60, and a roller pair 63 and a roller 65 are placed in this order at downstream in a pickup direction of the paper P by the pickup roller 61. The recording paper sheet on the top of the stack is drawn out from the paper-feeding unit 60 by rotation of the pickup roller 61 and conveyed by the roller pair 63 and the roller 65.

A transfer unit 42 is placed at a position facing the roller 55 via the intermediate transfer belt 50. The paper sheet P conveyed by the roller pair 63 and the roller 65 is fed into the space between the intermediate transfer belt 50 and the transfer unit 42, where a toner image formed on the image-forming face of the intermediate transfer belt 50 is transferred by the transfer unit 42. A fixing unit 44 equipped with a fusing roller pair is placed at a position downstream of the transfer unit 42 in a direction in which the paper sheet P is conveyed, and after fusing and fixing the transferred toner image by the fixing unit 44, the paper sheet P onto which the toner image is transferred is discharged out of the image formation apparatus 130, and placed onto a paper tray (not shown in the figure).

EXAMPLES

The invention will now be explained by reference to Examples, but the invention is not limited thereto.

Example 1

A cylindrical aluminum support is prepared as a conductive support.

Next, 100 parts by weight of zinc oxide (trade name: SMZ-17N, manufactured by Tayca corporation) is mixed with 500 parts by weight of toluene and stirred, then 2 parts by weight of a silane coupling agent (trade name: A1100, manufactured by Nippon Unicar Company Limited) is added and stirred for five hours. Thereafter, the toluene is distilled off by vacuum distillation and baking is performed at 120° C. for two hours. The obtained surface-treated zinc oxide is analyzed by fluorescence X-rays, and the result is that the ratio of Si element intensity to zinc element intensity is $1.8\times10^{-4}$.

35 parts by weight of the above surface-treated zinc oxide is mixed with 15 parts by weight of a curing agent (trade name: SUMIJULE 3175, blocked isocyanate, manufactured by Sumitomo Bayer Urethane Co., Ltd.), 6 parts by weight of a butyral resin (trade name: S-LEC BM-1, manufactured by Sekisui Chemical Co., Ltd.), and 44 parts by weight of methyl ethyl ketone. The mixture is dispersed for two hours by a sand mill using 1 mmϕ glass beads. To the obtained dispersion, 0.005 parts by weight of dioctyl tin dilaulate as a catalyst and 17 parts by weight of silicone particles (trade name: TOSPAL 130, manufactured by GE Toshiba Silicone Co., Ltd.) are added to obtain an undercoat layer forming solution. The solution is applied onto the above aluminum support by dipping coating, and dried and cured at 160° C. for 100 minutes to obtain an undercoat layer of 20 μm thick. The surface roughness (ten-point average roughness (Rz) as stipulated by JIS B0601 (1994), the disclosure of which is incorporated herein by reference), of the undercoat layer is 0.24 μm, as measured by a surface roughness shape measurer (trade name: SURFCOM 570A, manufactured by Tokyo Seimitsu Co., Ltd,) at a measuring distance of 2.5 mm and a scanning speed of 0.3 mm/sec.

Subsequently, 1 part by weight of hydroxygallium phthalocyanine having strong diffraction peaks at Bragg angles (2θ±0.2°) in X-ray diffraction spectrum of 7.5°, 9.9°, 12.5°, 16.3°, 18.6°, 25.1°, and 28.3° is mixed with 1 part by weight of polyvinyl butyral (trade name: S-LEC BM-S, manufactured by Sekisui Chemical Co., Ltd.) and 100 parts by weight of n-butyl acetate. The mixture is dispersed for an hour with a paint shaker using glass beads, and thus a charge generating layer forming solution is obtained. The solution is applied onto the undercoat layer by dip coating, and heated and dried at 100° C. for ten minutes to form a charge generating layer of 0.15 μm thick.

Next, a charge transporting layer forming solution is obtained by dissolving 2 parts by weight of a benzidine compound represented by the following Formula (XVIII-1) and 2.5 parts by weight of a polymer compound having a structure unit represented by the following Formula (XIX-1) (viscosity average molecular weight: 39,000) in 25 parts by weight of chlorobenzene.

(XVIII-1)

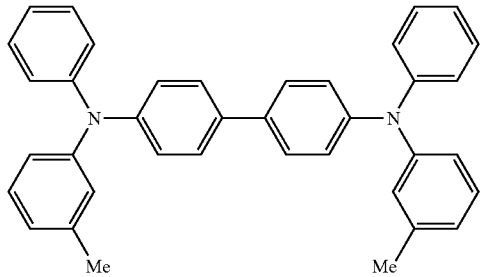

(XIX-1)

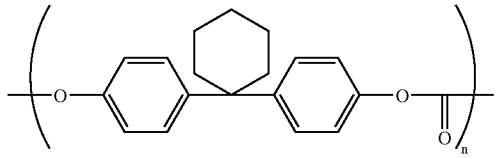

The obtained solution is applied onto the charge generating layer by dip coating, and heated and dried at 12° C. for 40 minutes to form a charge transporting layer of 22 μm thick.

Subsequently, 3 parts by weight of the compound (V-3), 2.7 parts by weight of a phenol resin (trade name: PL-4852, manufactured by Gunei Chemical Industry Co., Ltd.), 0.001 part by weight of fluorine atom-containing sodium sulfonate (trade name: FUTARGENT 100C, manufactured by Neos Company Limited), and 3.5 parts by weight of butanol are mixed to obtain a protective layer forming solution. The solution is applied onto the charge transporting layer by dip coating and air dried at room temperature for ten minutes, and then heated and dried to cure at 140° C. for one hour to form a charge transporting layer of 6 μm thick. The desired electrophotographic photoreceptor (hereinafter, referred to as Photoreceptor-1) is thus obtained.

The same procedures as above are repeated ten times to obtain ten samples of Photoreceptor-1, and the surface conditions of the protective layers of the photoreceptors are visually observed. The film defect ratio is shown in Table 1.

Example 2

The support, undercoat layer, charge generating layer, and charge transporting layer are prepared in the same manner as described in Example 1.

Subsequently, the protective layer forming solution is obtained in the same manner as in Example 1 except that a fluorine atom-containing polyoxyethylene ether (trade name: FUTARGENT 251, manufactured by Neos Company Limited) is used in place of the fluorine atom-containing sodium sulfonate (trade name: FUTARGENT 100C. manufactured by Neos Company limited). Thereafter, a protective layer of 6 μm thick is formed in the same manner as in Example 1 to obtain an electrophotographic photoreceptor (hereinafter, referred to as Photoreceptor-2).

The same procedures as above are repeated ten times to obtain ten samples of Photoreceptor-2, and the surface conditions of the protective layers of the photoreceptors are visually observed. The film defect ratio is shown in Table 1.

Example 3

The support, undercoat layer, charge generating layer, and charge transporting layer are prepared in the same manner as described in Example 1.

Subsequently, the protective layer forming solution is obtained in the same manner as in Example 1 except that a fluorine atom-containing betaine structure compound (trade name: FUTARGENT 400SW, manufactured by Neos Company Limited) is used in place of the fluorine atom-containing sodium sulfonate (trade name: FUTARGENT 100C, manufactured by Neos Company Limited). Thereafter, a protective layer of 6 μm thick is formed in the same manner as in Example 1 to obtain an electrophotographic photoreceptor (hereinafter, referred to as Photoreceptor-3).

The same procedures as above are repeated ten times to obtain ten samples of Photoreceptor-3, and the surface conditions of the protective layers of the photoreceptors are visually observed. The film defect ratio is shown in Table 1.

Example 4

The support, undercoat layer, charge generating layer, and charge transporting layer are prepared in the same manner as described in Example 1.

Subsequently, the protective layer forming solution is obtained in the same manner as in Example 1 except that a fluorine atom-containing polyoxyethylene ether (trade name: POLYFOX PF6520, manufactured by Kitamura Chemicals Co., Ltd.) is used in place of the fluorine atom-containing sodium sulfonate (trade name: FUTARGENT 100C, manufactured by Neos Company Limited). Thereafter, a protective layer of 6 μm thick is formed in the same manner as in Example 1 to obtain an electrophotographic photoreceptor (hereinafter, referred to as Photoreceptor-4).

The same procedures as above are repeated ten times to obtain ten samples of Photoreceptor-4, and the surface conditions of the protective layers of the photoreceptors are visually observed. The film defect ratio is shown in Table 1.

Example 5

The support undercoat layer, charge generating layer, and charge transporting layer are prepared in the same manner as described in Example 1.

Subsequently, the protective layer forming solution is obtained in the same manner as in Example 1 except that a perfluorobutane carboxylate (trade name: MEGAFAC F-114, manufactured by Dainippon Ink and Chemicals, Inc.) is used in place of the fluorine atom-containing sodium sulfonate (trade name: FUTARGENT 100C, manufactured by Neos Company limited). Thereafter, a protective layer of 6 μm thick is formed in the same manner as in Example 1 to obtain an electrophotographic photoreceptor (hereinafter, referred to as Photoreceptor-5).

The same procedures as above are repeated ten times to obtain ten samples of Photoreceptor-5, and the surface conditions of the protective layers of the photoreceptors are visually observed. The film defect ratio is shown in Table 1.

Example 6

The support, undercoat layer, charge generating layer, and charge transporting layer are prepared in the same manner as described in Example 1.

Subsequently, the protective layer forming solution is obtained in the same manner as in Example 1 except that a fluorine atom-containing acrylic compound (trade name: FTOP FE351 manufactured by JEMCO Inc.) is used in place of the fluorine atom-containing sodium sulfonate (trade name: FUTARGENT 100C, manufactured by Neos Company Limited). Thereafter, a protective layer of 6 μm thick is formed in the same manner as in Example 1 to obtain an electrophotographic photoreceptor (hereinafter, referred to as Photoreceptor-6).

The same procedures as above are repeated ten times to obtain ten samples of Photoreceptor-6, and the surface conditions of the protective layers of the photoreceptors are visually observed. The film defect ratio is shown in Table 1.

Example 7

The support, undercoat layer, charge generating layer, and charge transporting layer are prepared in the same manner as described in Example 1.

Subsequently, the protective layer forming solution is obtained in the same manner as in Example 1 except that a fluorine atom-containing acrylic compound (trade name: POLYFLOW KL-600, manufactured by Kyoeisha Chemical Co., Ltd.) is used in place of the fluorine atom-containing sodium sulfonate (trade name: FUTARGENT 100C, manufactured by Neos Company Limited). Thereafter, a protective layer of 6 μm thick is formed in the same manner as in Example 1 to obtain an electrophotographic photoreceptor (hereinafter, referred to as Photoreceptor-7).

The same procedures as above are repeated ten times to obtain ten samples of Photoreceptor-7, and the surface conditions of the protective layers of the photoreceptors are visually observed. The film defect ratio is shown in Table 1.

Example 8

The protective layer forming solution is obtained in the same manner as in Example 7 except that a compound (I-13) is used in place of the compound (V-3). Thereafter, a protective layer of 6 μm thick is formed in the same manner as in Example 1 to obtain an electrophotographic photoreceptor (hereinafter, referred to as Photoreceptor-8).

The same procedures as above are repeated ten times to obtain ten samples of Photoreceptor-8, and the surface conditions of the protective layers of the photoreceptors are visually observed. The film defect ratio is shown in Table 1.

Example 9

The protective layer forming solution is obtained in the same manner as in Example 7 except that a compound (II-1) is used in place of the compound (V-3). Thereafter, a protective layer of 6 μm thick is formed in the same manner as in Example 1 to obtain an electrophotographic photoreceptor (hereinafter, referred to as Photoreceptor-9).

The same procedures as above are repeated ten times to obtain ten samples of Photoreceptor-9, and the surface conditions of the protective layers of the photoreceptors are visually observed. The film defect ratio is shown in Table 1.

Example 10

The protective layer forming solution is obtained in the same manner as in Example 7 except that a compound (III-3) is used in place of the compound (V-3). Thereafter, a protective layer of 6 μm thick is formed in the same manner as in Example 1 to obtain an electrophotographic photoreceptor (hereinafter, referred to as Photoreceptor-10).

The same procedures as above are repeated ten times to obtain ten samples of Photoreceptor-10, and the surface conditions of the protective layers of the photoreceptors are visually observed. The film defect ratio is shown in Table 1.

Example 11

The protective layer forming solution is obtained in the same manner as in Example 7 except that a compound (IV-6) is used in place of the compound (V-3). Thereafter, a protective layer of 6 μm thick is formed in the same manner as in Example 1 to obtain an electrophotographic photoreceptor (hereinafter, referred to as Photoreceptor-11).

The same procedures as above are repeated ten times to obtain ten samples of Photoreceptor-11, and the surface conditions of the protective layers of the photoreceptors are visually observed. The film defect ratio is shown in Table 1.

Example 12

The protective layer forming solution is obtained in the same manner as in Example 7 except that the content of the fluorine atom-containing acrylic compound (trade name: POLYFLOW KL-600, manufactured by Kyoeisha Chemical Co., Ltd.) is changed to 0.00057 part by weight from 0.001 part by weight. Thereafter, a protective layer of 6 μm thick is formed in the same manner as in Example 1 to obtain an electrophotographic photoreceptor (hereinafter, referred to as Photoreceptor-12).

The same procedures as above are repeated ten times to obtain ten samples of Photoreceptor-12, and the surface conditions of the protective layers of the photoreceptors are visually observed. The film defect ratio is shown in Table 1.

Example 13

The protective layer forming solution is obtained in the same manner as in Example 7 except that the content of the fluorine atom-containing acrylic compound (trade name: POLYFLOW KL-600, manufactured by Kyoeisha Chemical Co., Ltd.) is changed to 0.057 part by weight from 0.001 part by weight. Thereafter, a protective layer of 6 μm thick is formed in the same manner as in Example 1 to obtain an electrophotographic photoreceptor (hereinafter, referred to as Photoreceptor-13).

The same procedures as above are repeated ten times to obtain ten samples of Photoreceptor-13, and the surface conditions of the protective layers of the photoreceptors are visually observed. The film defect ratio is shown in Table 1.

Example 14

The protective layer forming solution is obtained in the same manner as in Example 7 except that the content of the fluorine atom-containing acrylic compound (trade name: POLYFLOW KL-600, manufactured by Kyoeisha Chemical Co., Ltd.) is changed to 0.029 part by weight from 0.001 part by weight. Thereafter, a protective layer of 6 μm thick is formed in the same manner as in Example 1 to obtain an electrophotographic photoreceptor (hereinafter, referred to as Photoreceptor-14).

The same procedures as above are repeated ten times to obtain ten samples of Photoreceptor-14, and the surface conditions of the protective layers of the photoreceptors are visually observed. The film defect ratio is shown in Table 1.

Comparative Example 1

The protective layer forming solution is obtained in the same manner as in Example 7 except that the fluorine atom-containing acrylic compound is not used. Thereafter, a protective layer of 6 μm thick is formed in the same manner as in Example 1 to obtain an electrophotographic photoreceptor (hereinafter, referred to as Photoreceptor-comparative 1).

The same procedures as above are repeated ten times to obtain ten samples of Photoreceptor-comparative 1, and the surface conditions of the protective layers of the photoreceptors are visually observed. The film defect ratio is shown in Table 1.

Evaluation

The obtained electrophotographic photoreceptor is set in a printer (trade name: DocuCentre Color 400CP, manufactured by Fuji Xerox Corporation). A 10,000-sheet image formation test (image density: 15%) is performed at high temperature and high humidity (28° C., 80% RH), and another 10,000-sheet image formation test (image density: 15%) is performed at low temperature and low humidity (10° C., 20% RH). After the image formation tests, evaluations described below are carried out. The obtained results are shown in Table 2. In the image formation tests, sheets of A3-size J paper (manufactured by Fuji Xerox Office Supply Co., Ltd.) are used.

Scratches on Photoreceptor—

The existence of scratches on the photoreceptor is visually observed and evaluated in accordance with the following criteria.

A: No scratch is found

B: Scratches are partially found (not problematic in image quality)

C: Scratches are found (problematic in image quality)

Existence of Attached Substance—

The existence of attached substance on the photoreceptor is visually observed and evaluated in accordance with the following criteria.

A: No attached substance is found

B: Existence of the attached substance is partially observed (not problematic in image quality)

C: Existence of the attached substance is observed (problematic in image quality)

Toner Cleaning Property—

The toner cleaning property is visually observed and evaluated in accordance with the following criteria.

A: Favorable

B: Image defects such as streaks are partially found (not problematic in image quality)

C: Image defects are extensively found (problematic in image quality

Fine Line Reproducibility—

After the aforementioned image formation test at high temperature and high humidity and the subsequent image formation test at low temperature and low humidity, an image for fine line evaluation having 1-dot line and 2-dot line is printed, and the fine line reproducibility of the fine line image is evaluated in accordance with the following criteria.

A: No tapering is observed in the 1-dot line or the 2-dot line.

B: Tapering of 50% or less is observed in the 2-dot line.

C: Tapering of more than 50% in the 2-dot line and discontinuity in the 1-dot line are observed.

Half Tone Reproducibility—

The half tone reproducibility is observed with a magnifier and evaluated in accordance with the following criteria.

A: No detect is observed in the half tone image

B: Irregularities are slightly observed in the half tone image (not problematic in practical use)

C: Irregularities are found in the half tone image (problematic when a color printer with strict specifications is used)

Noises—

The existence of noises is evaluated in accordance with the following criteria.

A: Noises are not generated during running or stopping.

B: Noises are slightly generated during stopping (not problematic in practical use)

C: Noises are generated during running (problematic in practical use)

Blade Chipping—

The existence of blade chippings is observed with a laser microscope and evaluated in accordance with the following criteria.

A: No chipping of 100 μm or more in width is observed

B: 1 to 3 of chippings of 100 μm or more in width are observed (not problematic in practical use)

C: 4 or more of chippings of 100 μm or more in width are observed (problematic in practical use)

TABLE 1

| | | Film Defect Ratio |
|---|---|---|
| Example 1 | Photoreceptor-1 | 1/10 |
| Example 2 | Photoreceptor-2 | 0/10 |
| Example 3 | Photoreceptor-3 | 1/10 |
| Example 4 | Photoreceptor-4 | 0/10 |
| Example 5 | Photoreceptor-5 | 0/10 |
| Example 6 | Photoreceptor-6 | 0/10 |
| Example 7 | Photoreceptor-7 | 0/10 |
| Example 8 | Photoreceptor-8 | 1/10 |
| Example 9 | Photoreceptor-9 | 0/10 |
| Example 10 | Photoreceptor-10 | 2/10 |
| Example 11 | Photoreceptor-11 | 0/10 |
| Example 12 | Photoreceptor-12 | 1/10 |
| Example 13 | Photoreceptor-13 | 1/10 |
| Example 14 | Photoreceptor-14 | 0/10 |
| Comparative example 1 | Photoreceptor-comparative 1 | 7/10 |

TABLE 2

| | | High Temperature and High Humidity | | | | Low Temperature and Low Humidity | | | | Photoreceptor | |
|---|---|---|---|---|---|---|---|---|---|---|---|
| | | Fine line reproducibility | Half tone reproducibility | Noises | Blade chipping | Fine line reproducibility | Half tone reproducibility | Noises | Blade chipping | Scratches | Attached substance |
| Example 1 | Photoreceptor-1 | A | A | A | A | A | B | A | B | A | B |
| Example 2 | Photoreceptor-2 | A | A | A | A | A | A | A | A | A | A |
| Example 3 | Photoreceptor-3 | A | A | A | A | A | B | A | B | A | A |
| Example 4 | Photoreceptor-4 | A | A | A | A | A | A | A | A | A | A |
| Example 5 | Photoreceptor-5 | A | A | A | B | B | B | A | A | A | A |
| Example 6 | Photoreceptor-6 | A | A | A | A | A | A | A | A | A | A |
| Example 7 | Photoreceptor-7 | A | A | A | A | A | A | A | A | A | A |
| Example 8 | Photoreceptor-8 | A | A | A | A | B | B | A | B | A | B |
| Example 9 | Photoreceptor-9 | A | A | A | A | A | A | A | A | A | A |
| Example 10 | Photoreceptor-10 | A | A | A | A | B | B | A | B | B | A |
| Example 11 | Photoreceptor-11 | A | A | A | A | A | A | A | A | A | A |
| Example 12 | Photoreceptor-12 | A | A | A | A | B | B | A | B | B | A |
| Example 13 | Photoreceptor-13 | A | A | A | A | B | B | A | B | B | A |
| Example 14 | Photoreceptor-14 | A | A | A | A | A | A | A | A | A | A |
| Comparative example 1 | Photorecepto-comparative 1 | A | B | C | C | B | B | C | C | B | C |

From the above results, it is understood that the photoreceptors of examples have favorable fine line reproducibility, half tone reproducibility, noises and blade chipping, under both of the conditions of high temperature and humidity and low temperature and humidity, as compared with the photoreceptor of comparative example. Additionally, it is understood that the photoreceptors of examples have favorable surface conditions on the photoreceptor (existences of scratches and accretion), as compared with the photoreceptor of comparative example.

All publications, patent applications, and technical standards mentioned in this specification are herein incorporated by reference to the same extent as if each individual publication, patent application, or technical standard was specifically and individually indicated to be incorporated by reference.

What is claimed is:

1. An electrophotographic photoreceptor comprising a conductive support and a photosensitive layer provided on or above the conductive support, the photosensitive layer having an outermost layer comprising a cured product of a composition comprising a curable resin, a surfactant containing a fluorine atom, and at least one charge transporting organic compound represented by any one of the following formulae (I) to (V):

$$F—[(X^2)_{n2}—(R^2)_{n3}—(Z^2)_{n4}G]_{n5} \quad (I)$$

wherein in Formula (I): F represents an n5-valent organic group derived from a compound having a hole transporting capability; $X^2$ represents an oxygen atom or a sulfur atom; $R^2$ represents an alkylene group; $Z^2$ represents an oxygen atom, a sulfur atom, NH or COO; G represents an epoxy group; n2, n3 and n4 each independently represent 0 or 1; and n5 is an integer of 1 to 4:

$$F\text{-}[\text{-}D\text{-}Si(R^3)_{(3-a)}Q_a]_b \quad (II)$$

wherein in Formula (II): F represents a b-valent organic group derived from a compound having a hole transporting capability; D represents a bivalent group; $R^3$ represents a hydrogen atom, a substituted or unsubstituted alkyl group, or a substituted or unsubstituted aryl group; Q represents a hydrolyzable group; a is an integer of 1 to 3; and b is an integer of 1 to 4:

(III)

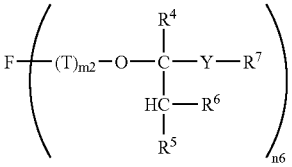

wherein in Formula (III): F represents an n6-valent organic group derived from a compound having a hole transporting capability; T represents a bivalent group; Y represents an oxygen atom or a sulfur atom; $R^4$, $R^5$ and $R^6$ each independently represent a hydrogen atom or a monovalent organic group; $R^7$ represents a monovalent organic group; m2 is 0 or 1; n6 is an integer of 1 to 4; and $R^6$ and $R^7$ may bind to each other to form a heterocyclic ring containing Y as the heteroatom:

(IV)

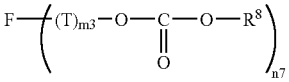

wherein in Formula (IV): F represents an n7-valent organic group derived from a compound having a hole transporting capability; T represents a bivalent group; $R^8$ represents a monovalent organic group; m3 is 0 or 1; and n7 is an integer of 1 to 4:

(V)

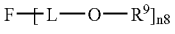

wherein in Formula (V): F represents an n8-valent organic group derived from a compound having a hole transporting capability; L represents an alkylene group; $R^9$ represents a monovalent organic group; and n8 is an integer of 1 to 4, wherein the content of the surfactant is from about 0.01% by weight to about 1% by weight with respect to the total content of the outermost layer.

2. The electrophotographic photoreceptor according to claim 1, wherein the surfactant has an alkylene oxide structure.

3. The electrophotographic photoreceptor according to claim 1, wherein the surfactant has an acrylic structure.

4. The electrophotographic photoreceptor according to claim 1, wherein the surfactant has a perfluoroalkyl group.

5. The electrophotographic photoreceptor according to claim 1, wherein the content of the surfactant is from about 0.02% by weight to about 0.5% by weight with respect to the total content of the outermost layer.

6. The electrophotographic photoreceptor according to claim 1, wherein the curable resin is an alcohol-soluble resin.

7. The electrophotographic photoreceptor according to claim 1, wherein the curable resin is a phenol resin.

8. The electrophotographic photoreceptor according to claim 1, wherein the outermost layer further comprises conductive inorganic particles.

9. The electrophotographic photoreceptor according to claim 1, wherein the outermost layer further comprises a compound represented by the following formula:

$$Si(R^{50})_{(4-c)}Q_c$$

wherein in the formula: $R^{50}$ represents a hydrogen atom, an alkyl group or a substituted or unsubstituted aryl group; Q represents a hydrolyzable group; and c is an integer of 1 to 4.

10. The electrophotographic photoreceptor according to claim 1, wherein the outermost layer further comprises a compound represented by the following formula:

$$B—(Si(R^{51})_{(3-d)}Q_d)_2$$

wherein in the formula: B represents a bivalent organic group; $R^{51}$ represents a hydrogen atom, an alkyl group or a substituted or unsubstituted aryl group; Q represents a hydrolyzable group; and d is an integer of 1 to 3.

11. The electrophotographic photoreceptor according to claim 1, wherein the outermost layer further comprises a cyclic compound or a derivative thereof having a repeating unit represented by the following formula:

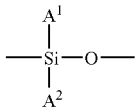

wherein in the formula, $A^1$ and $A^2$ each independently represent a monovalent organic group.

12. The electrophotographic photoreceptor according to claim 1, wherein the outermost layer further comprises silicon atom-containing particles.

13. The electrophotographic photoreceptor according to claim 1, wherein the outermost layer further comprises an antioxidant.

14. The electrophotographic photoreceptor according to claim 1, wherein the photosensitive layer comprises an undercoat layer, a charge-generating layer, a charge-transporting layer and a protective layer, and wherein the protective layer is the outermost layer.

15. A process cartridge comprising the electrophotographic photoreceptor according to claim 1 and at least one selected from the group consisting of a charging unit that charges the electrophotographic photoreceptor, a development unit that develops an electrostatic latent image with a toner to form a toner image, and a toner removing unit that removes the residual toner on the surface of the electrophotographic photoreceptor.

16. An image forming apparatus comprising:

the electrophotographic photoreceptor according to claim 1;

a charging unit that charges the electrophotographic photoreceptor;

an exposing unit that forms an electrostatic latent image on the charged electrophotographic photoreceptor;

a development unit that develops the electrostatic latent image with a toner to form a toner image; and a transferring unit that transfers the toner image onto a transferring body.

* * * * *